US005403112A

United States Patent [19]

Carney, III

[11] Patent Number: 5,403,112

[45] Date of Patent: Apr. 4, 1995

[54] CRASH IMPACT ATTENUATOR CONSTRUCTED FROM HIGH MOLECULAR WEIGHT/HIGH DENSITY POLYETHYLENE

[75] Inventor: John F. Carney, III, Nashville, Tenn.

[73] Assignee: Vanderbilt University, Nashville, Tenn.

[21] Appl. No.: 118,461

[22] Filed: Sep. 8, 1993

[51] Int. Cl.[6] ..... F01F 13/00

[52] U.S. Cl. ..... 404/6; 256/13.1

[58] Field of Search ..... 404/6, 9, 10; 256/13.1

[56] References Cited

U.S. PATENT DOCUMENTS

| | | | |
|---|---|---|---|
| 1,839,015 | 12/1931 | Deveaux | 454/363 |
| 3,845,936 | 11/1974 | Boedecker | 256/1 |
| 4,146,113 | 3/1979 | Gavel | 181/210 |
| 4,190,275 | 2/1980 | Mileti | 293/102 |
| 4,200,310 | 4/1980 | Carney, III | 280/784 |
| 4,583,716 | 4/1986 | Stephens et al. | 256/13.1 |
| 4,600,178 | 7/1986 | Zucker et al. | 256/1 |
| 4,645,375 | 2/1987 | Carney, III | 404/6 |
| 4,658,941 | 4/1987 | Gottwald et al. | 188/377 |
| 4,711,481 | 12/1987 | Krage et al. | 293/133 |
| 4,797,026 | 1/1989 | Webster | 404/28 |
| 5,011,326 | 4/1991 | Carney, III | 404/6 |
| 5,031,947 | 7/1991 | Chen | 293/135 |
| 5,052,732 | 12/1991 | Oplet et al. | 293/102 |
| 5,120,154 | 6/1992 | Lasch et al. | 404/14 |
| 5,125,762 | 6/1992 | Strassil | 404/6 |
| 5,199,755 | 4/1993 | Gertz | 293/120 |
| 5,234,280 | 8/1993 | Cowan | 404/6 |

FOREIGN PATENT DOCUMENTS

| | | | |
|---|---|---|---|
| 2251749 | 10/1992 | Germany | 404/352 |
| 363658 | 12/1931 | United Kingdom | 293/136 |

OTHER PUBLICATIONS

"Polyolefin Piping", Plastics Pipe Institute Brochure.

Amsted Industries PLEXCO Bulletins, Nos. 101, 104, 108 and 112, and Application Notes, Nos. 1-13.

*Primary Examiner*—Ramon S. Britts

*Assistant Examiner*—James A. Lisehora

*Attorney, Agent, or Firm*—Waddey & Patterson

[57] ABSTRACT

A crash impact attenuator including one or more cylinders, each bolted or otherwise connected to the adjacent cylinder and such cylinders being connected to the platform of a service vehicle or to an abutment adjacent a highway wherein the cylinders are constructed from a high molecular weight/high density polyethylene material.

5 Claims, 50 Drawing Sheets

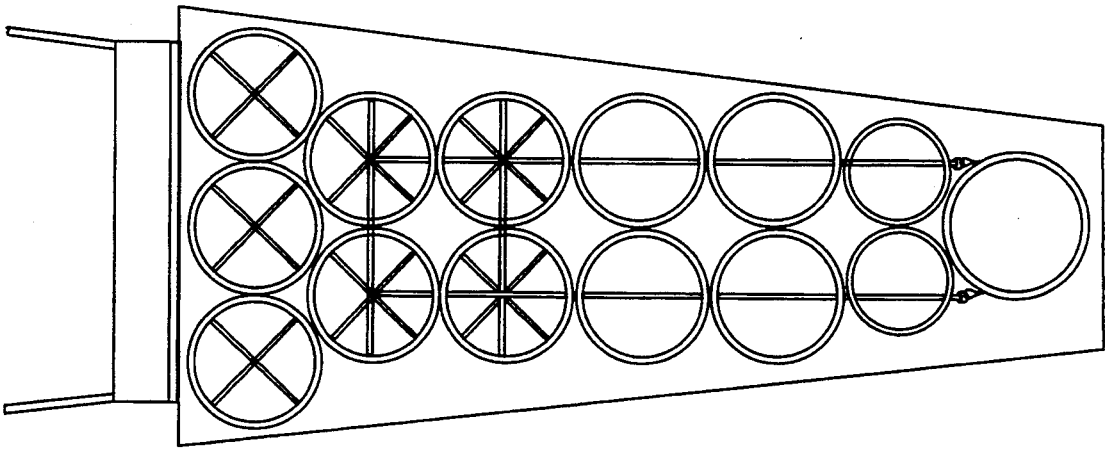
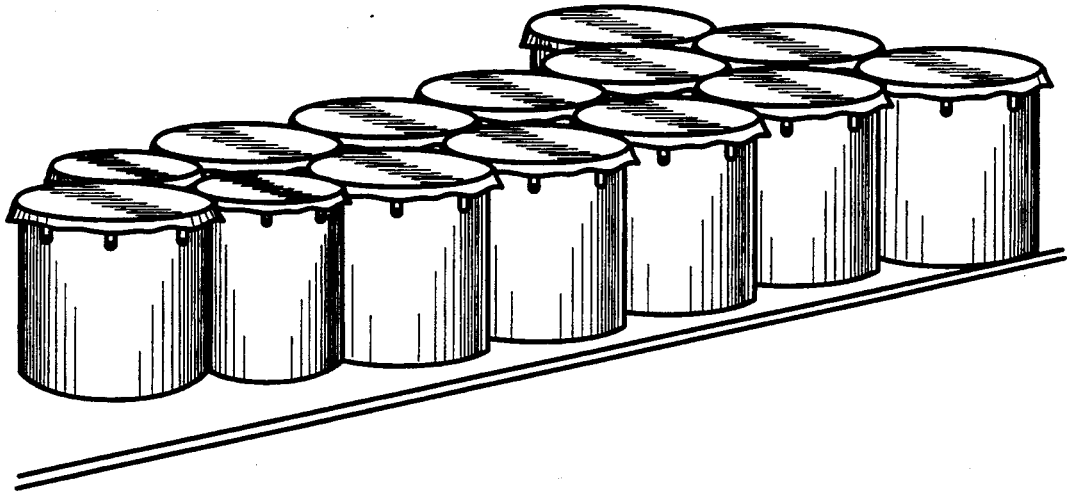
*FIG. 2*

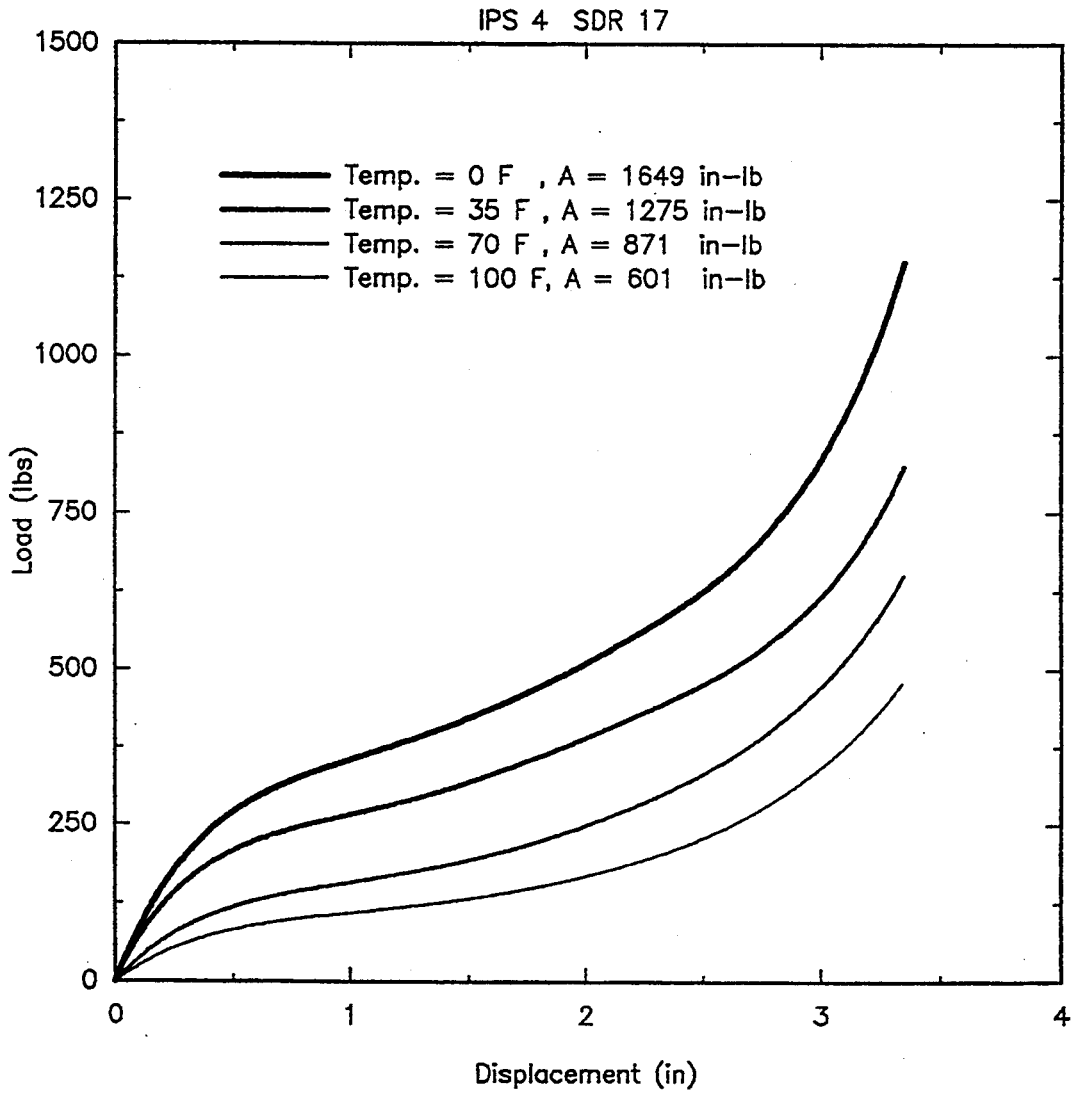
Figure 5. Quasi-static Load vs. Displacement for IPS 4 SDR 17.

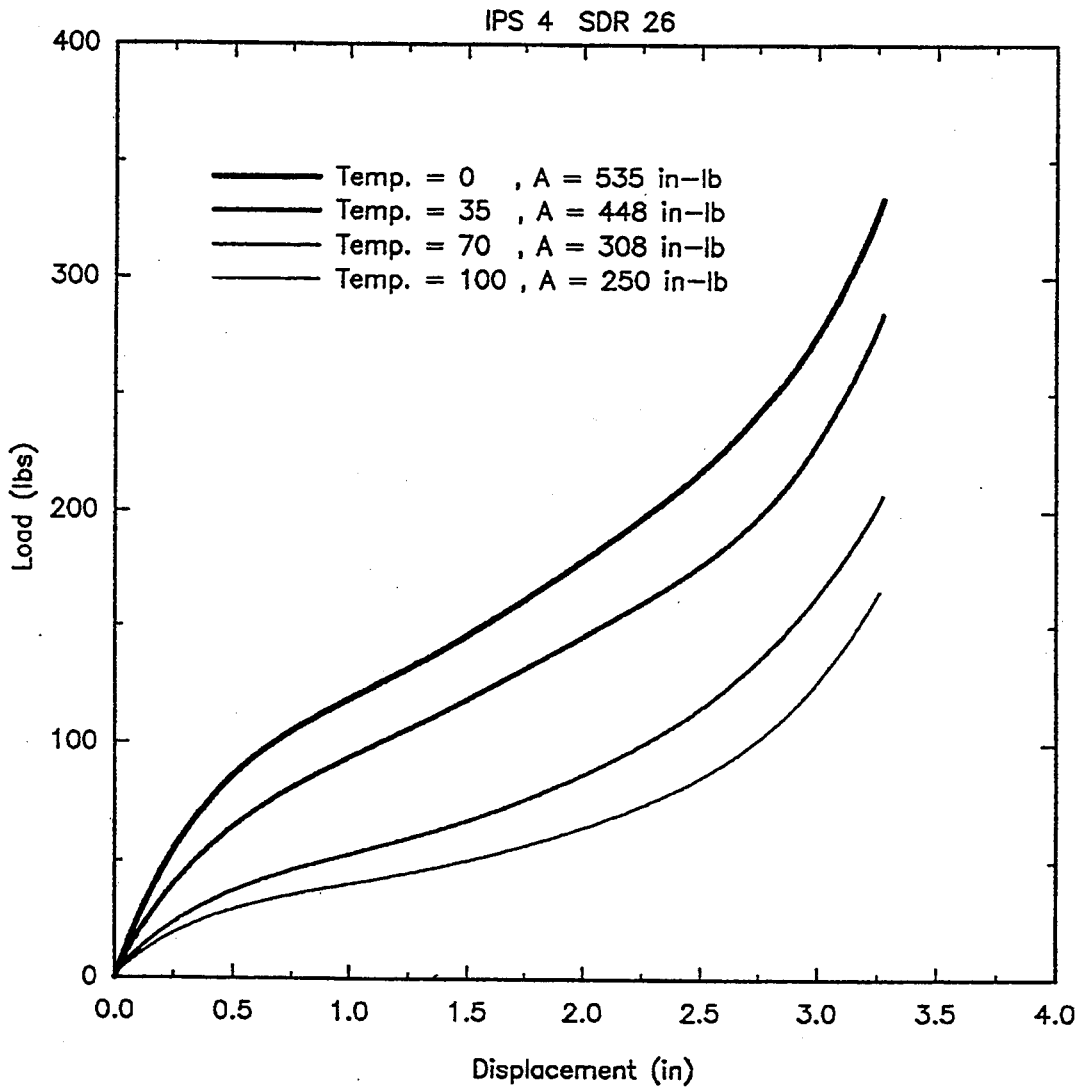
Figure 6. Quasi-static Load vs. Displacement for IPS 4 SDR 26.

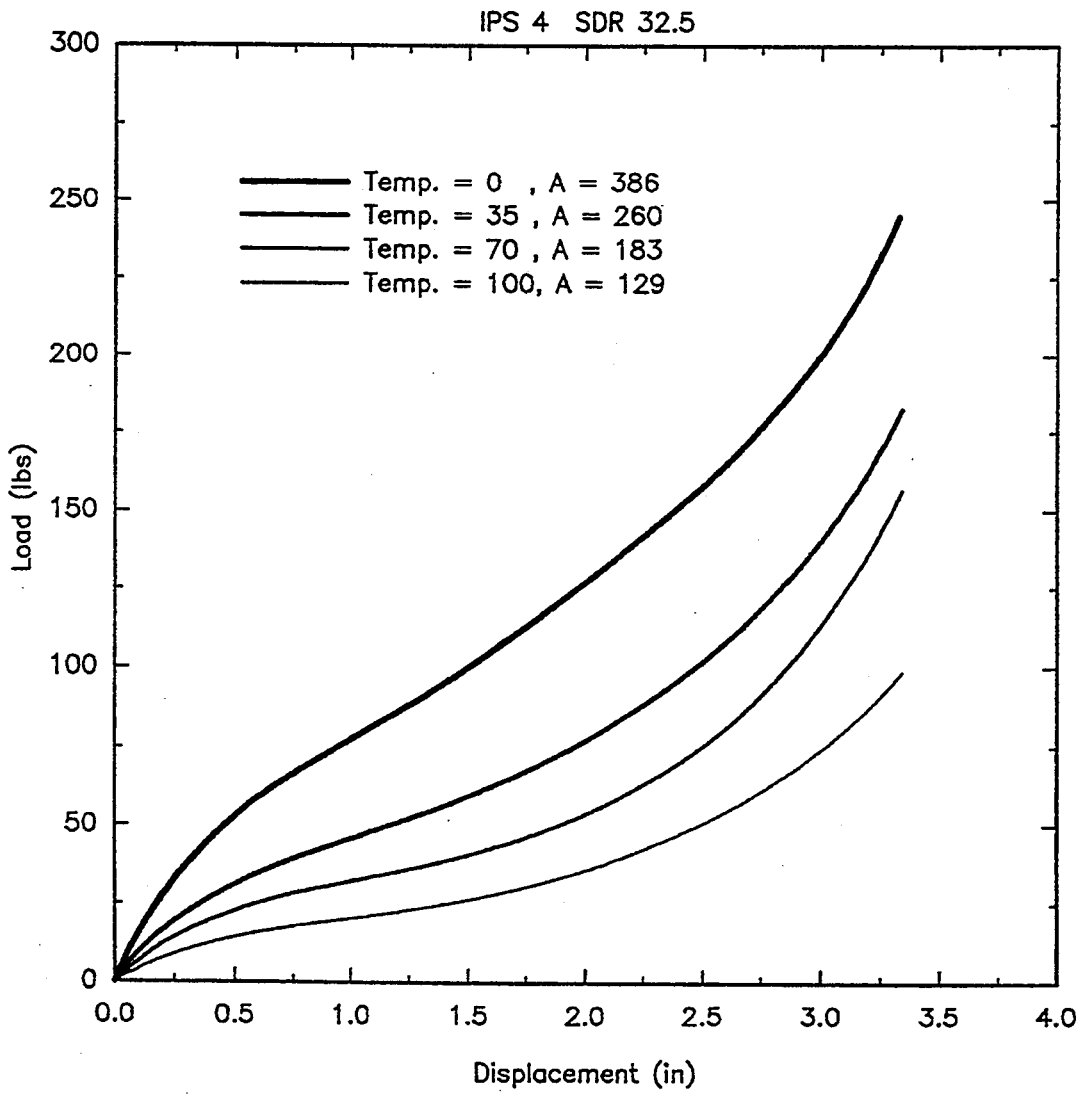
Figure 7. Quasi-static Load vs. Displacement for IPS 4 SDR 32.5.

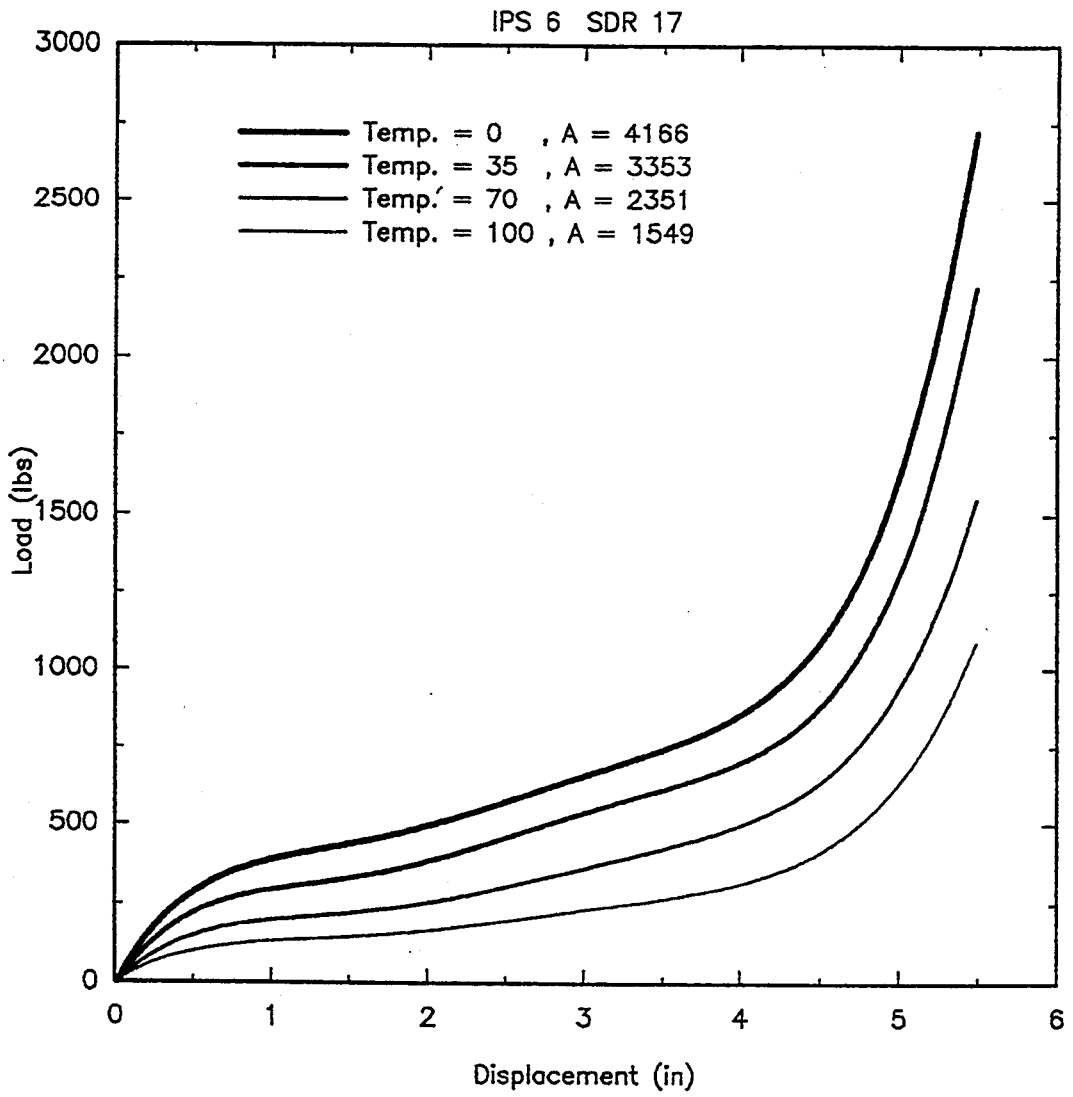
Figure 8. Quasi-static Load vs. Displacement for IPS 6 SDR 17.

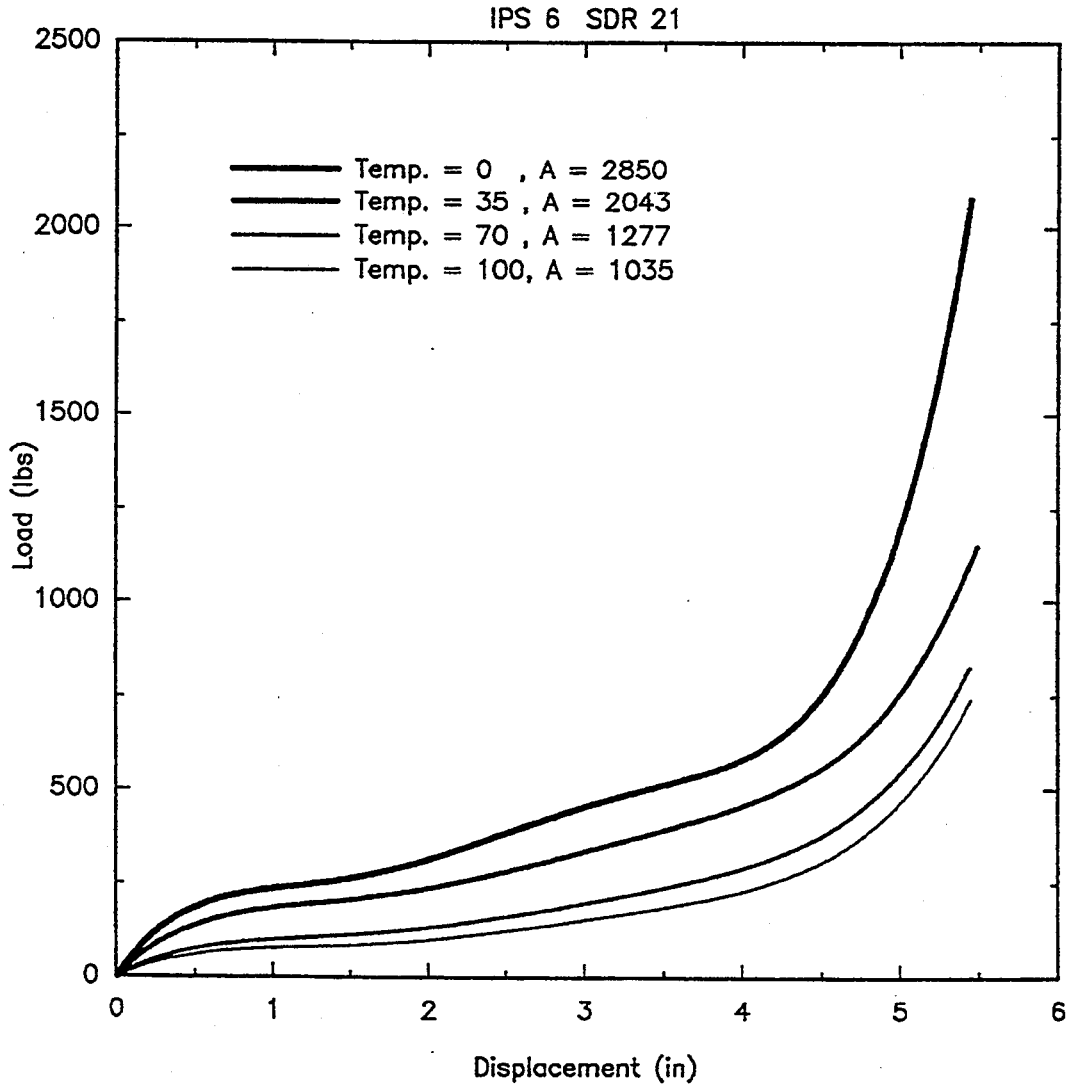
Figure 9. Quasi-static Load vs. Displacement for IPS 6 SDR 21.

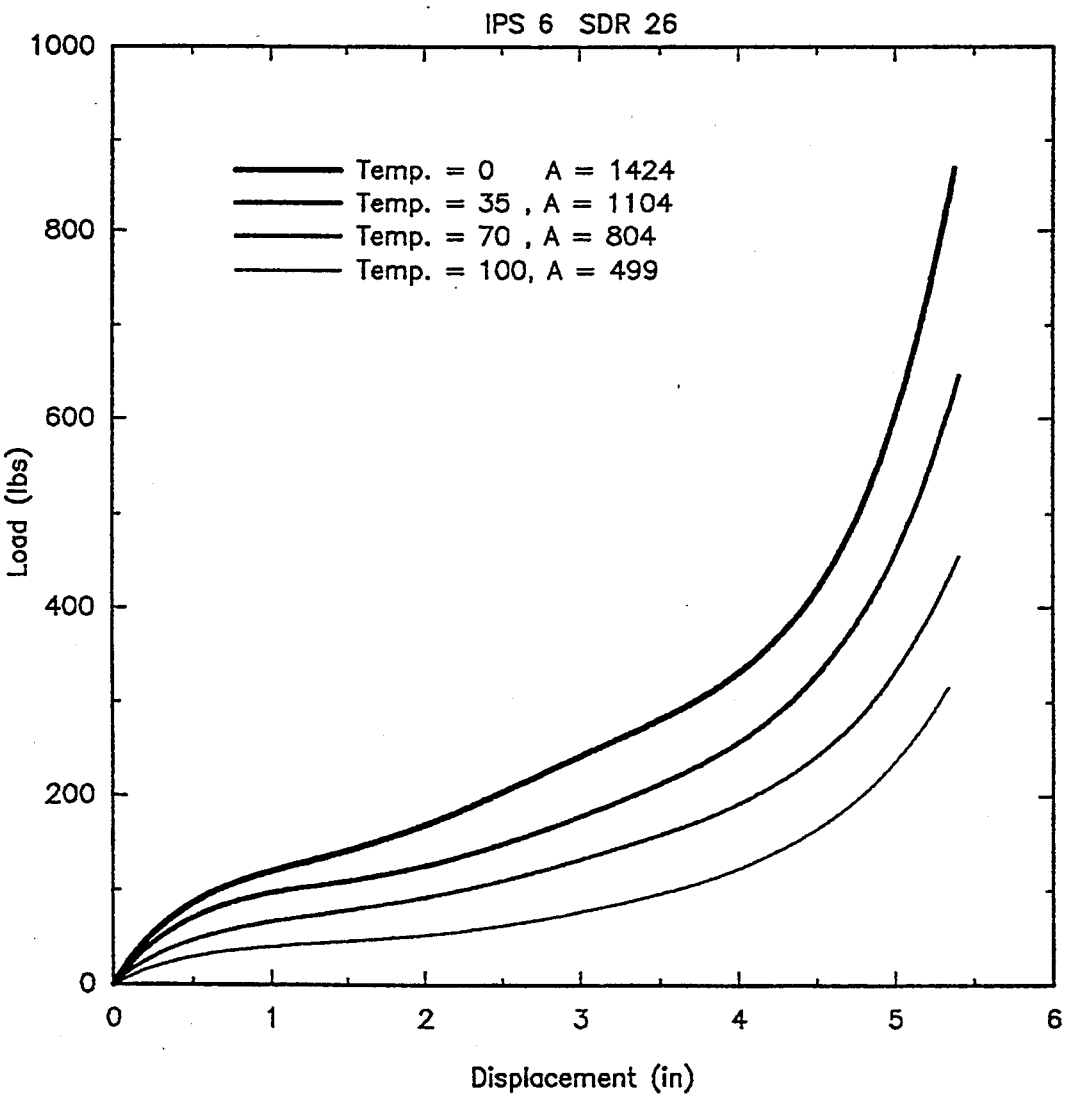
Figure 10. Quasi-static Load vs. Displacement for IPS 6 SDR 26.

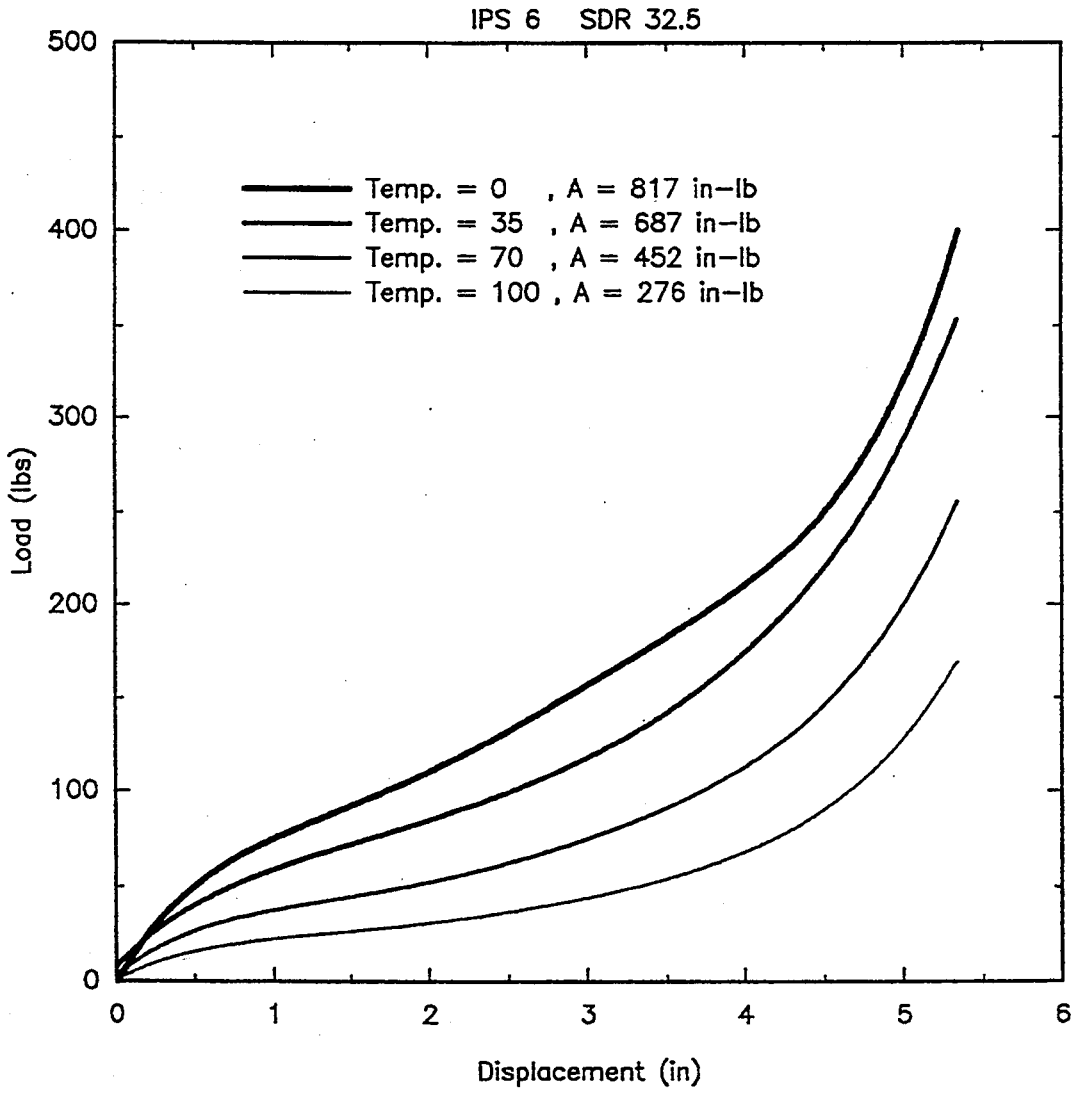
Figure 11. Quasi-static Load vs. Displacement for IPS 6 SDR 32.5.

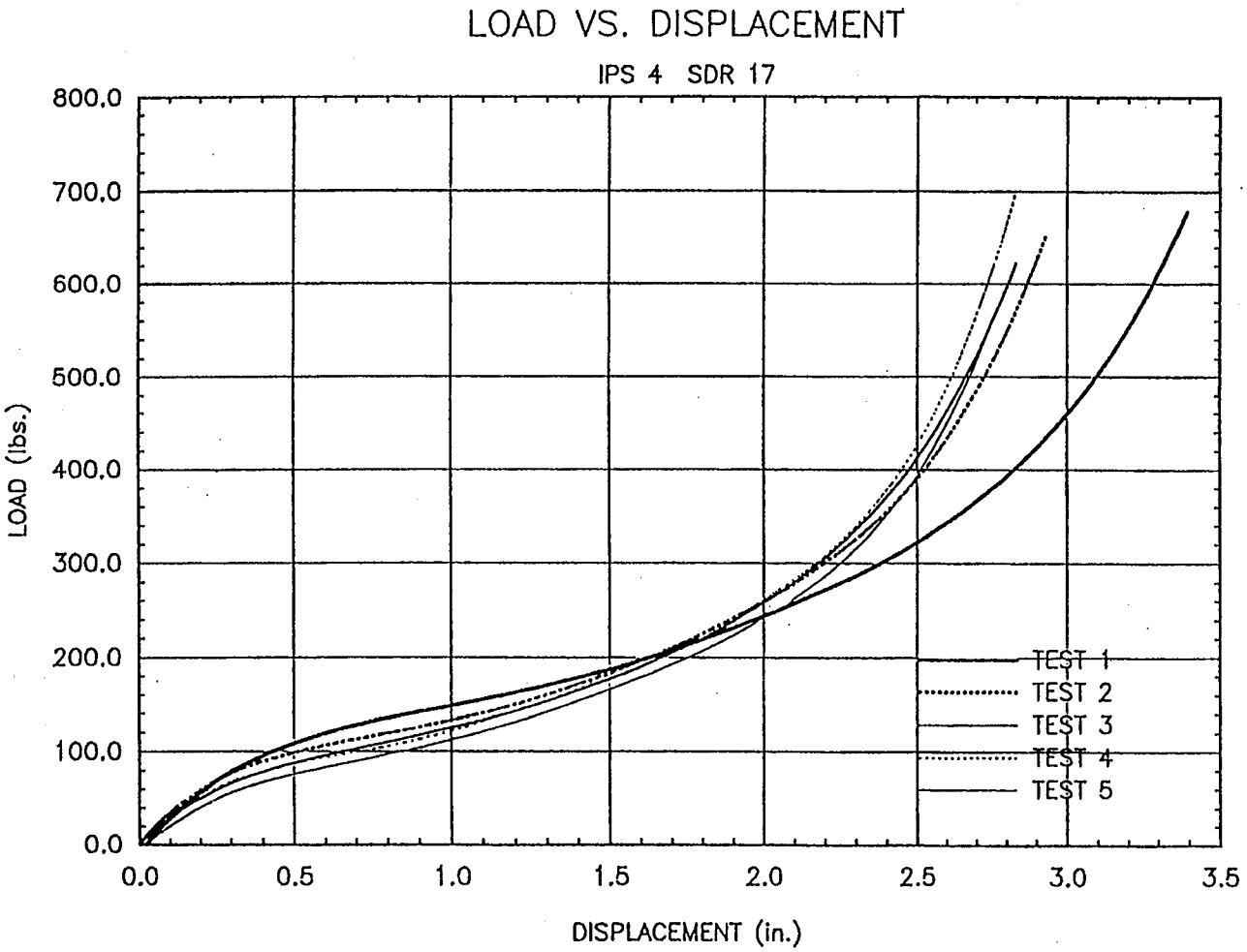
Figure 12. Load vs. Displacement Histories for IPS 4 SDR 17.

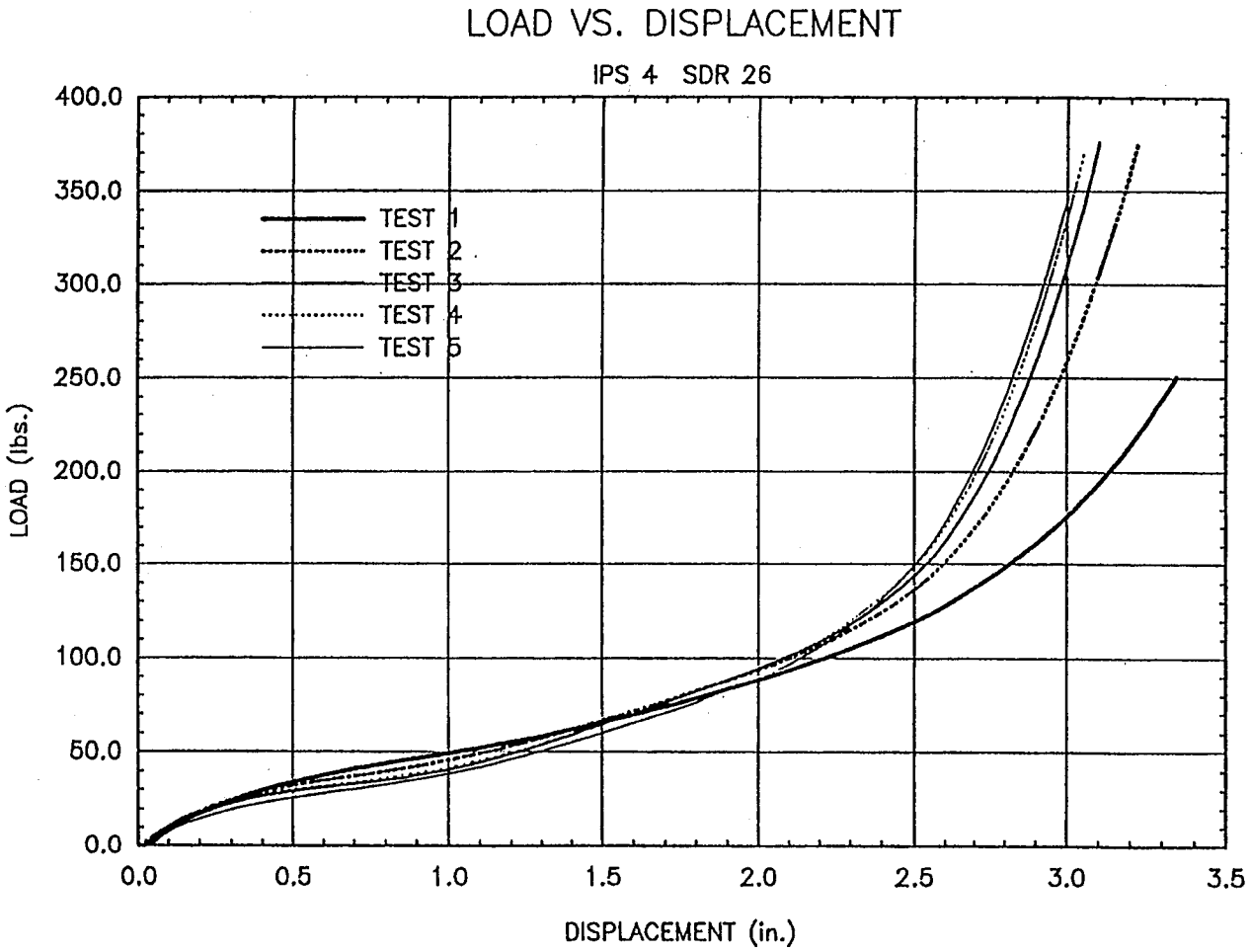
Figure 13: Load vs. Displacement Histories for IPS 4 SDR 26.

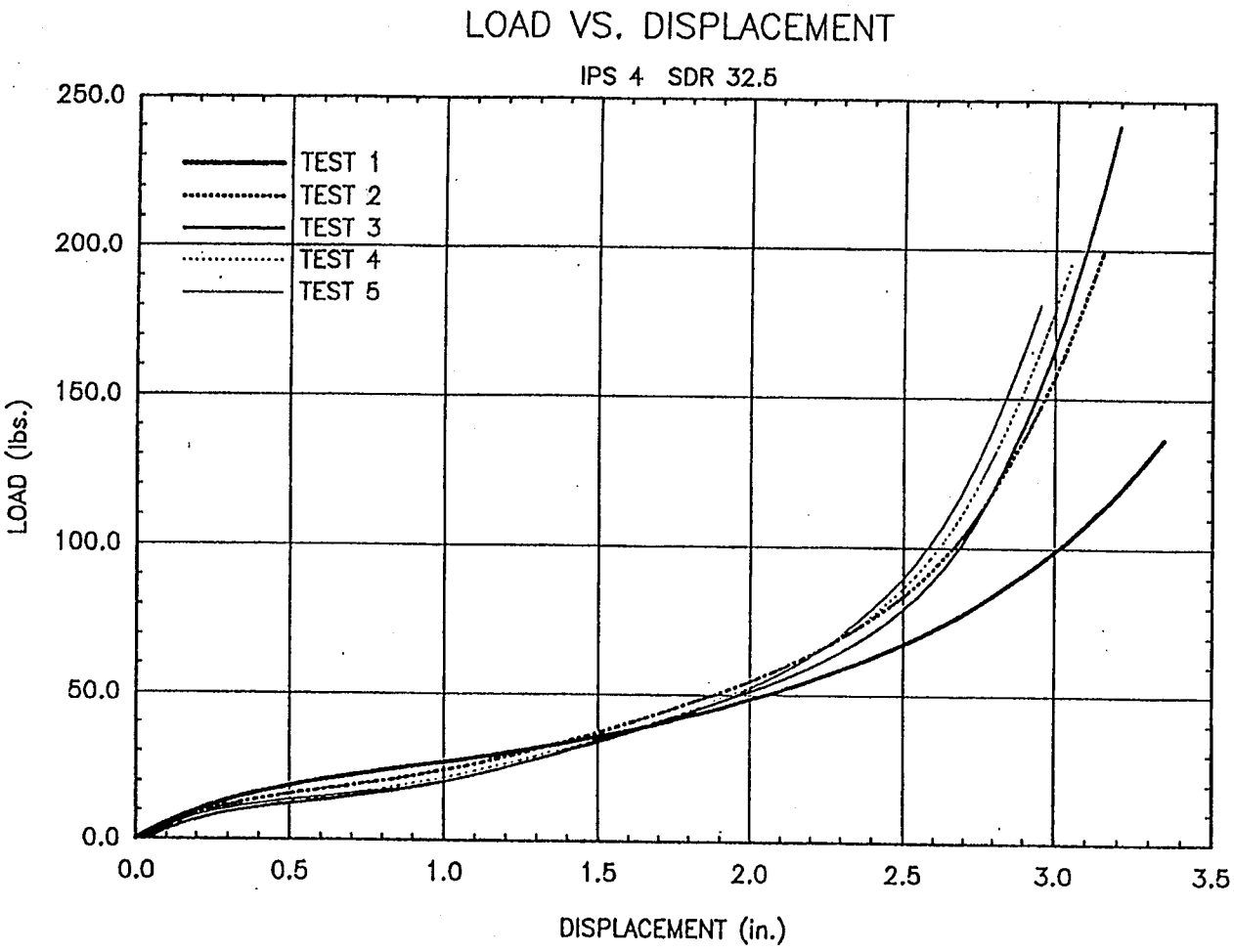
Figure 14. Load vs. Displacement Histories for IPS 4 SDR 32.5.

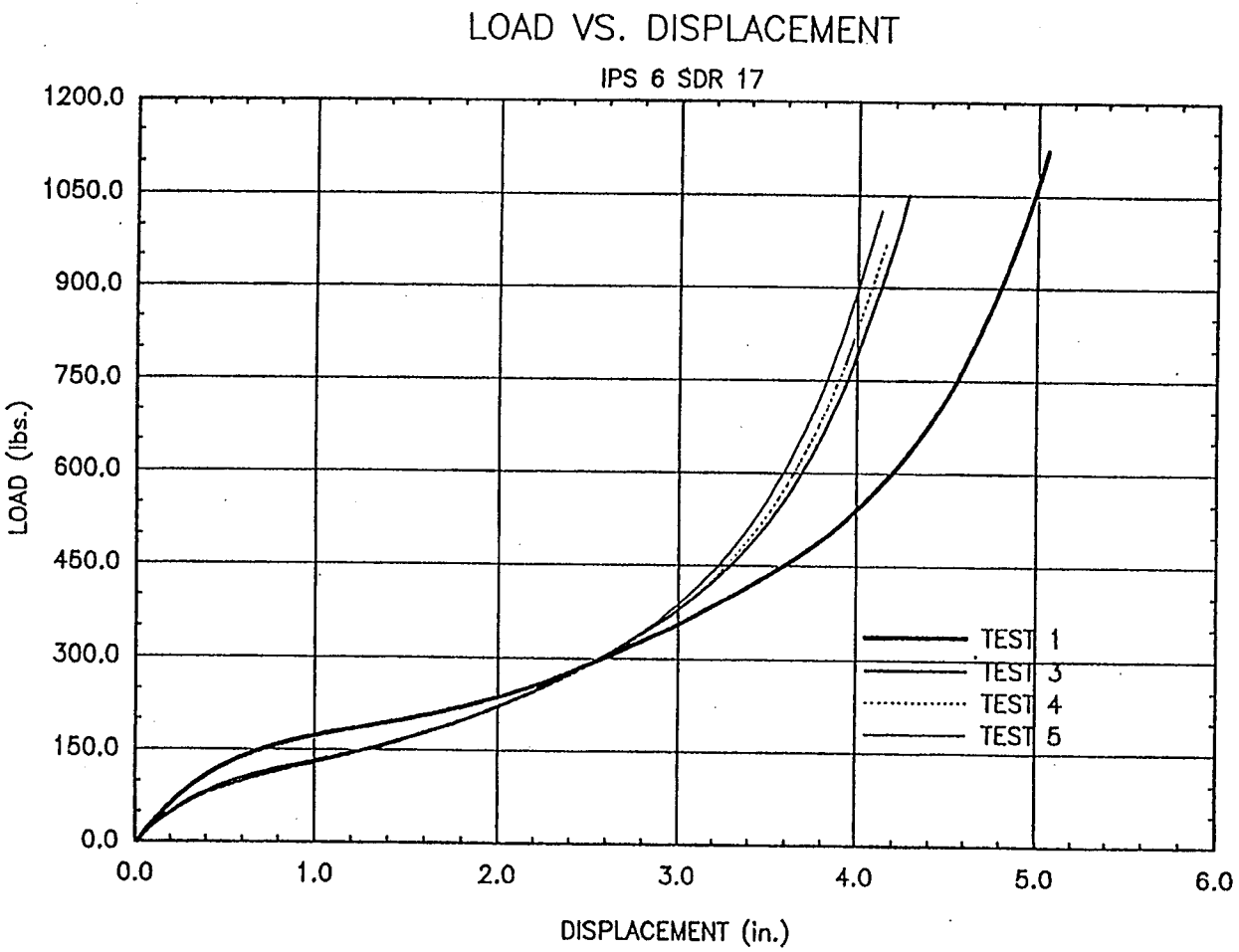
Figure 15. Load vs. Displacement Histories for IPS 6 SDR 17.

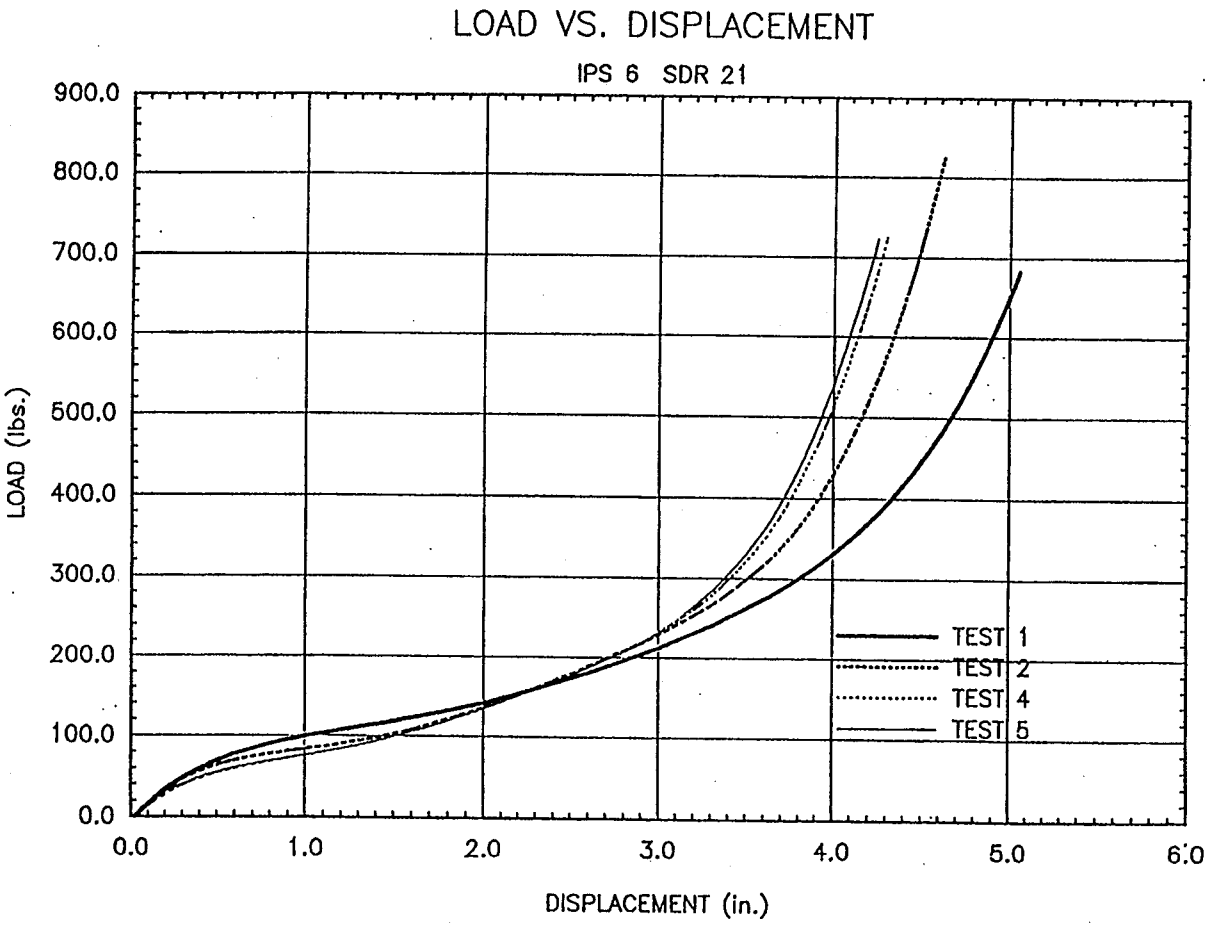
Figure 16. Load vs. Displacement Histories for IPS 6 SDR 21.

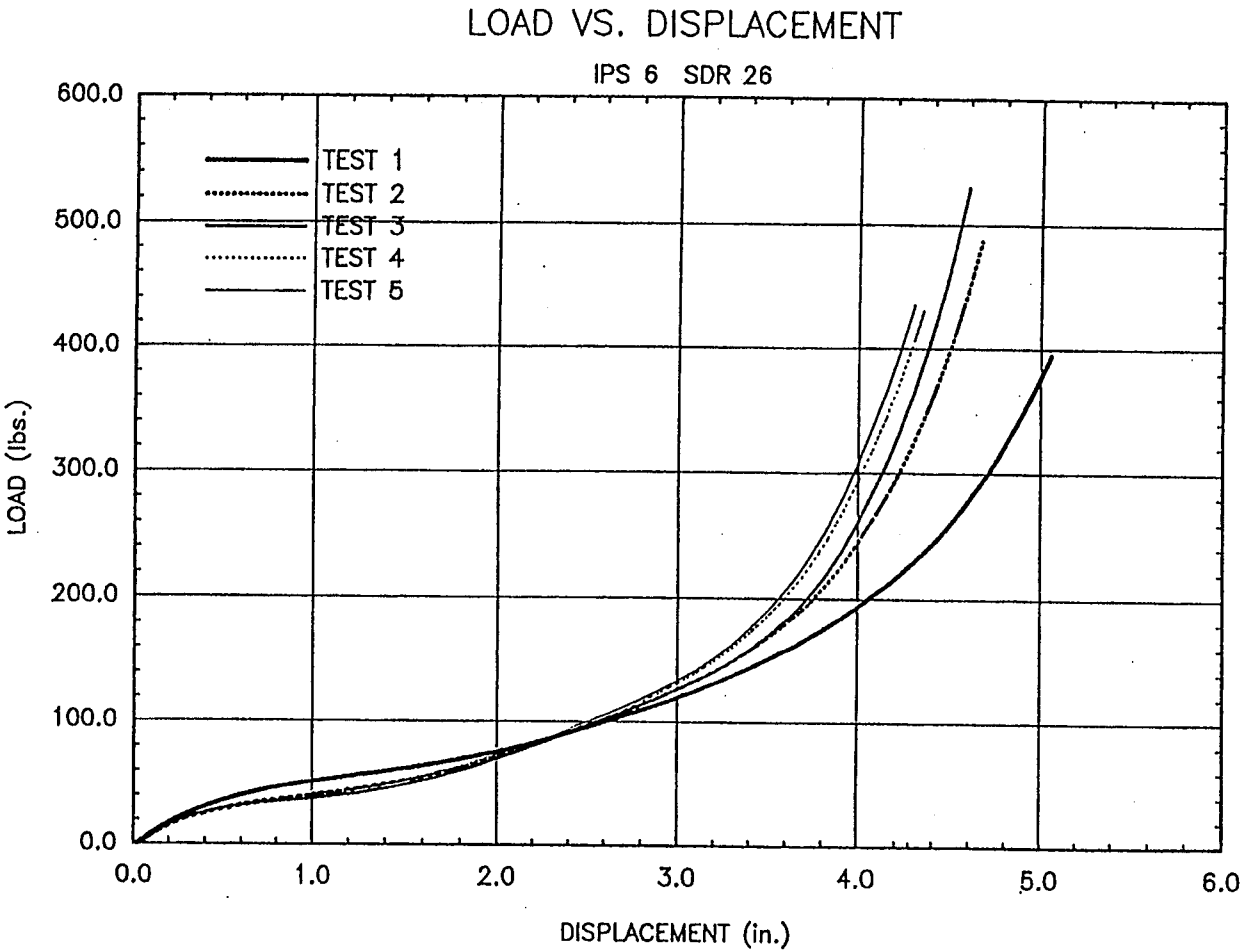
Figure 17. Load vs. Displacement Histories for IPS 6 SDR 26.

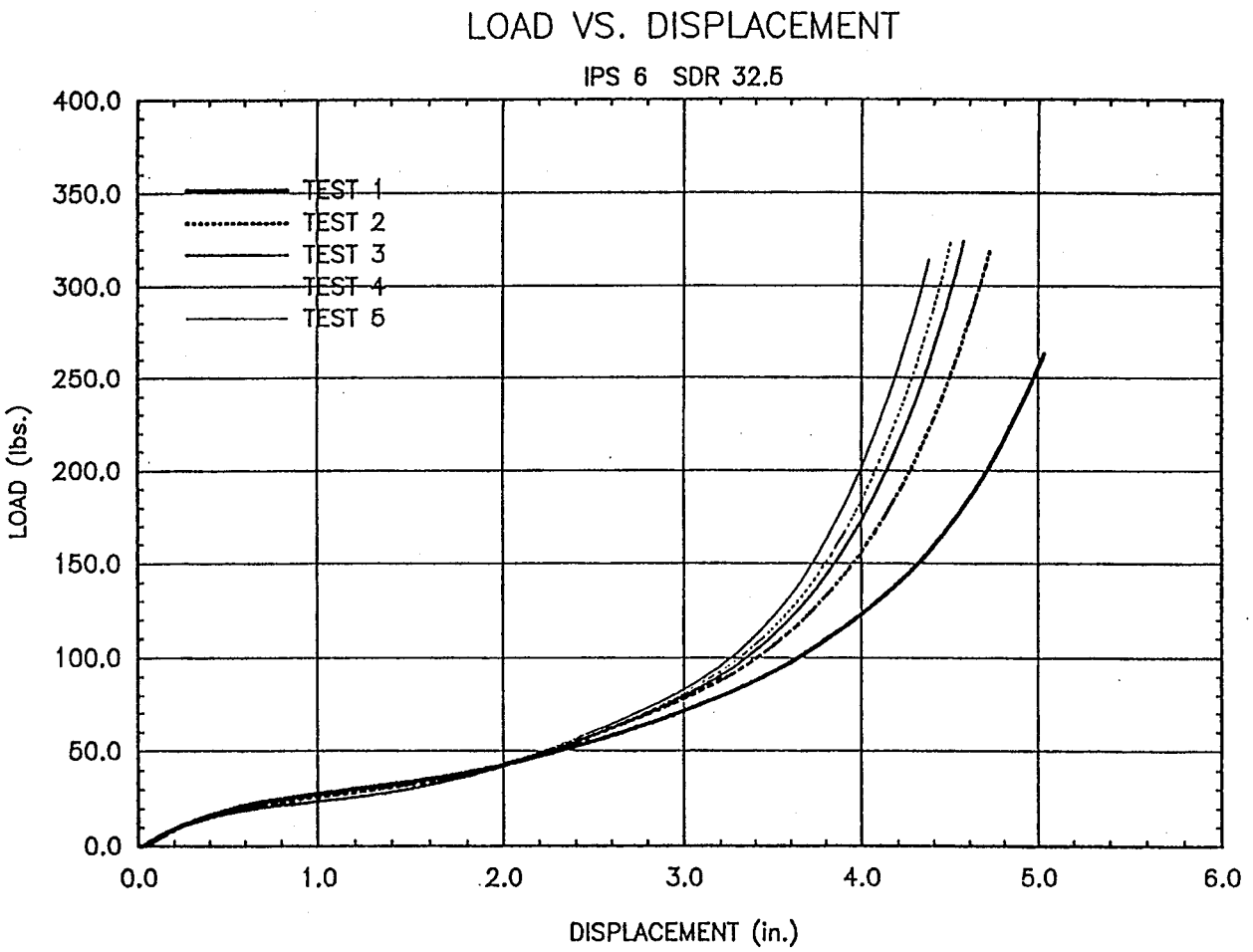
Figure 18. Load vs. Displacement Histories for IPS 6 SDR 32.5.

Figure 20. Quasi-static Load vs. Displacement for IPS 24 SDR 17.

Figure 21. Quasi-static Load vs. Displacement for IPS 24 SDR 32.5.

Figure 22. Quasi-static Load vs. Displacement for IPS 32 SDR 32.5.

Figure 23. Quasi-static Load vs. Displacement for IPS 36 SDR 32.5.

Figure 24. 8.5 mph Impact Test for IPS 4 SDR 17.

Figure 25. 8.5 mph Impact Test for IPS 4 SDR 26.

Figure 26. 8.5 mph Impact Test for IPS 4 SDR 32.5.

Figure 27. 8.5 mph Impact Test for IPS 6 SDR 17.

Figure 28. 8.5 mph Impact Test for IPS 6 SDR 21.

Figure 29. 8.5 mph Impact Test for IPS 6 SDR 26.

Figure 30. 8.5 mph Impact Test for IPS 6 SDR 32.5.

Figure 31. 22 mph Impact Test for IPS 4 SDR 17.

Figure 32. 22 mph Impact Test for IPS 4 SDR 26.

Figure 33. 22 mph Impact Test for IPS 4 SDR 32.5.

Figure 34. 22 mph Impact Test for IPS 6 SDR 17.

Figure 35. 22 mph Impact Test for IPS 6 SDR 21.

Figure 36. 22 mph Impact Test for IPS 6 SDR 26.

Figure 37. 22 mph Impact Test for IPS 6 SDR 32.5.

Figure 38. Strain Rate Sensitivity Factors for IPS 4 SDR 17.

Figure 39. Strain Rate Sensitivity Factors for IPS 4 SDR 26.

Figure 40. Strain Rate Sensitivity Factors for IPS 4 SDR 32.5.

Figure 41. Strain Rate Sensitivity Factors for IPS 6 SDR 17.

Figure 42. Strain Rate Sensitivity Factors for IPS 6 SDR 21.

Figure 43. Strain Rate Sensitivity Factors for IPS 6 SDR 26.

Figure 44. Strain Rate Sensitivity Factors for IPS 6 SDR 32.5.

Figure 45. Predicted vs Actual Energy Dissipation in 4.5- and 6.625-in Diameter Tubes Under Quasi-Static Loading.

Figure 46. Predicted vs Actual Energy Dissipation in Large Diameter Tubes Under Quasi-Static Loading.

Figure 47. Energy Dissipation Sensitivity to Radius of Tube.

Figure 48. Energy Dissipation Sensitivity to Wall Thickness of Tube.

Figure 49. Temperature Effects Under Quasi-Static and Impact Loading Conditions.

CRASH IMPACT ATTENUATOR CONSTRUCTED FROM HIGH MOLECULAR WEIGHT/HIGH DENSITY POLYETHYLENE

The United States Government has rights in this invention pursuant to the contract between Vanderbilt University and the Washington State Department of Transportation under contract number 4-410-4923, and pursurant to the contract between Vanderbilt University and the U.S. Department of Transportation under contract number 4-22-41-4802.

BACKGROUND OF THE INVENTION

The present invention relates generally to crash impact attenuators and more particularly to motor vehicle and highway barrier crash impact attenuators constructed from high molecular weight/high density polyethylene.

Motor vehicle related accidents are a major, worldwide health problem and constitute a great economic loss to society. For example, vehicular crashes kill more Americans between the ages of 1 and 34 than any other source of injury or disease. Put another way, for almost half the average life span, people are at greater risk of dying in a roadway crash than in any other way. In the U.S., more than 95 percent of all transportation deaths are motorway related, compared to 2 percent for rail and 2 percent for air. The yearly world wide societal costs of motorway deaths and injuries runs in the hundreds of billions of dollars. Indeed, the productive or potential years of life that are lost prior to age 65 as a result of motor vehicle related injuries or death are greater than those lost to cancer or heart disease.

Measures are being taken to reduce the billions of dollars lost in medical expenses, earnings, insurance claims, and litigation, as well as the intangible costs associated with human suffering. One important contribution to improved highway safety has been the development of impact attenuation devices which prevent errant vehicles from crashing into fixed object hazards that cannot be removed, relocated, or made breakaway. These devices have existed since the 1960's, and many technical improvements and innovative designs have been developed in the intervening years.

Today, such highway safety appurtenances as truck mounted attenuators, crash cushions, terminals, and longitudinal barriers are widely used and very effective. The employment of these devices has resulted in thousands of lives saved and serious injuries avoided over the last 25 years. Although a strong case can be made for the cost-effectiveness of highway safety appurtenances, the fact remains that their life cycle costs are high. A significant percentage of this total cost typically is associated with maintenance activities following vehicular impacts. This is the case because the vast majority of highway safety hardware dissipate energy through the use of sacrificial elements which must be discarded and replaced after an impact event.

In many instances, the initial installed cost of such hardware is small compared with recurring maintenance and refurbishment costs. Truck mounted attenuators, crash cushions, and terminals usually employ energy dissipating components which have almost no post-impact value and must be replaced at great expense. Similar problems with flexible longitudinal barriers have led to the increased use of the concrete safety barriers even though their installation cost per foot is significantly higher than beam-post systems.

There is another serious problem associated with damaged roadside hardware. In an alarming number of cases, the incapacitated safety device sits for days, weeks, or months before repairs are made. The potential safety and tort liability ramifications also translate into millions of dollars of lost revenue. It is clear that this money could be saved if all or most of our highway safety hardware were as maintenance-free as the concrete safety barriers. However, because of the need for controlled deceleration rates, impact attenuation devices cannot be composed of rigid concrete components. In fact, significant deformations are usually required of such devices.

The results of the efforts to design an effective crash impact attenuator have been the subject matter of several United States patents, including the following patents issued to the Applicant: U.S. Pat. Nos. 4,200,310 issued on Apr. 29, 1980, 4,645,375 issued on Feb. 24, 1987 and 5,011,326 issued on Apr. 30, 1991. Other efforts at creating effective crash impact attenuators include, among others, those inventions covered by U.S. Pat. Nos. 4,190,275 issued to Mileti, and 5,052,732 issued to Oplet et.al.

The patents issued to Applicant and identified above are based on the technology and concept of employing hollow cylinders connected together and aligned in a stacked relationship to absorb the impact of a crash between a car and a service vehicle or between a car and a roadside barrier. While these devices have been effective and have proven to be commercially successful, the expense of such devices has restricted their adoption and use in some areas to the full extent needed. Further, while the initial expense of construction or purchase and installation of such devices is significant, the acquisition and installation cost would be manageable in many jurisdictions if the cost of repair and replacement could be reduced. Repair and replacement costs cannot be budgeted with any precision because the number of crashes that will occur into a crash impact attenuator cannot be accurately predicted. However, once a crash with a crash impact attenuator occurs, the cylinders collapse in the course of absorption of the energy created by the crash. The collapsed cylinders must then be repaired or replaced. The cylinders can be repaired by beating them out into their original shape so that they will be available to accept the next crash or by replacing the cylinder within the system. In both instances, labor costs can be high and material costs are unpredictable. Such systems, when the cylinders are made from metal stock, which has been the case in the past, do not have regenerative properties and therefore the inability of such systems to regenerate themselves to the original condition is a substantial drawback to the ready acceptance of available crash impact attenuators. The safety that such systems provide and the ability to reduce the extent of injuries that result from crashes between an automobile and a service vehicle or an automobile and a roadside barrier could be greatly reduced if there was wide-spread use of the impact attenuation systems which I have developed.

What is needed then is a crash impact attenuation system which has regenerative properties so that it will regenerate itself to its original configuration and retain energy absorption capacity after being crashed into by a moving vehicle. Prior art devices that have a useful life greater than a single crash have included vinyl coated nylon fabric cylinders filled with water (see U.S. Pat. No. 4,583,716), plastic sheet having a honeycomb structure (see U.S. Pat. No. 4,190,275) which have some regenerative or multi-use characteristics but which fail to control the rate of deceleration upon crash in the effective manner of my impact attenuators, and others. The prior art does not include an expensive device or system which will dissipate the energy created by a crash and effectively attenuate the impact resulting upon a crash between a moving vehicle and a service vehicle or a moving vehicle and a roadside barrier yet which will regenerate itself and can be used over and over again without having to be replaced or repaired after each crash.

After extensive research and investigation over a number of years, I have determined that crash impact attenuation systems using the cylinder design of my prior U.S. Pat. Nos. 4,200,310, 4,645,375 and 5,011,326 as well as other designs employing cylinders as the primary dissipator of energy in such crash impact systems can be manufactured from high molecular weight-/high density polyethylene which will provide a system that has regenerative properties and which can absorb multiple crashes without the necessity of any repair. Such systems, when manufactured of high molecular weight/high density polyethylene will regenerate themselves to their original or near original shape and strength after crash and collapse. The use of such materials in the construction of such systems of this nature is not suggested by the prior art and in fact the prior art teaches away from the use of materials such as high molecular weight/high density polyethylene in the cylinders of the systems because the prior art devices all call for metal, steel or alloy cylinders. Moreover, the high molecular weight/high density polyethylene cylinders have regenerative properties which I have discovered to be heretofore unknown because construction of such material have not been tested or used in applications of this nature.

The primary use of high molecular weight/high density polyethylene cylinders has been in the construction of pipe used in sewer systems and in fluid transmission lines. Such systems receive compressive pressures around the entire circumference of the pipe. The pipe is being pressured rather uniformly from the outside. To my knowledge, no tests have been conducted on the regenerative properties of such systems and such properties are unknown and undiscovered prior to my experimentations.

SUMMARY OF THE INVENTION

My invention is directed to a crash impact attenuator including a plurality of cylinders, each bolted or otherwise connected to the adjacent cylinder and such cylinders being connected to the platform of a service vehicle or to an abutment adjacent a highway wherein the cylinders are constructed from a high molecular weight/high density polyethylene material. More specifically, the cylinders are in the range of 1 ft. to 10 ft. diameter and having a wall thickness in the range of 0.3 to 3 in. Cylinders constructed in this fashion have a particularly unique and advantageous regenerative characteristic. In addition, cylinders of a non-circular shaped cross section having a major diameter in the range of 4 to 20 ft. and a minor diameter in the range of 2 to 10 ft. are particularly effective when constructed from the high molecular weight/high density polyethylene material of a thickness in the range of 0.3 to 3 inches. Such non-circular shaped cylinders as disclosed in my pending patent application Ser. No. 07/939,084 are particularly effective in absorbing the energy resulting from impact between a vehicle and the crash impact attenuator manufactured in accordance with the teachings of the present application.

BRIEF DESCRIPTION OF THE DRAWINGS

FIG. 2. The Connecticut Impact Attenuation System (CIAS).

FIG. 5. Quasi-static Load vs. Displacement for IPS 4 SDR 17.

FIG. 6. Quasi-static Load vs. Displacement for IPS 4 SDR 26.

FIG. 7. Quasi-static Load vs. Displacement for IPS 4 SDR 32.5.

FIG. 8. Quasi-static Load vs. Displacement for IPS 6 SDR 17.

FIG. 9. Quasi-static Load vs. Displacement for IPS 6 SDR 21.

FIG. 10. Quasi-static Load vs. Displacement for IPS 6 SDR 26.

FIG. 11. Quasi-static Load vs. Displacement for IPS 6 SDR 32.5.

FIG. 12. Load vs. Displacement Histories for IPS 4 SDR 17.

FIG. 13. Load vs. Displacement Histories for IPS 4 SDR 26.

FIG. 14. Load vs. Displacement Histories for IPS 4 SDR 32.5.

FIG. 15. Load vs. Displacement Histories for IPS 6 SDR17.

FIG. 16. Load vs. Displacement Histories for IPS 6 SDR21.

FIG. 17. Load vs. Displacement Histories for IPS 6 SDR26.

FIG. 18. Load vs. Displacement Histories for IPS 6 SDR32.5.

REVIEW OF PREVIOUS WORK

Figure 1:
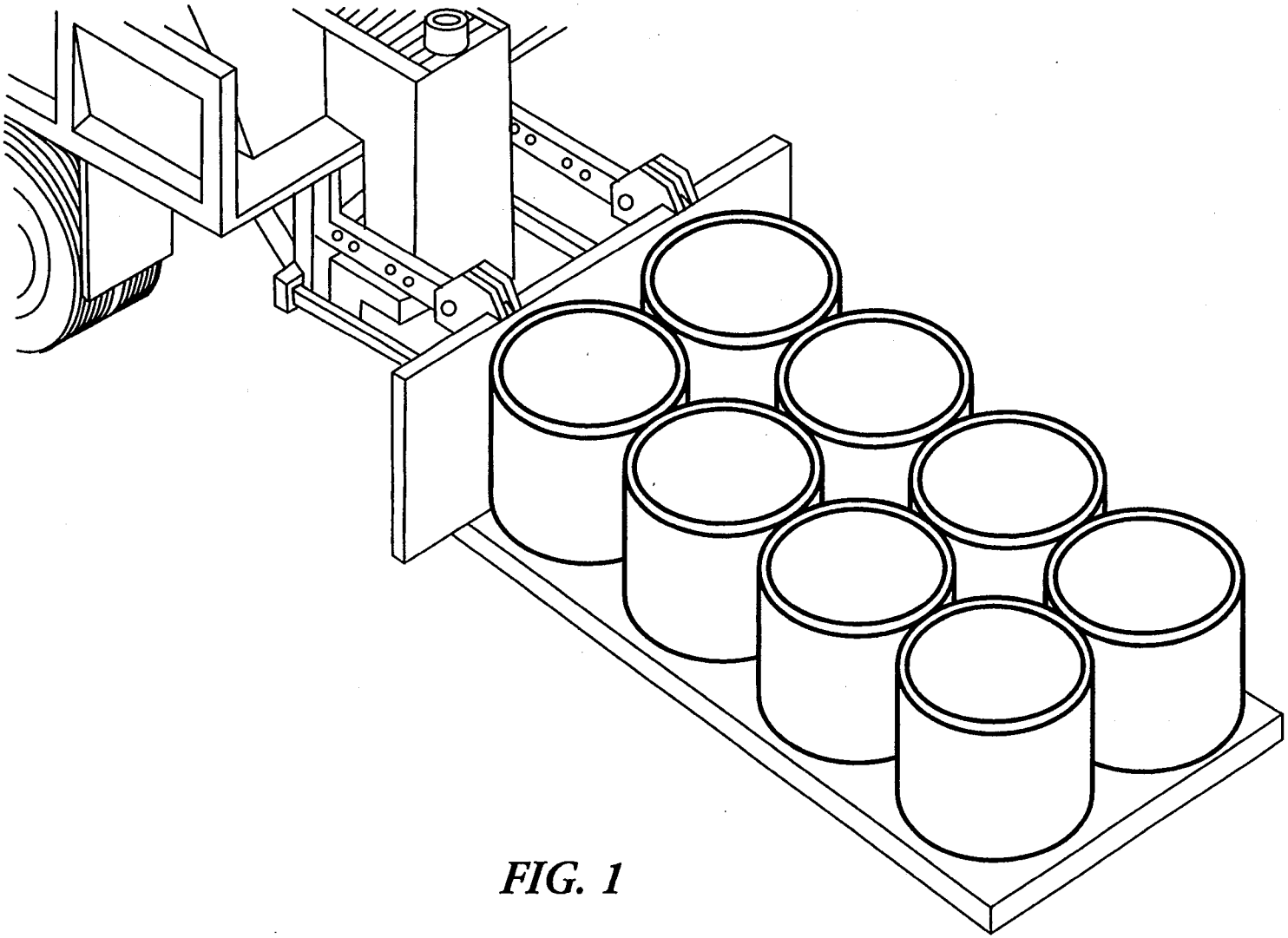
FIG. 1. Truck Mounted Attenuator (TMA).

In the 1960's the reality of traffic fatalities occurring at a rate of 1,000 per week prompted the U.S. Federal Highway Administration to initiate a research and development program to provide rapid improvement in highway safety. The development of roadside safety appurtenances was an important part of this highway safety program and a variety of devices have evolved during the last 25 years. The installation of these devices on the roadway system of the United States has substantially reduced the severity of many accidents.

The first recommended procedures for performing full-scale crash tests were contained in the single page Highway Research Board Circular 482 published in 1962. This document specified a 4000-lb test vehicle, two impact angles (7 and 25 degrees), and an impact velocity of 60 mi/h for testing guardrails. In 1974, an expanded set of procedures and guidelines were published as NCHRP Report 153. This report was the first comprehensive specification which addressed a broad range of roadside hardware including longitudinal barriers, terminals, transitions, crash cushions, and breakaway supports. Specific evaluation criteria were presented as were specific procedures for performing tests and reducing test data. In the years following the publication of Report 153, a wealth of additional information regarding crash testing procedures and evaluation criteria became available, and in 1976 Transportation Research Board Committee A2A04 was given the task of reviewing Report 153 and providing recommendations. The result of this effort was Transportation Research Circular No. 191. As TRC 191 was being published, a new NCHRP project was initiated to update and revise Report 153. The result of this NCHRP project was Report 230, published in 1981.

In many ways Report 153 was the first draft of Report 230; six years of discussion, dissension, and clarification were required before the highway safety community reached the consensus represented by Report 230. Report 230 specifies the test procedures and evaluation criteria to be followed in evaluating the effectiveness of roadside safety hardware. Appurtenances are grouped into three general categories: (1) longitudinal barriers, (2) crash cushions and (3) breakaway and yielding supports. Longitudinal barriers redirect errant vehicles away from roadside hazards and include devices such as guard rails, median barriers, and bridge railings. Terminals and transitions are particular types of longitudinal barriers designed to safely end a barrier or provide a transition between two different barrier systems. Crash cushions are designed to safely bring an errant vehicle to a controlled stop under head-on impact conditions and may or may not redirect when struck along the side. Breakaway and yielding supports are devices used for roadway signs and luminaries that are designed to disengage, fracture, or bend away under impact conditions.

DESCRIPTION OF THE PREFERRED EMBODIMENT

The research which led to this invention has documented the energy dissipative characteristics of high molecular weight/high density polyethylene (HMW HDPE), a "smart" thermoplastic which Applicant has discovered and established to possess the unique properties of self-restoration and reusability.

Quasi-static and impact experiments conducted by the Applicant and under his direction have shown that this material has a memory and restores itself over time to 90 percent of its original shape following extensive deformation and associated energy dissipation. The material properties are only moderately affected by temperature. Furthermore, HMW HDPE is quite ductile. Polyethylene tubes were loaded laterally during my testing to complete collapse without fracture, and the self-restoring tubes can be reloaded repeatedly.

Applicant's extensive investigations have established the value of employing that HMW HDPE tubes in the design of maintenance free crash cushions and longitudinal barriers. In addition to the achieved increased safety benefits, the development of impact attenuation devices which will automatically restore themselves to their original shapes and require little or no maintenance could save State DOT's millions of dollars in maintenance, repair, and litigation costs over the lives of these safety systems.

The objective of Applicant's investigation was to determine if a system could be constructed which would have high impact dissipation characteristics, low maintenance cost, regenerative properties, not be affected by wide temperature variations, and which could be used as a modification of existing systems to avoid high cost associated with total system replacement. Although the prior art suggested the use of metal cylinders and taught away from the use of materials such as Applicant selected to test, Applicant decided to investigate the feasibility of employing high molecular weight/high density polyethylene (HMW HDPE) tubes in highway safety appurtenances. That contrarian effort has resulted in the development of families of maintenance-free impact attenuation devices as are disclosed herein. Applicant has discovered that maintenance and repair costs can be virtually eliminated in such devices after a vehicular impact as a result of his findings that HMW HDPE is a "smart" material, possessing the unique ability to first dissipate large amounts of energy, and then restore itself to approximately 90 percent of its original shape. By establishing the stated research objective, Applicant estimates that the employment of this new technology could lead to millions of dollars of savings in maintenance, repair, and litigation costs. Furthermore, the safety of the motoring public will be enhanced and the exposure to danger of DOT personnel will be reduced.

Figure 50:
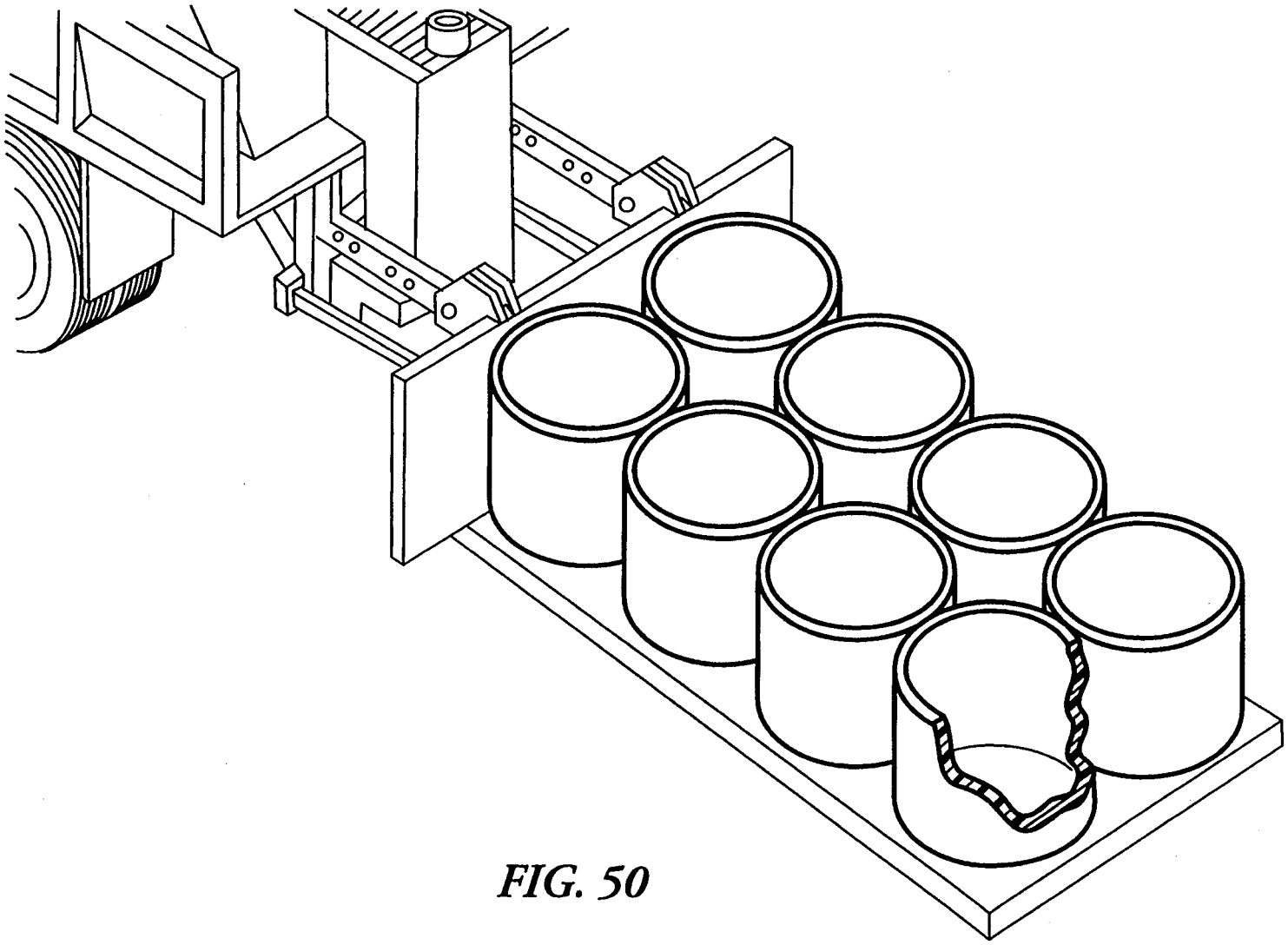
FIG. 50. A perspective view of the present invention as a part of a truck mounted attenuation system showing a cut-away of one of the cylinders which illustrates the claimed High Molecular Weight/high Density Polyethylene material of the cylinders.

FIG. 50 illustrates one embodiment of the present invention. Shown in FIG. 50 is a truck mounted attenuation system 10 of the type previously illustrated in connection with FIG. 1 and discussed in connection therewith. In this embodiment, a series of cylinders 12 are mounted on a platform 14 connected to the rear of the truck 16. The cylinders 12 are constructed of High Molecular Weight/High Density Polyethylene material 18 as is illustrated in the cut-away section of the cylinder 12'.

Polyethylene is not a new material. In fact, polyethylenes are the most widely used plastic in the United States. High density polyethylene is a thermoplastic material which is solid in its natural state. This polymer is characterized by its opacity, chemical inertness, toughness at both low and high temperatures, and chemical and moisture resistance. High density can be achieved because of the linear polymer shape which permits the tight packing of polymer chains. The physical properties of high density polyethylene are also affected by the weight-average molecular weight of the polymer. When this high density polymer is used with a high molecular weight resin in the 200,000–500,000 range, a high molecular weight/high density polyethylene is produced which I have found to exhibit the following favorable material characteristics:

High stiffness
High abrasion resistance
High chemical corrosion resistance
High moisture resistance
High ductility
High toughness
High tensile strength
High impact resistance over a wide temperature range Because of these properties, HMW HDPE has been employed in several high performance market areas, including film, piping, blow molding, and sheet production. All of the properties mentioned above are crucially important in an impact attenuation device application. Mild steel, which is currently being used in most such devices, also exhibits most of these favorable characteristics. What was discovered in Applicant's research work which distinguishes HMW HDPE from mild steel is its ability to remember and almost return to its original configuration after loading. A HMW HDPE tube, for example, when crushed laterally between two plates to complete collapse, will restore itself to approximately 90 percent of its original shape upon removal of the load. It can be reloaded and unloaded repeatedly, exhibiting almost identical load-deformation/energy dissipation characteristics. It remains ductile at temperatures well below 0 degrees F., and its energy dissipation potential is still significant at temperatures above 100 degrees F.

The production of HMW HDPE piping over a wide range of diameters and wall thicknesses has gone on for years. The primary pipe applications have been in oil and gas recovery, water supply systems, sewer and sewer rehabilitation linings, and in other industrial and mining uses. See, e.g., Bulletins No 104 and 112, published by Amsted Industries, Inc. describing known applications for its PLEXCO ® PE 3408 Product. Tubing made of HMW HDPE is, therefore, readily available and relatively inexpensive. However, its self-restorative properties were heretofore unknown and have never been exploited.

Applicant's research involved a quasi-static and impact loading experimental investigation to determine the energy dissipation characteristics of HMW HDPE tubes as functions of temperature, radius to wall thickness ratio, strain, strain-rate, deformation, and repeated and cyclic loading. The results of this experimental program were analyzed to develop analytic energy dissipation expressions which are then employed in the design of truck mounted attenuators (TMA). Finally, an expert system computer program, CADS, is modified to use HMW HDPE tubes in the generalized design of crash cushions.

ENERGY DISSIPATION IN HIGHWAY SAFETY APPURTENANCES

Currently available highway safety hardware dissipate energy in a variety of ways. Examples include:

Crushing of cartridges filled with polyurethane foam enclosed in a hex-shaped cardboard honeycomb matrix.

An extrusion process in which a W-beam guardrail is permanently deformed and deflected.

A cable/brake assembly which does work by developing fraction forces between brakes and a wire rope cable.

Shearing off a multitude of steel band sections between slots in a W-beam guardrail.

Transferring the momentum of an errant vehicle into sand particles contained in frangible plastic barrels.

Applicant has developed and crash tested several different types of impact attenuators which dissipate the kinetic energy associated with a high speed vehicular collision by deforming mild steel cylinders. These laterally loaded cylinders are either formed from flat plate stock or cut from pipe sections and possess some attractive energy dissipation characteristics. These include the ability to achieve deformations approaching 95 percent of their original diameters, a stable load-deformation behavior, an insensitivity to the direction of loading, and a high energy dissipation capability per unit mass. The systems will now be described in some detail because of the potential of easily replacing their existing mild steel cylindrical energy dissipators with HMW HDPE cylinders.

The specific appurtenances developed include:

1. A portable truck mounted attenuator (TMA), which is employed in slow-moving maintenance operations (e.g., line-striping, pavement overlay) to provide protection for both the errant motorist and maintenance personnel. This TMA, which uses four 2-fi diameter steel pipe sections to dissipate energy, is shown in FIG. 1. It has been employed by many State Departments of Transportation since the 1970's and its use has been credited with saving lives and reducing accident injury severities.
2. The Connecticut Impact Attenuation System (CIAS), an operational crash cushion composed of 14 mild steel cylinders of 3- or 4-ft diameters. This crash cushion is unique in that it is designed to trap the errant vehicle when it impacts the unit on the side unless the area of the impact on the device is so close to the back of the system that significant energy dissipation and acceptable deceleration responses are unobtainable because of the proximity of the hazard. Only in this situation will the impact attenuation device redirect the vehicle back into the traffic flow direction.

This redirective capability is achieved through the use of steel "tension" straps (ineffective under compressive loading) and "compression" pipes (ineffective in tension). This bracing system ensures that the crash cushion will respond in a stiff manner when subjected to an oblique impact near the rear of the unit, providing the necessary lateral force to redirect the errant vehicle. On the other hand, the braced tubes retain their unstiffened response when the attenuation system is crushed by impacts away from the back of the device.

The CIAS, shown in FIG. 2, uses 4 ft high cylinders with the individual wall thicknesses varying from cylinder to cylinder.

Figure 3:
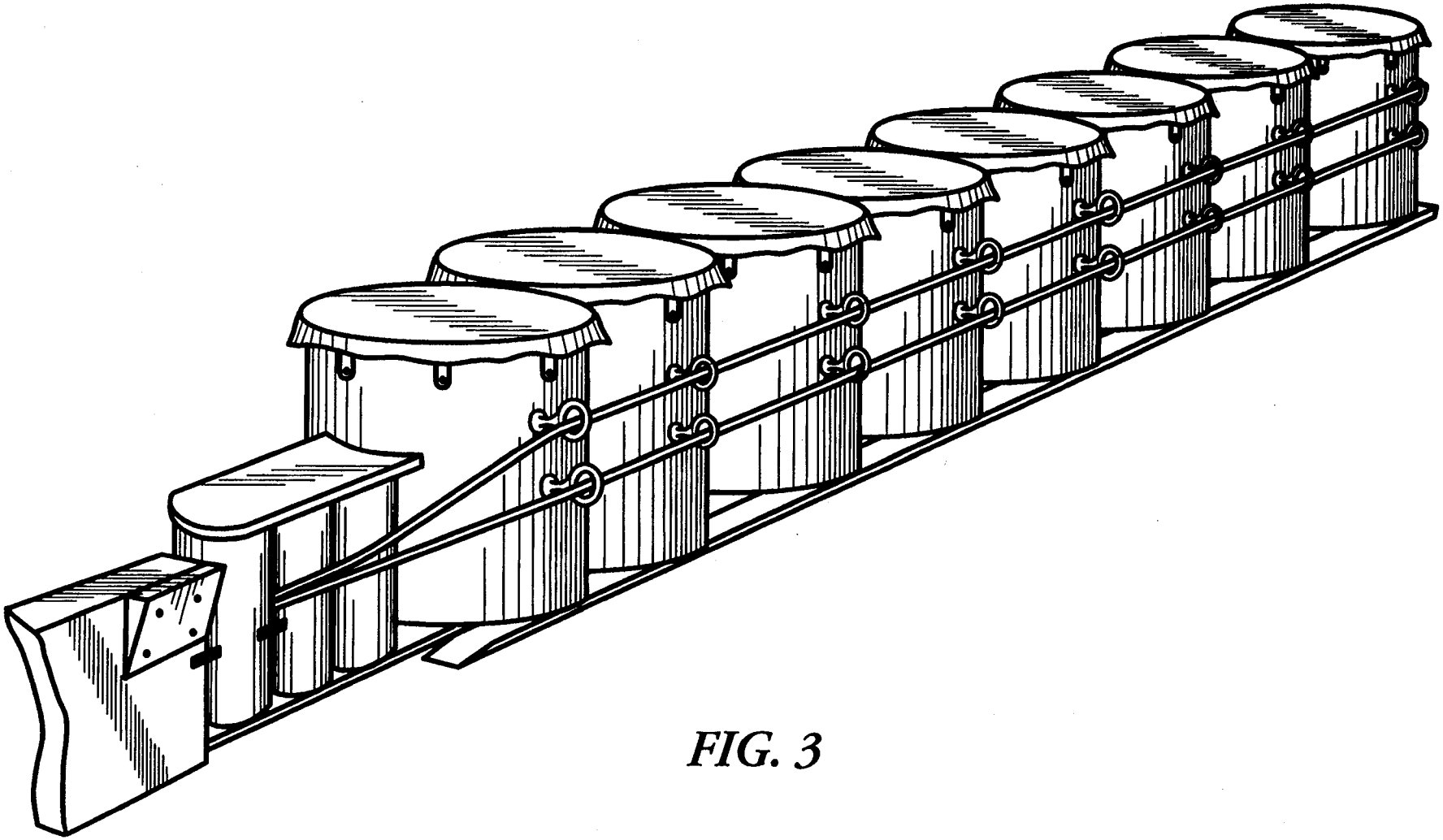
FIG. 3. The Narrow Connecticut Impact Attenuation System (NCIAS).

3. A new narrow hazard system, known as the Connecticut Narrow Hazard Crash Cushion, and shown in FIG. 3. The system is composed of a single row of eight 3-ft diameter mild steel cylinders of different thicknesses. All cylinders are 4 ft high, and a total of four 1-in diameter cables (two on each side of the system) provide lateral stability and assist in redirecting errant vehicles under side impact conditions. The 24 ft length of the crash cushion was chosen as the probable minimum acceptable length for the crash cushion if occupant risk crash test requirements are to be met. The 3 ft width was selected because most narrow highway hazards are approximately 2 ft wide and the crash cushion should be slightly wider than this dimension.

The Connecticut Narrow Hazard Crash Cushion has also been granted operational status by the Federal Highway Administration and there are several installations in Connecticut and Tennessee.

4. A generalized CIAS design, which employs an Expert System computer program to optimize the design of the crash cushion when given the unique characteristics of a proposed site. These conditions include the available site dimensions and the speed limit. This Expert System (called CADS) can be used to optimally design crash cushions in multiple service level applications. CADS employs the guidelines of NCHRP Report 230 to ensure that performance requirements relating to occupant risk are met. The individual cylindrical wall thicknesses are determined so that the occupant impact velocities and ridedown accelerations are minimized, subject to the dual constraints of system length and the required energy dissipation capability. This computer based design system allows the non-expert to optimally design site-specific versions of the Connecticut Impact-Attenuation System.

EXPERIMENTAL PROCEDURES AND DISCUSSION

Applicant's research involved an extensive experimental program conducted to determine the energy dissipation and self restoration characteristics of HMW HDPE tubes as functions of:

Loading rate
Temperature
Diameter/thickness (R/t) ratio
Strain
Deformation level
Repeated loading

TEMPERATURE

Applicant's experiments were performed over a temperature range of 0 degrees F. to 100 degrees F. Four different D/t ratios were considered, corresponding to the plastic pipe industry standard dimension ratios (SDR=outside diameter/wall thickness=D/t) of 17, 21, 26, and 32.5. Restoration characteristics for different deformation levels and temperatures were determined. Repeated cyclic loading/deformation tests were performed to establish the ability of HMW HDPE to undergo repeated cycles of deformation while providing the same level of energy dissipation.

A. QUASI-STATIC TESTS

Figure 4A:
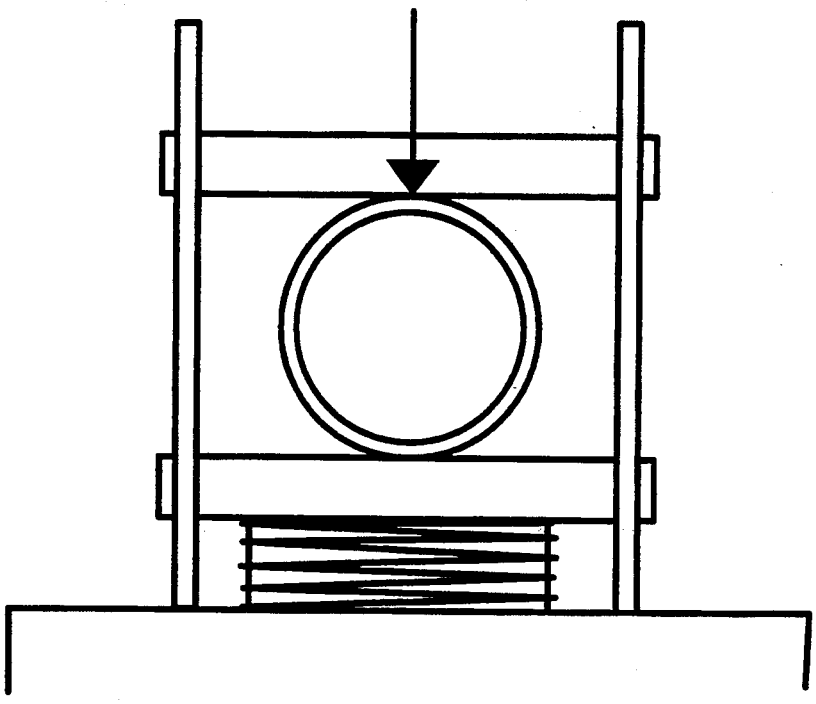
FIG. 4. Typical Quasi-Static Test.
Figure 4B:
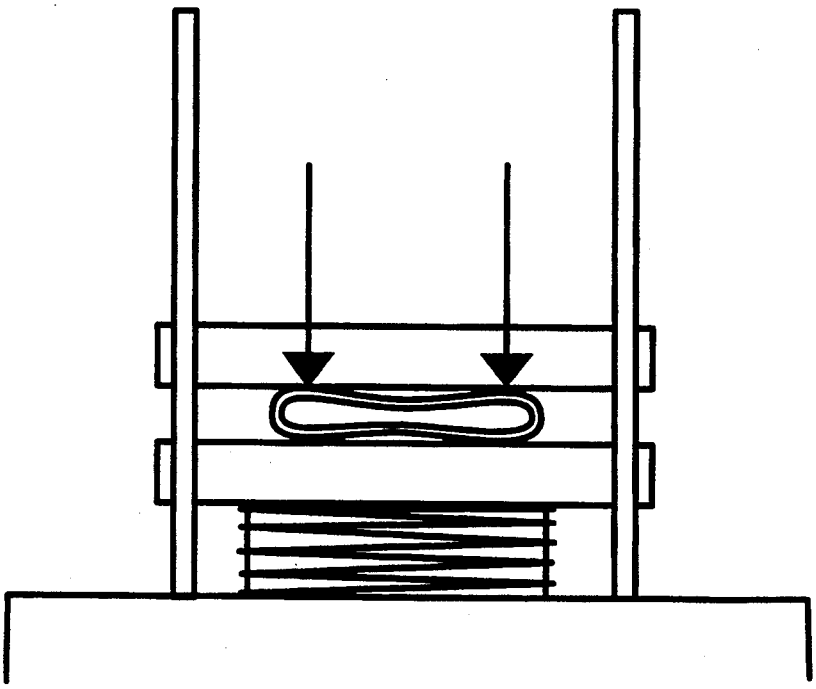

An extensive series of quasi-static tests were conducted with HMW HDPE tubes for a variety of tube diameters, thicknesses, deformation levels, loading cycles, and temperatures. A typical test setup is shown in FIG. 4. The tube was loaded between two plates and load vs. deflection data recorded. The applied loads at the top and bottom of the specimen are line loads during the early stages of the collapse process. However, it is of interest and importance to note that these individual line loads bifurcate into two loads during the latter stages of deformation and travel toward the sides of the test specimen. This phenomenon has a significant effect on the character of the typical load-deflection response, tending to increase the load required for a given deflection over that which would exist if the initial line load did not bifurcate. The result is an increased area under the load-deflection curve, and this area is the energy that can be dissipated during the collapse process.

The first quasi-static test series was performed on 4.5-in. and 6.625-in. outside diameter tubes which were 2 inches in length. A total of seven different specimens were selected, as shown in Table 1. In the table, IPS (industrial piping system) is the nominal diameter of the tube, and SDR (standard dimension ratio) has been previously defined as the ratio of the outside diameter of the tube to its minimum wall thickness.

All seven specimens were tested at temperatures of 0 degrees, 35 degrees, 70 degrees, and 100 degrees F. The results are presented in FIGS. 5–11. The areas under each load-displacement curve, A, are given in in-lbs on the graphs. As expected, the areas tend to decrease when the temperature increases under quasi-static conditions.

1. Repeated Loading Tests

This test series was conducted to determine the self-restoration capabilities of HMW HDPE tubing and to investigate the ability of such tubes to retain their load-displacement characteristics under repeated loadings. The seven tube sizes given in Table 1 were subjected to load-displacement tests on five consecutive days. Two different test series were performed. In the first series, the seven tubes were loaded to complete collapse. The second test series involved tube displacements to 50 percent of their original diameters.

The self-restoration results are presented in Tables 2 and 3. Table 2 contains the complete collapse data and shows that the HMW HDPE tubes restore themselves to approximately 90 percent of their original diameter when loaded to complete collapse the first time. Further loading cycles to complete collapse results in restorations of 96–99 percent of the previous shapes. After five loadings to complete collapse, all seven tubes retained approximately 86 percent of their original collapsing strokes. The load-displacement histories for this test series are shown in FIGS. 12–18. One significant discovery about the characteristics of this material, heretofore unknown, was that the load-displacement and energy dissipation responses are only slightly affected by repeated loadings to complete collapse. Furthermore, all tubes retained their ductility and no stress fractures occurred.

This test series was then repeated under 50 percent collapse loading conditions. Such a situation is a normal occurrence in actual impact attenuation devices. Table 3 shows that restoration approaches 96 percent after the first loading and 94 percent after five loading cycles. The load-displacement characteristics were essentially unaffected by these loading cycles.

2. Experiments With Large Diameter Tubes

Figure 19:
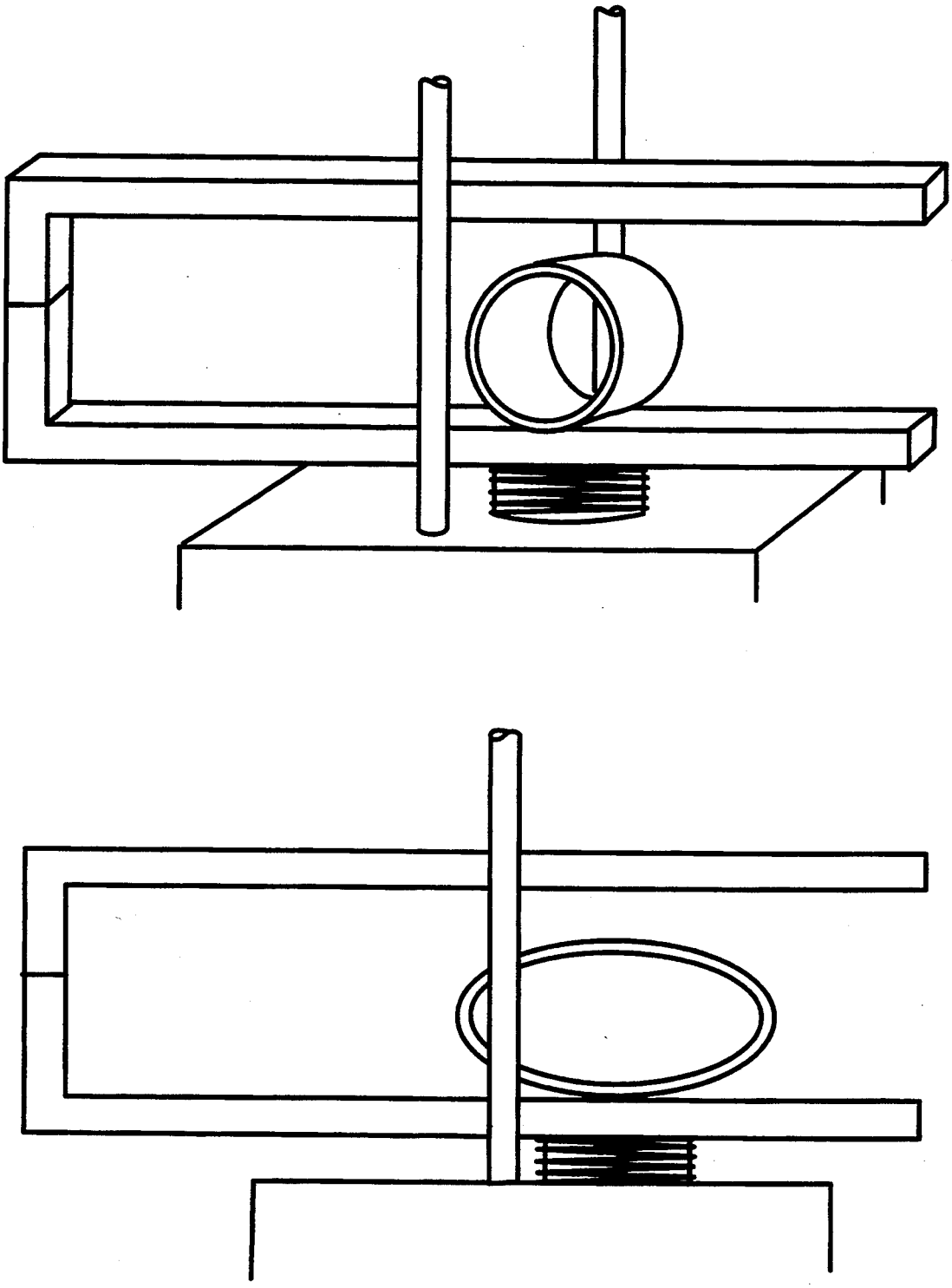
FIG. 19. Loading of Larger Samples.
Figure 20:
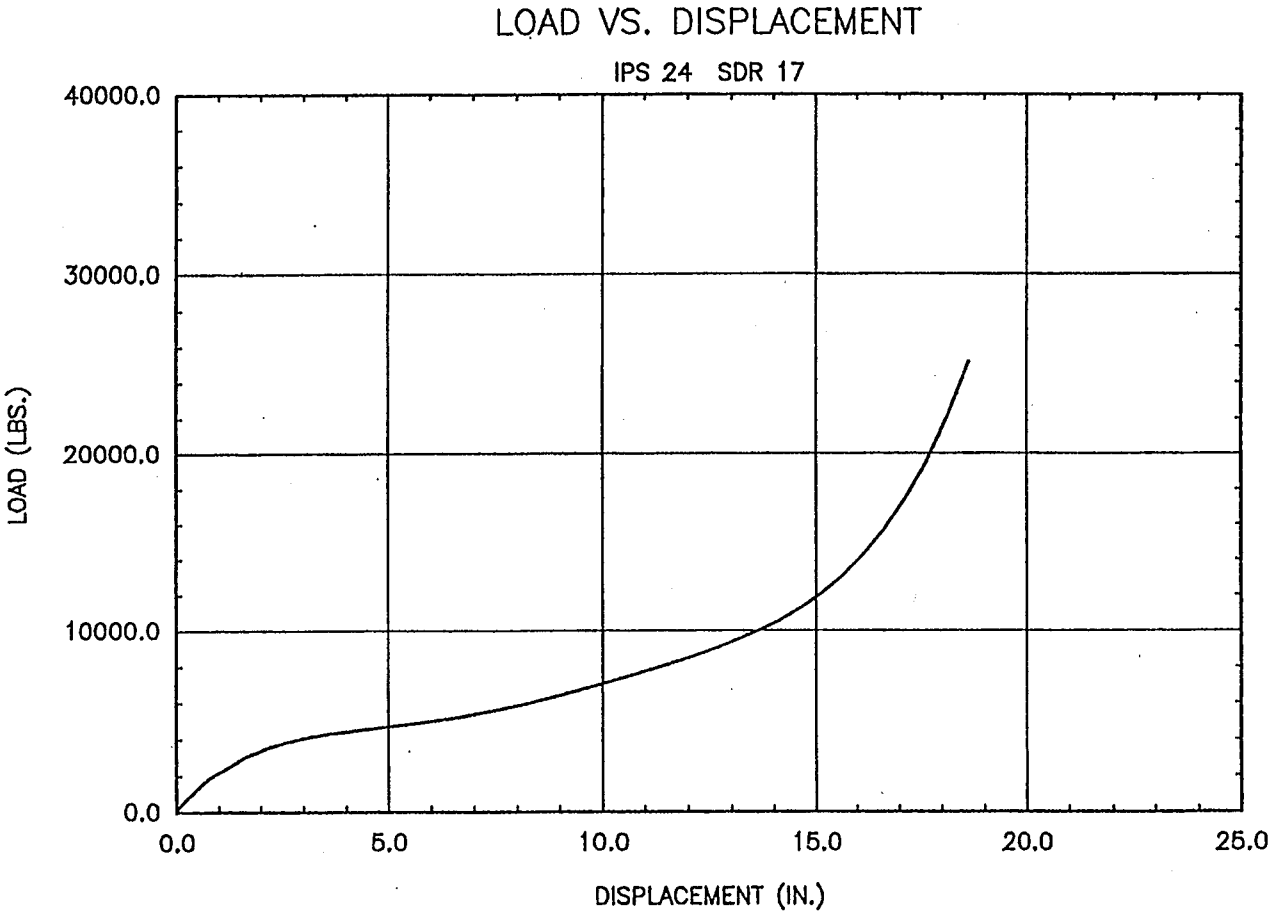
FIG. 20. Quasi-static Load vs. Displacement for IPS 24 SDR17.
Figure 21:
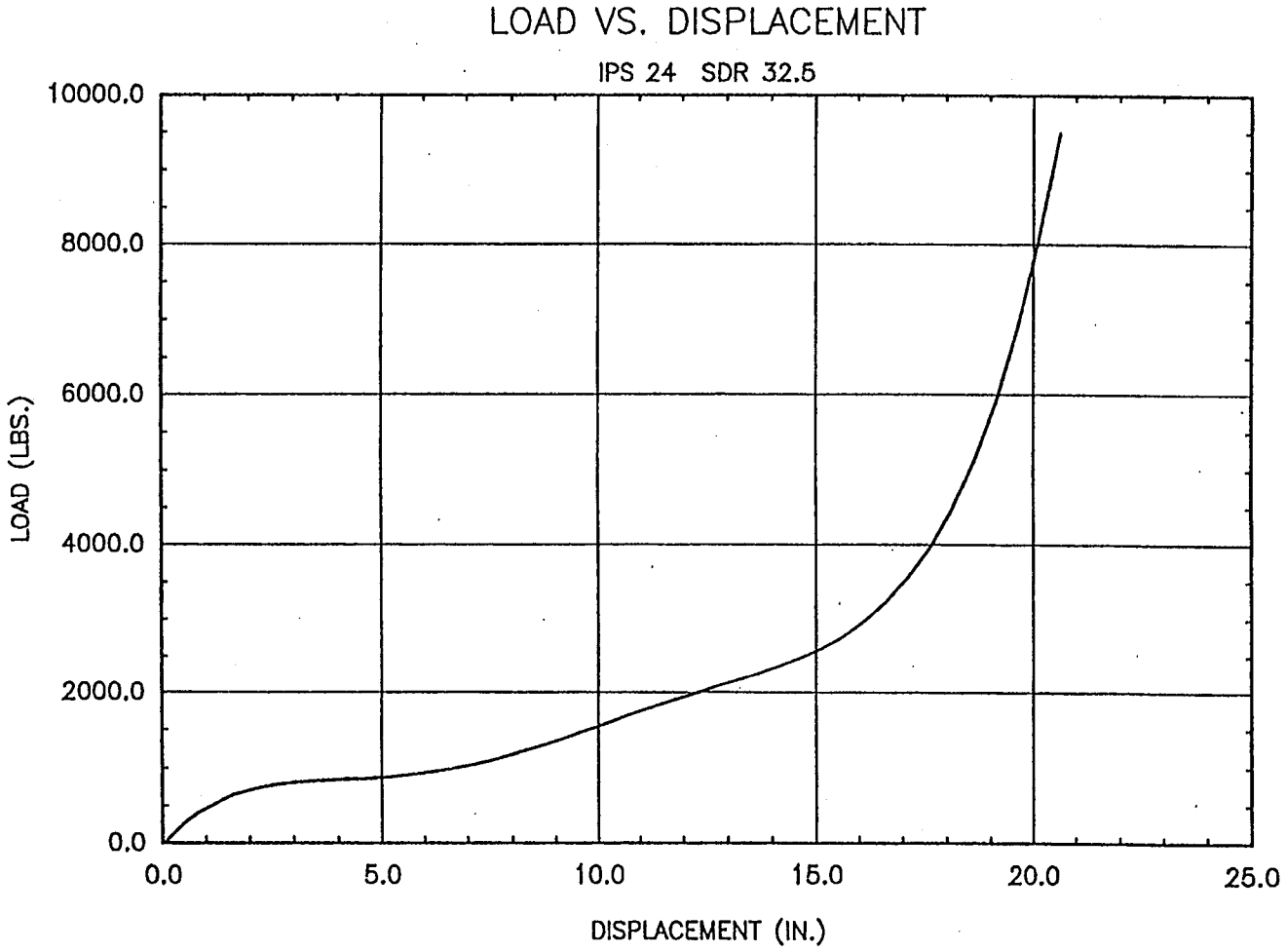
FIG. 21. Quasi-static Load vs. Displacement for IPS 24 SDR32.5.
Figure 22:
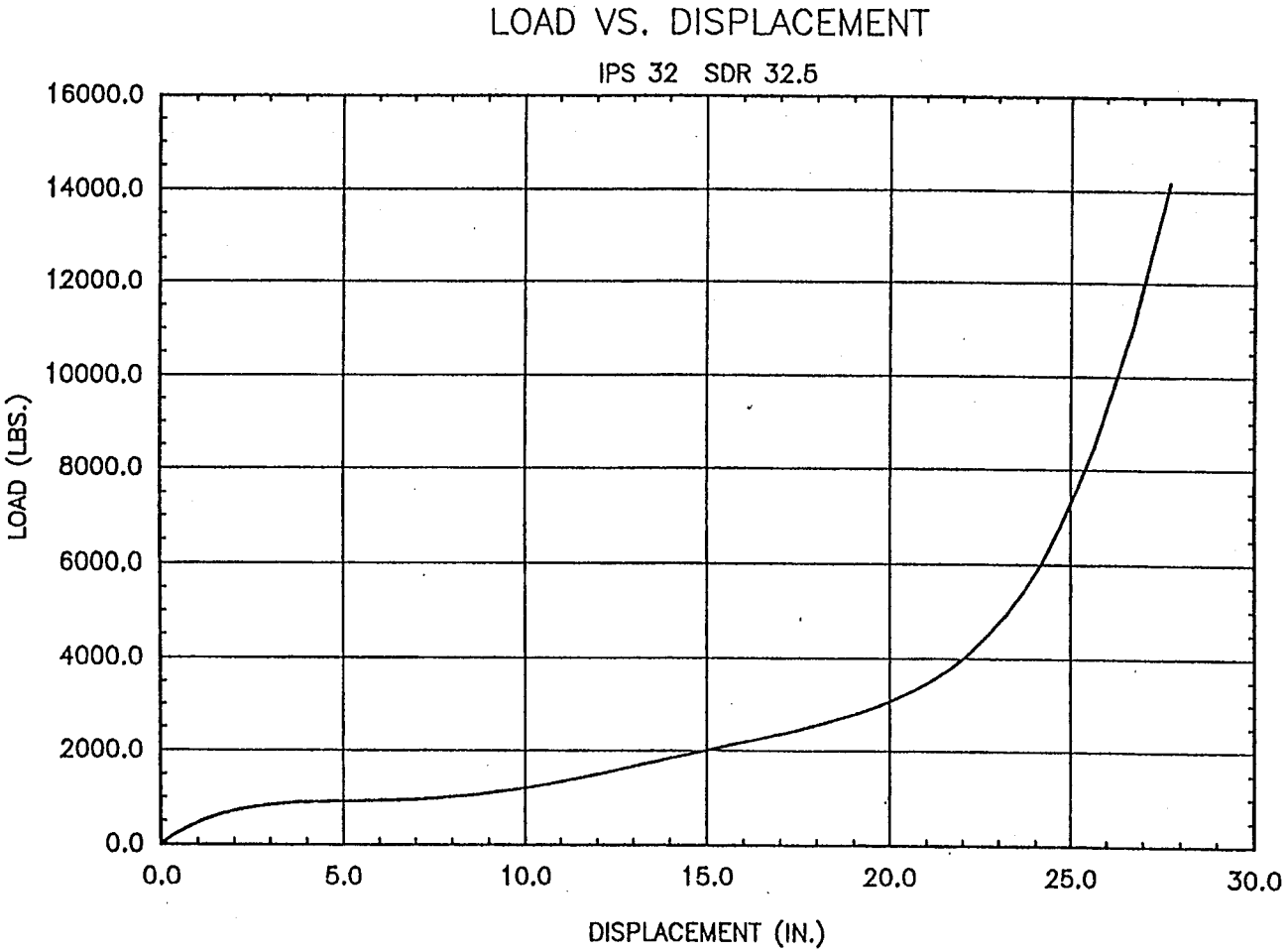
FIG. 22. Quasi-static Load vs. Displacement for IPS 32 SDR32.5.
Figure 23:
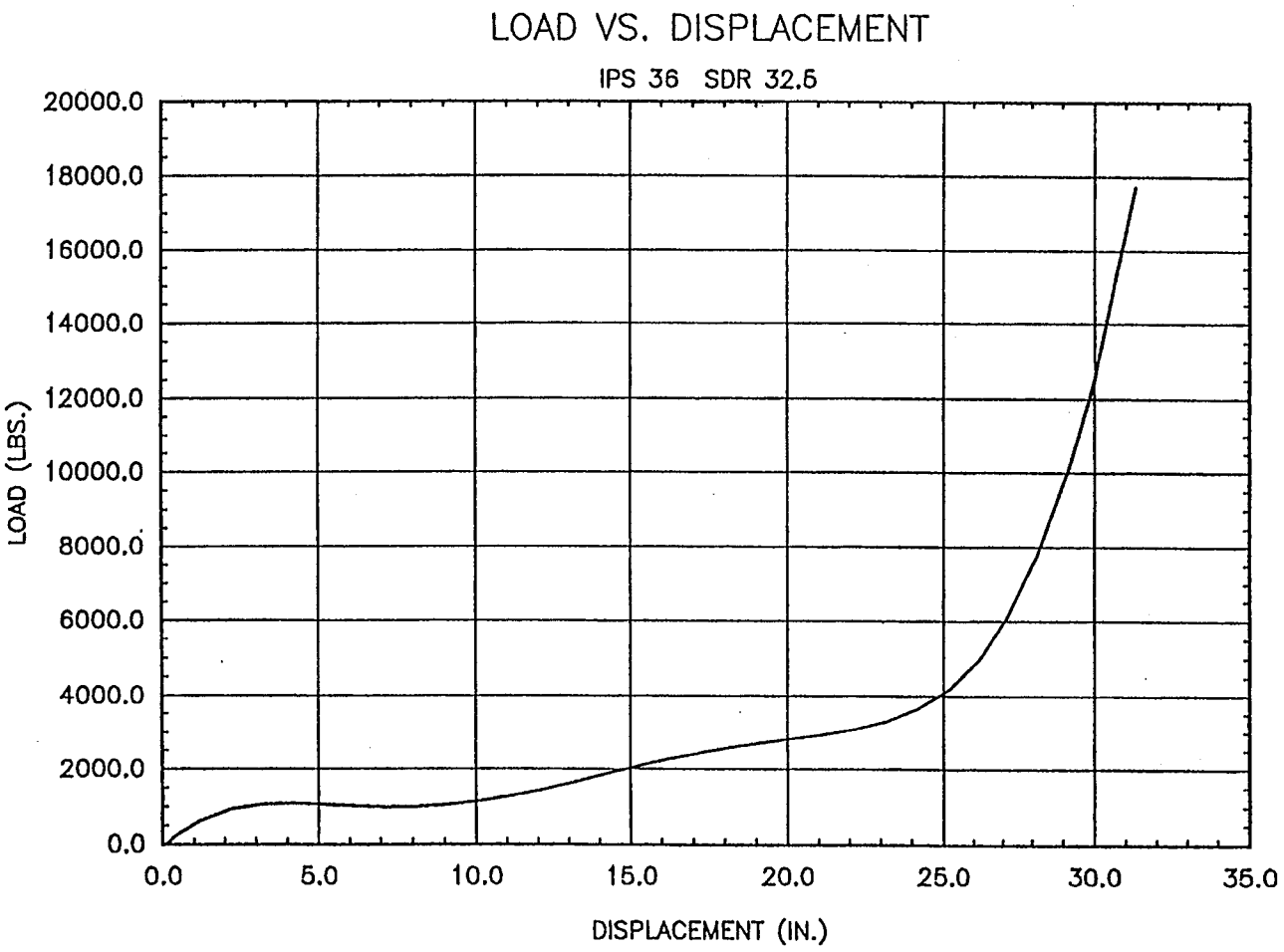
FIG. 23. Quasi-static Load vs. Displacement for IPS 36 SDR32.5.
Figure 24:
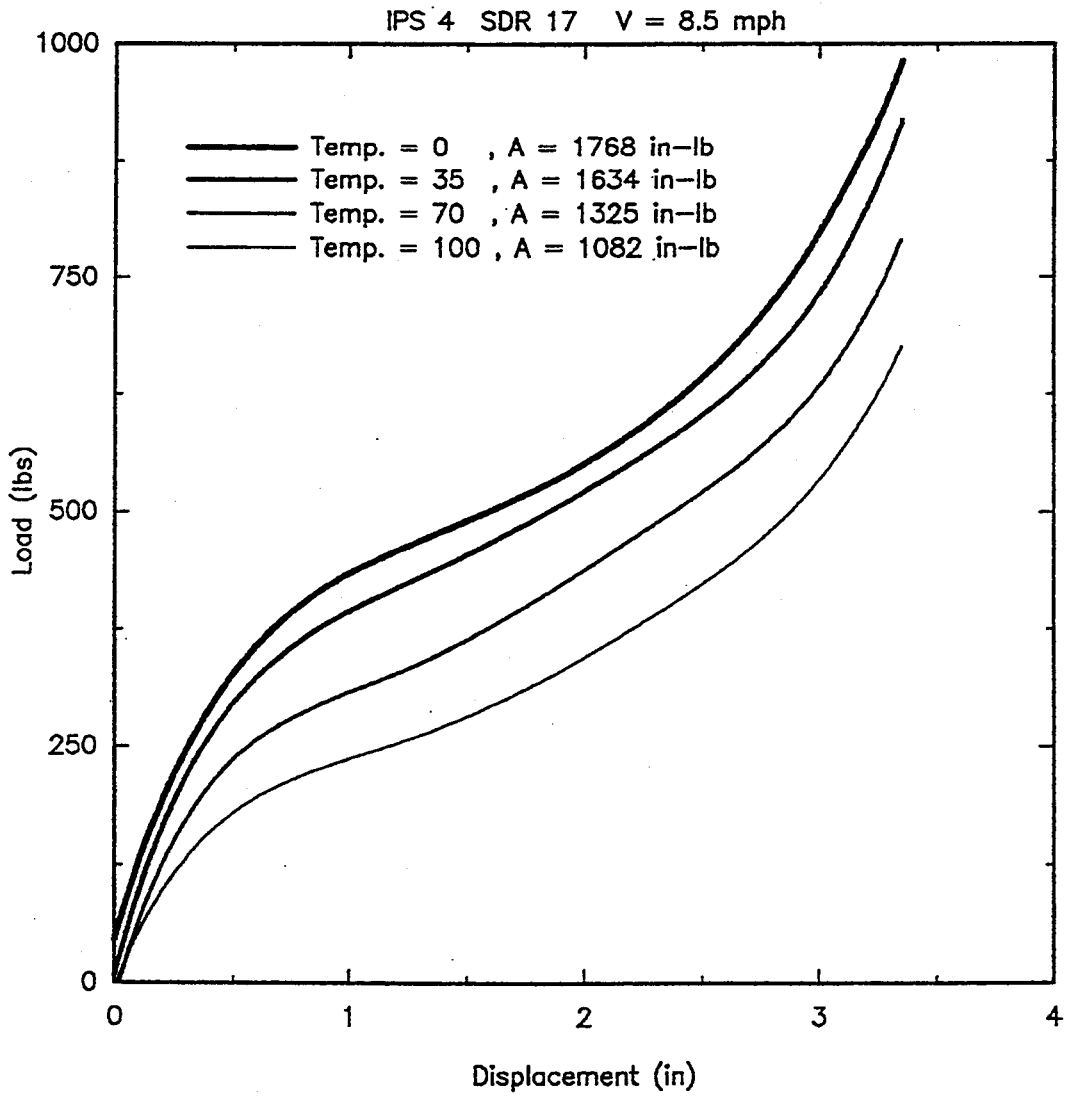
FIG. 24. 8.5 mph Impact Test for IPS 4 SDR17.
Figure 25:
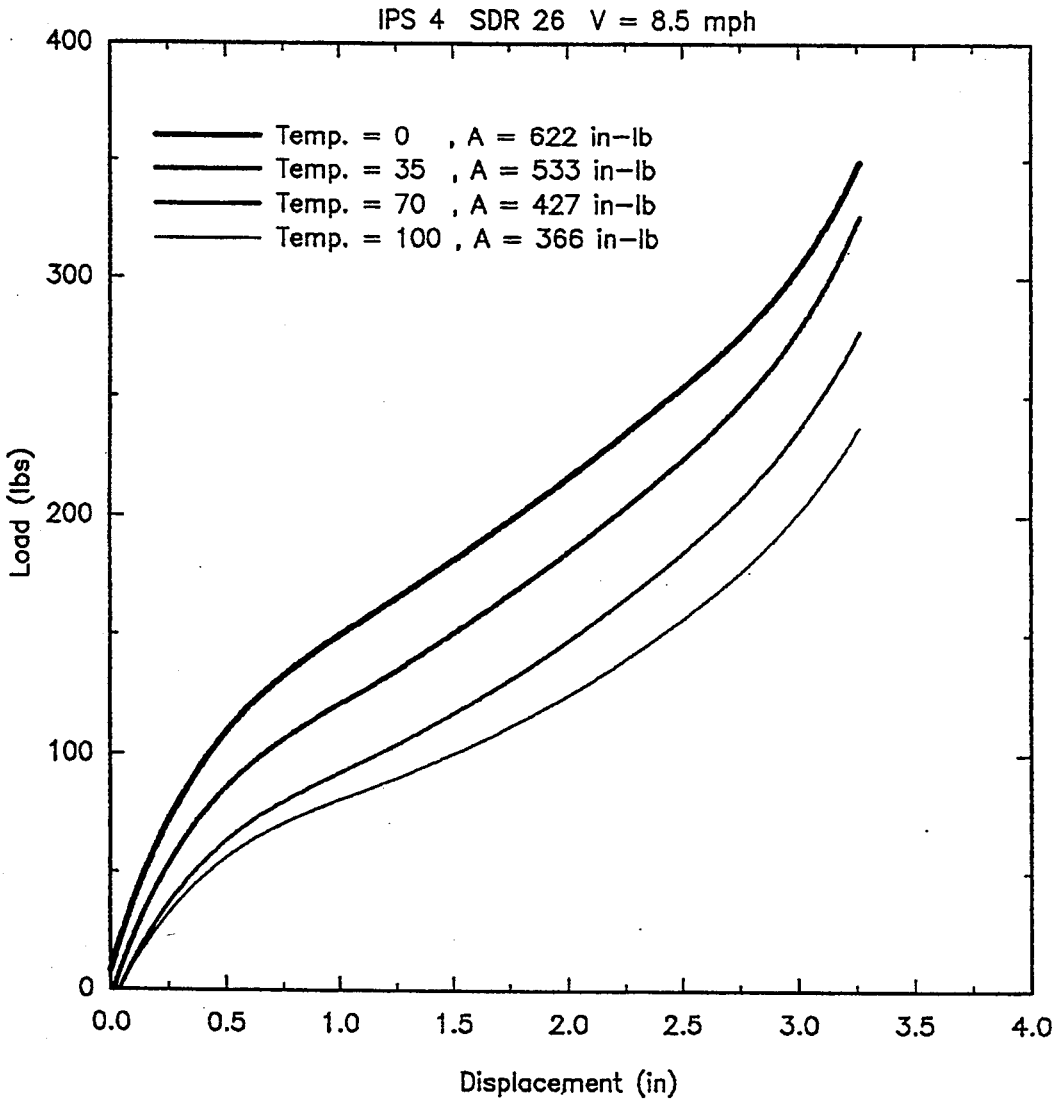
FIG. 25. 8.5 mph Impact Test for IPS 4 SDR26.
Figure 26:
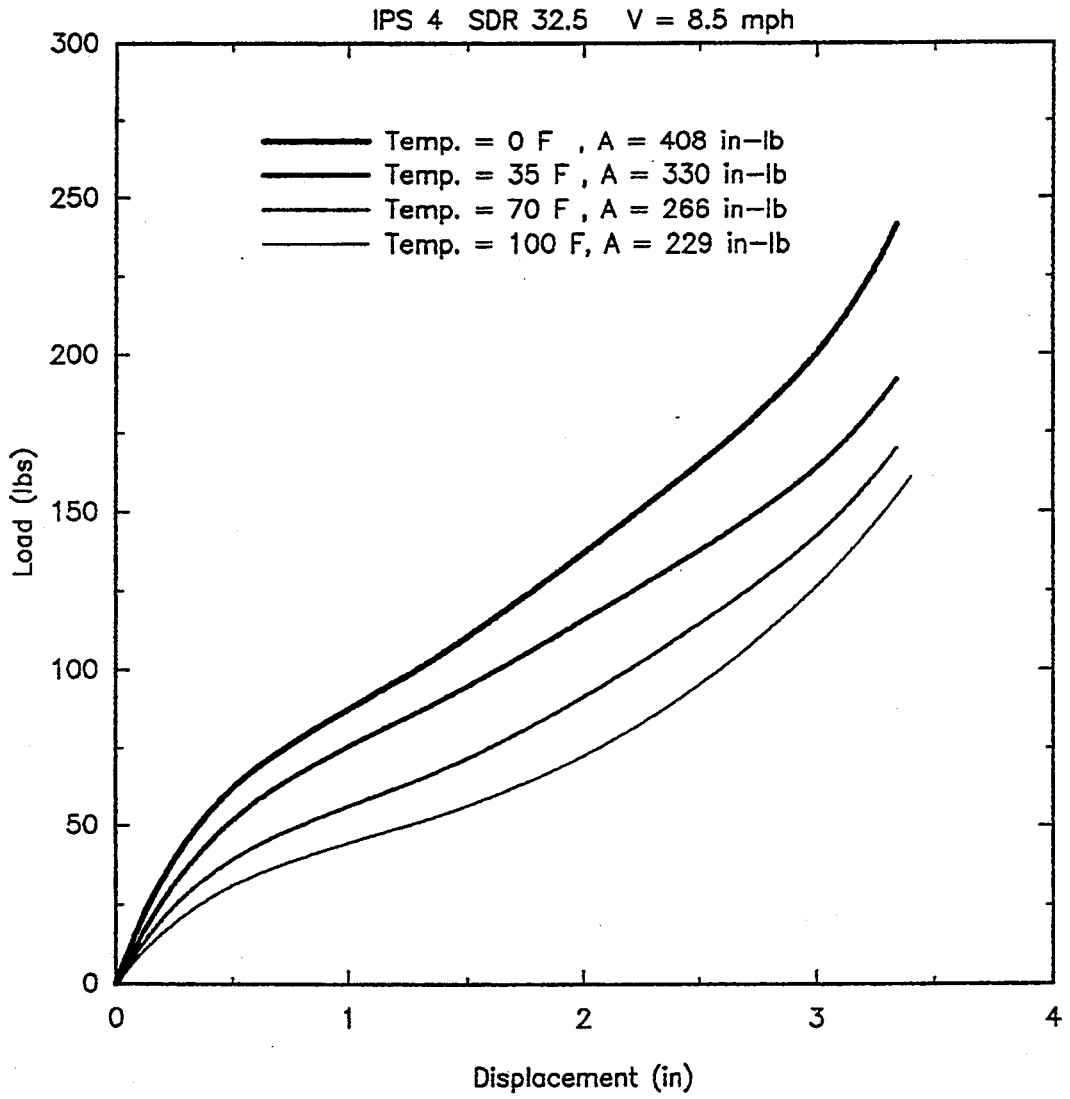
FIG. 26. 8.5 mph Impact Test for IPS 4 SDR32.5.
Figure 27:
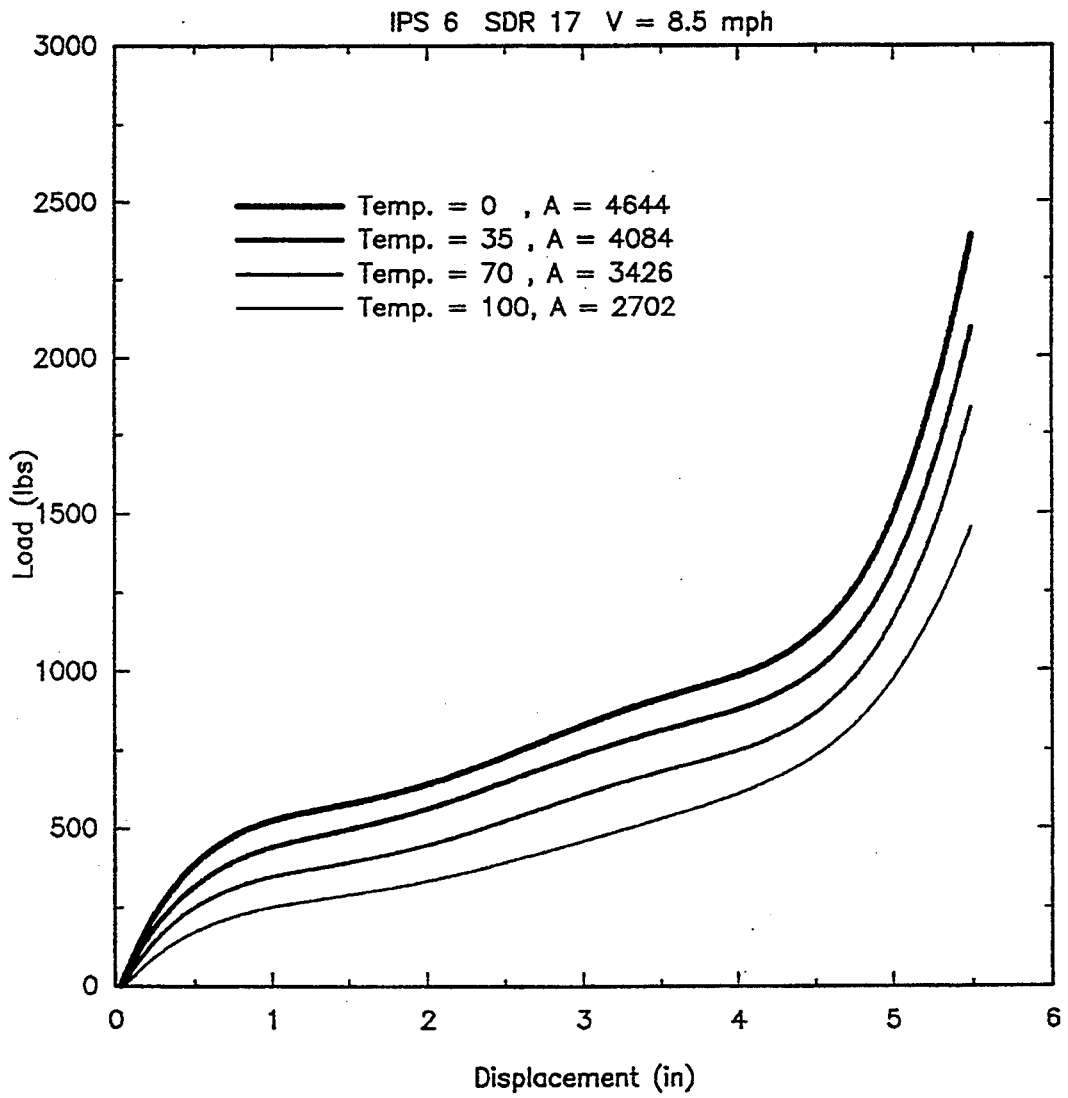
FIG. 27. 8.5 mph Impact Test for IPS 6 SDR17.
Figure 28:
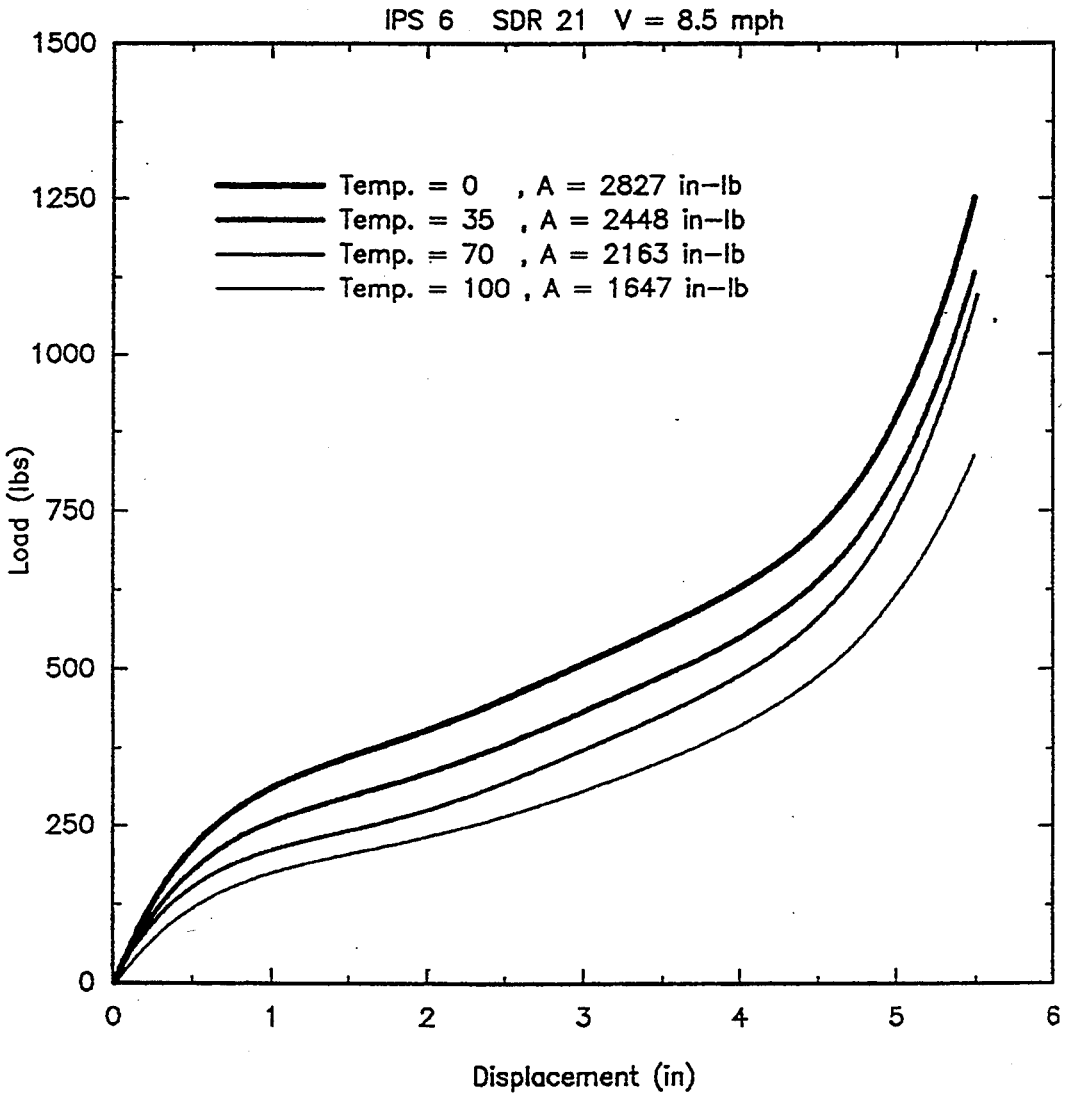
FIG. 28. 8.5 mph Impact Test for IPS 6 SDR21.
Figure 29:
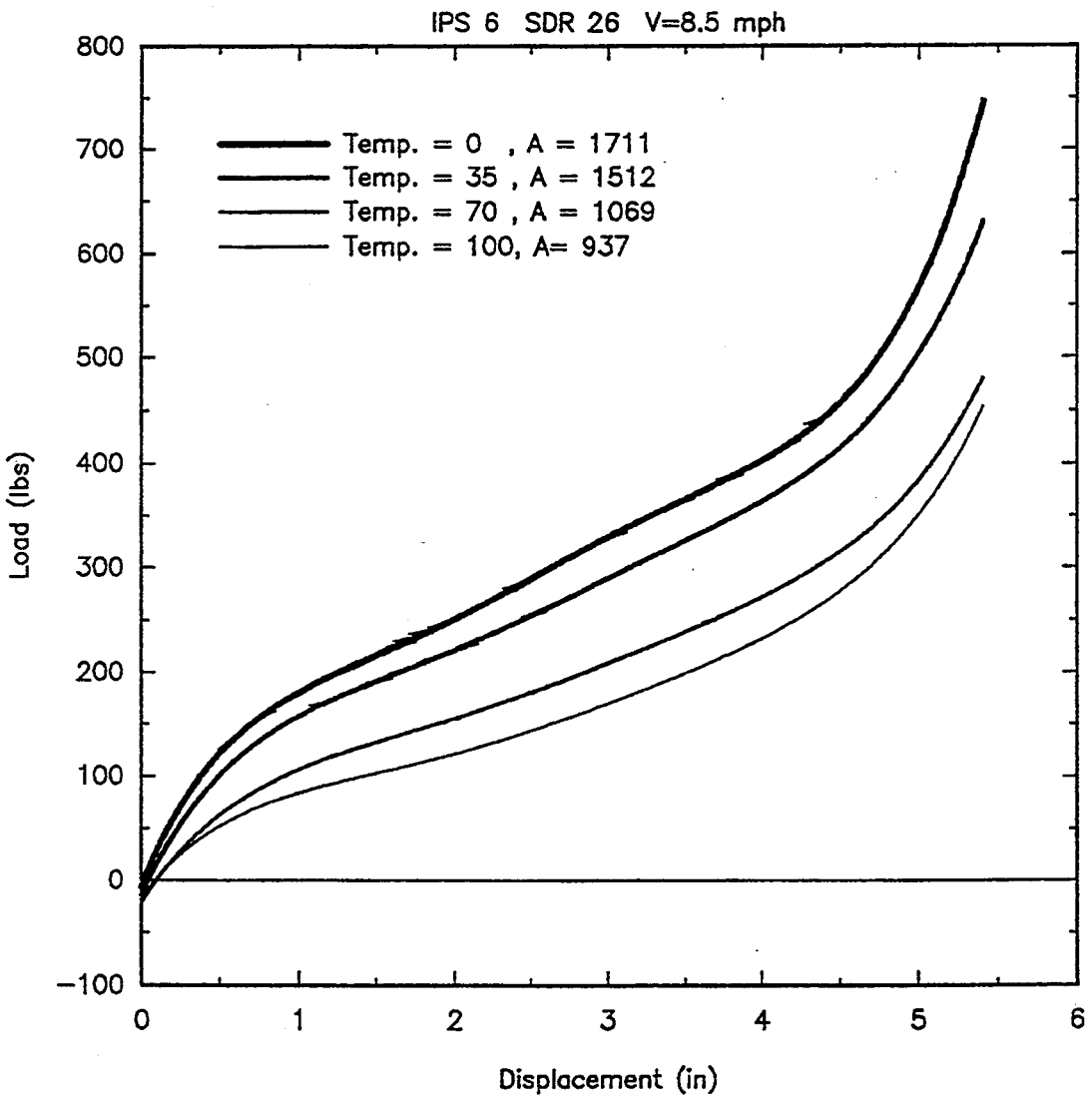
FIG. 29. 8.5 mph Impact Test for IPS 6 SDR26.
Figure 30:
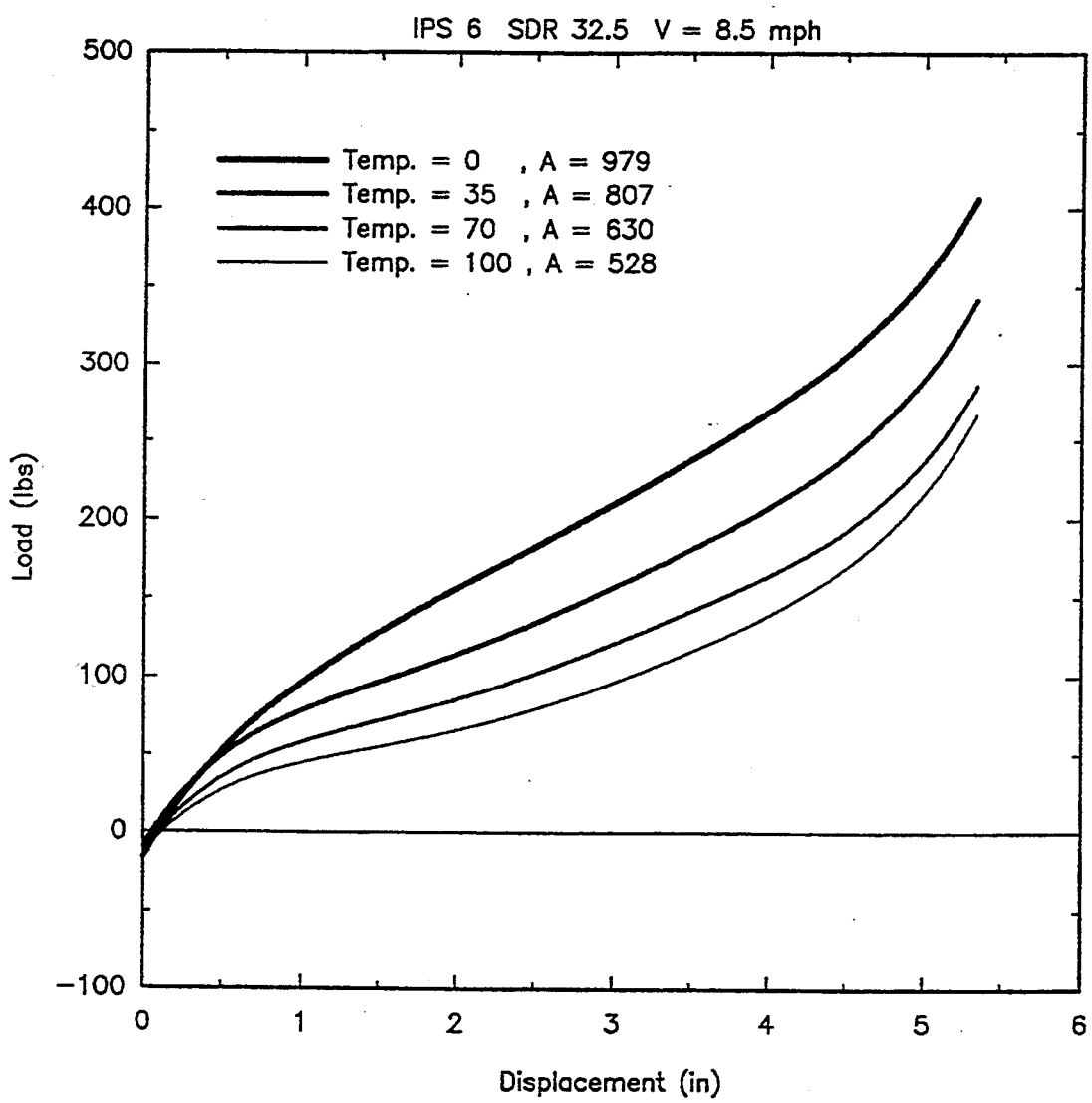
FIG. 30. 8.5 mph Impact Test for IPS 6 SDR32.5.
Figure 31:
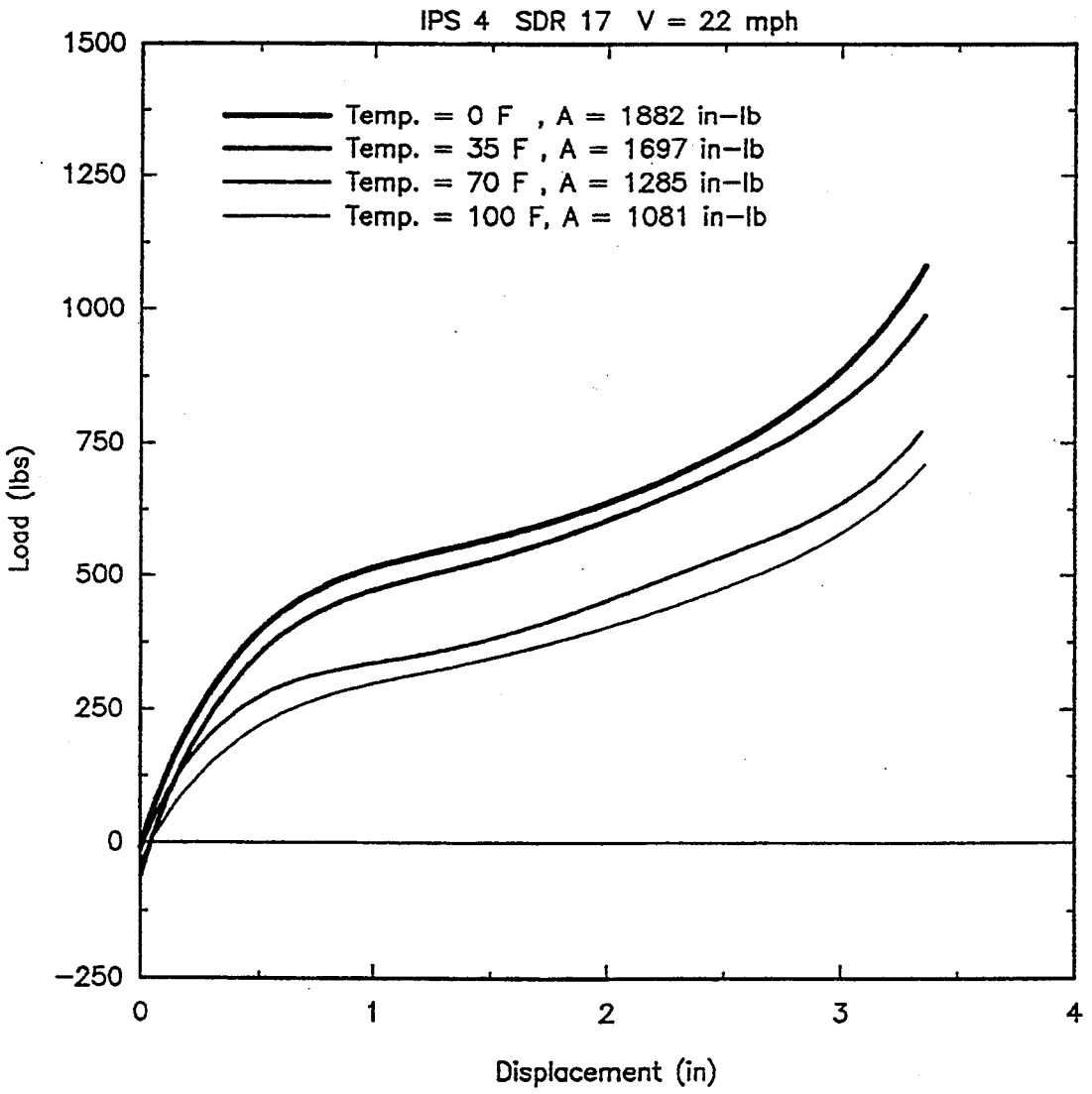
FIG. 31. 22 mph Impact Test for IPS 4 SDR17.
Figure 32:
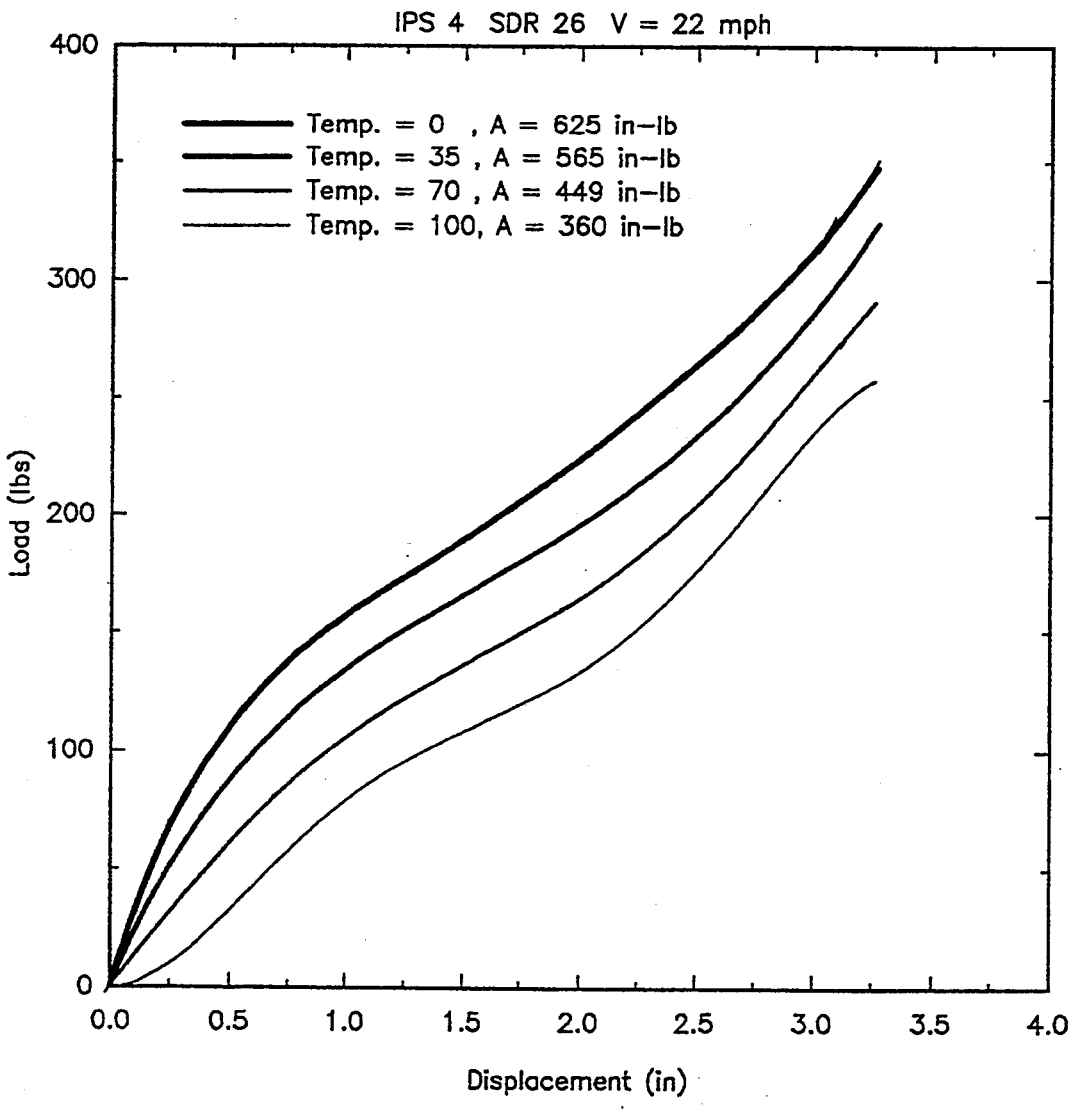
FIG. 32. 22 mph Impact Test for IPS 4 SDR26.
Figure 33:
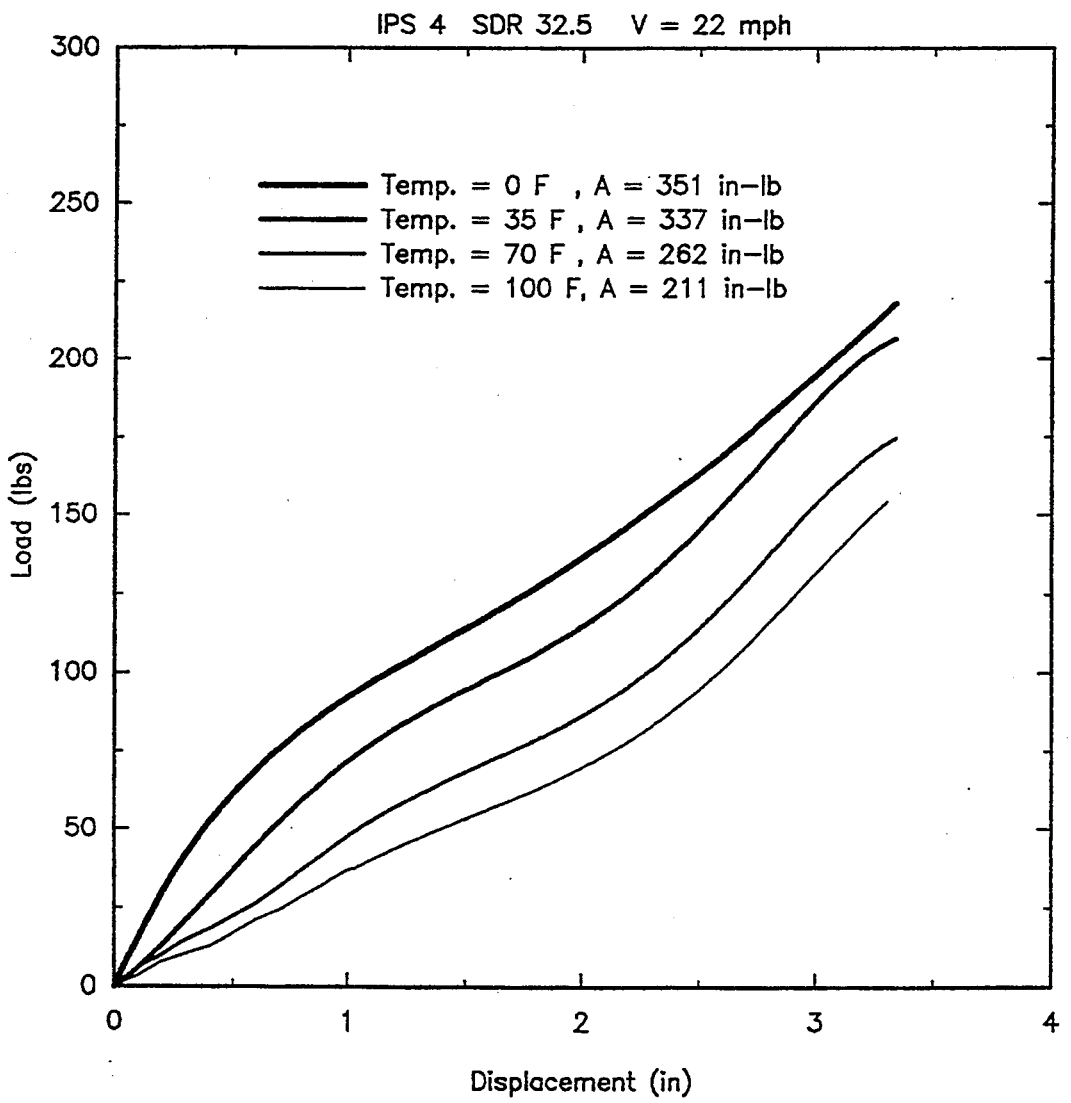
FIG. 33. 22 mph Impact Test for IPS 4 SDR32.5.
Figure 34:
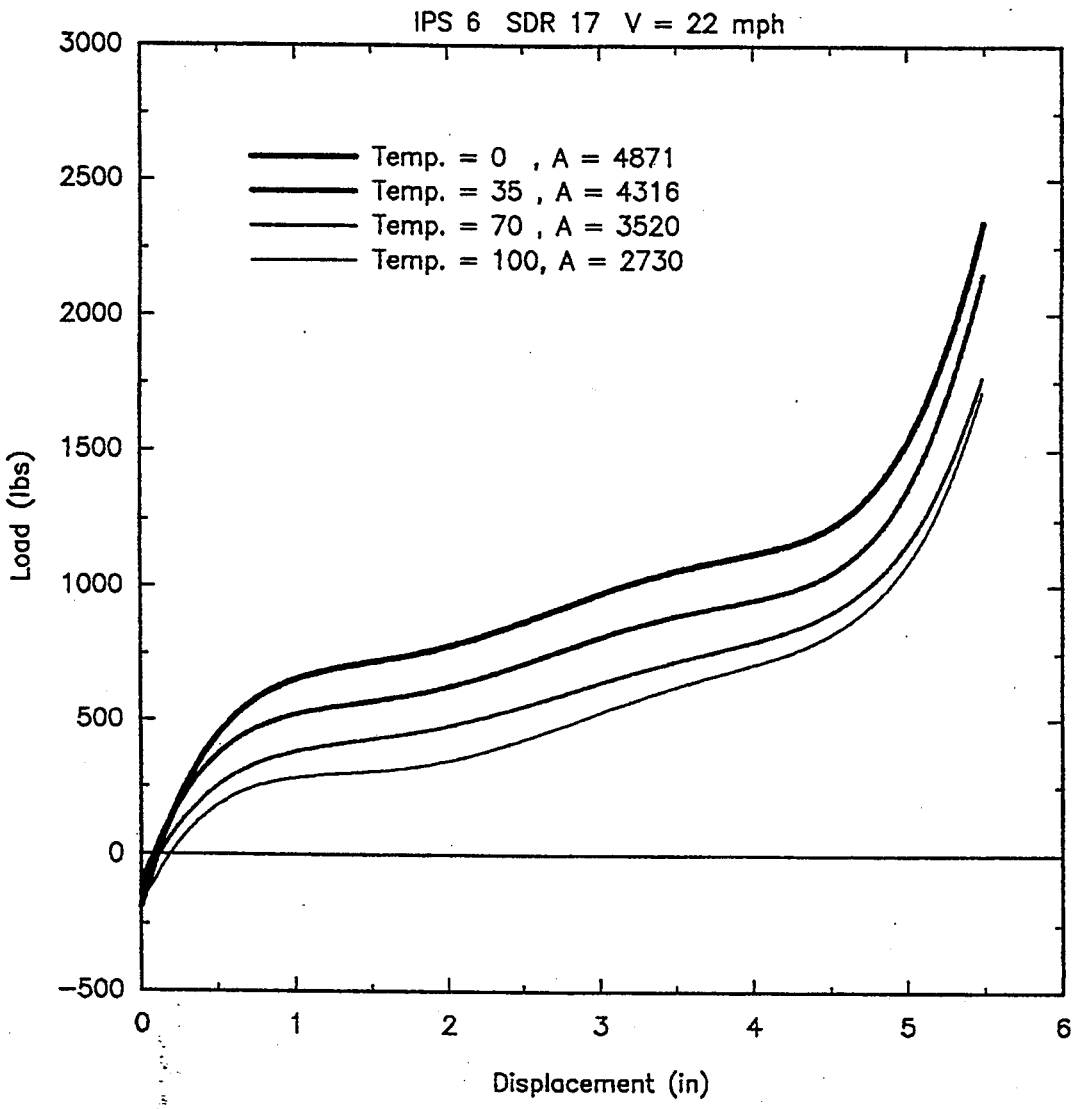
FIG. 34. 22 mph Impact Test for IPS 6 SDR17.
Figure 35:
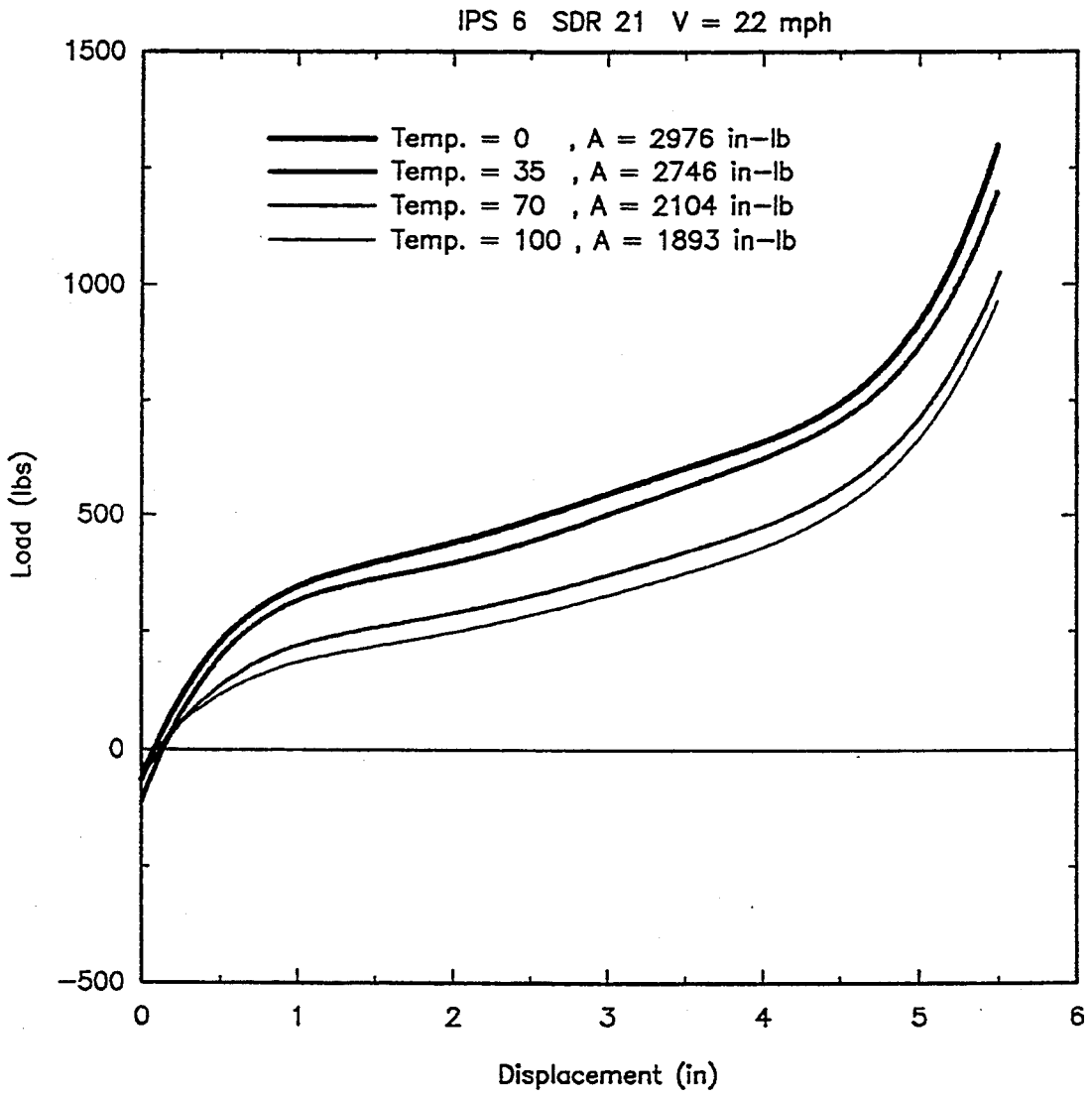
FIG. 35. 22 mph Impact Test for IPS 6 SDR21.
Figure 36:
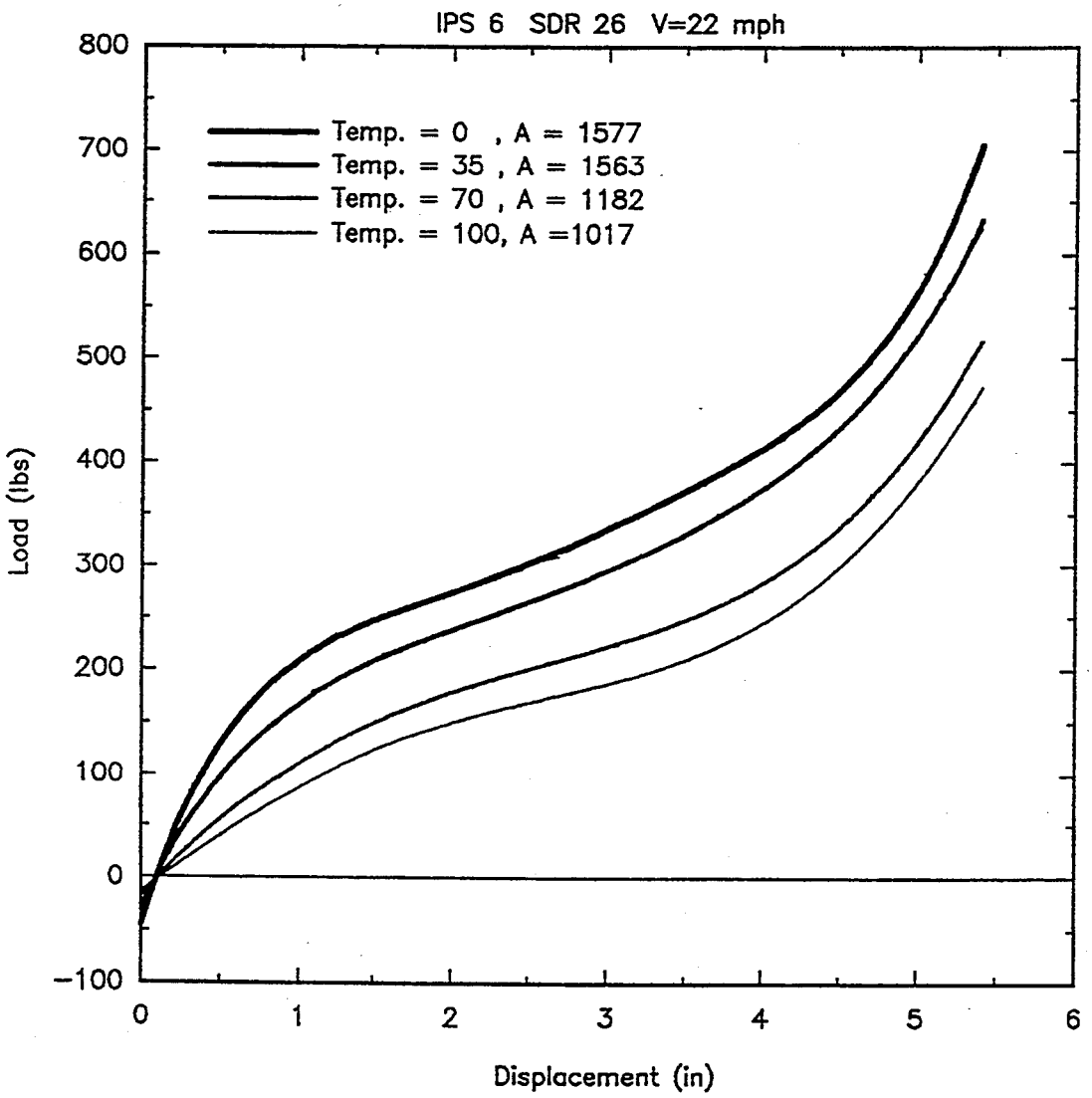
FIG. 36. 22 mph Impact Test for IPS 6 SDR26.
Figure 37:
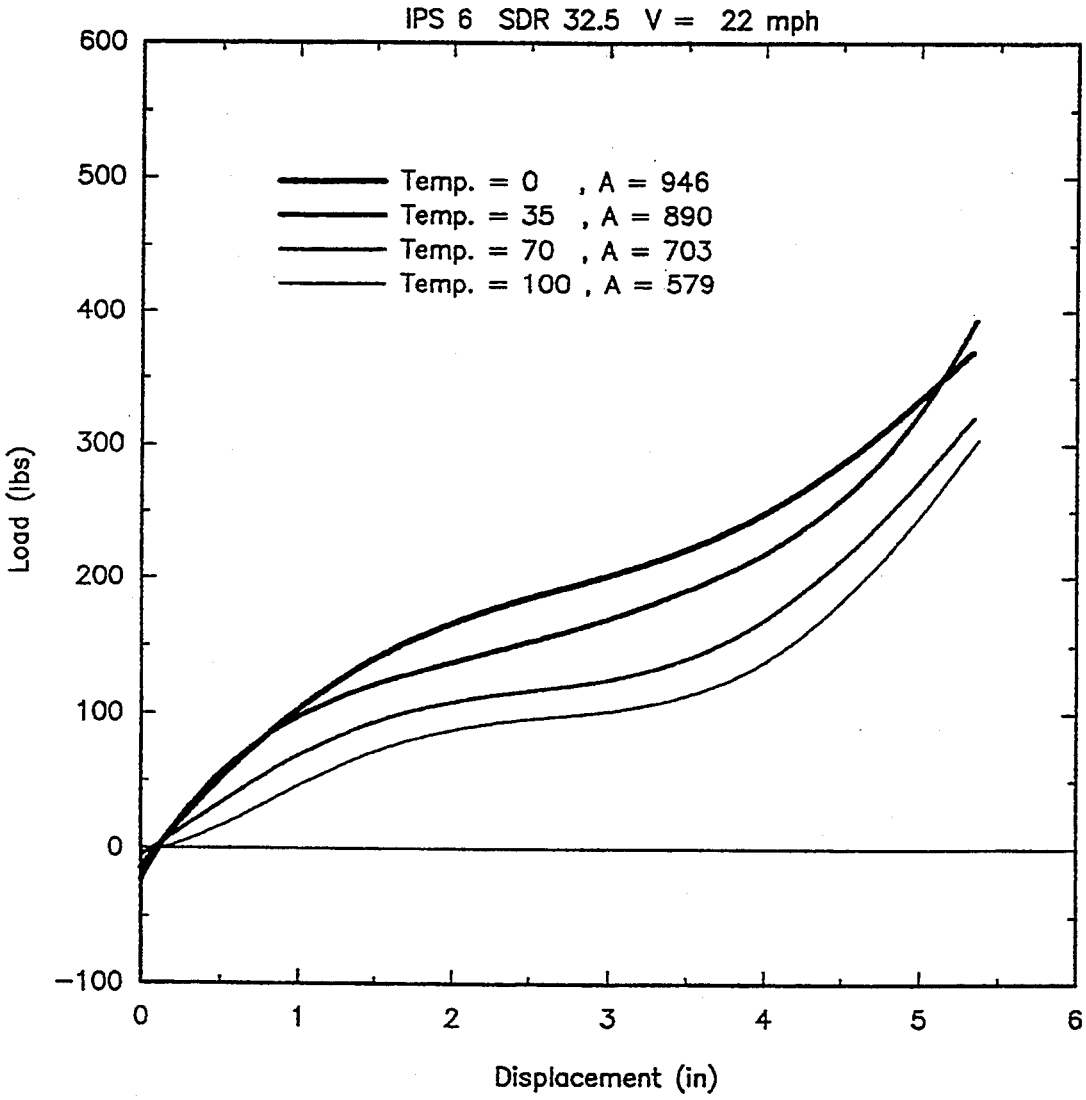
FIG. 37. 22 mph Impact Test for IPS 6 SDR32.5.
Figure 38:
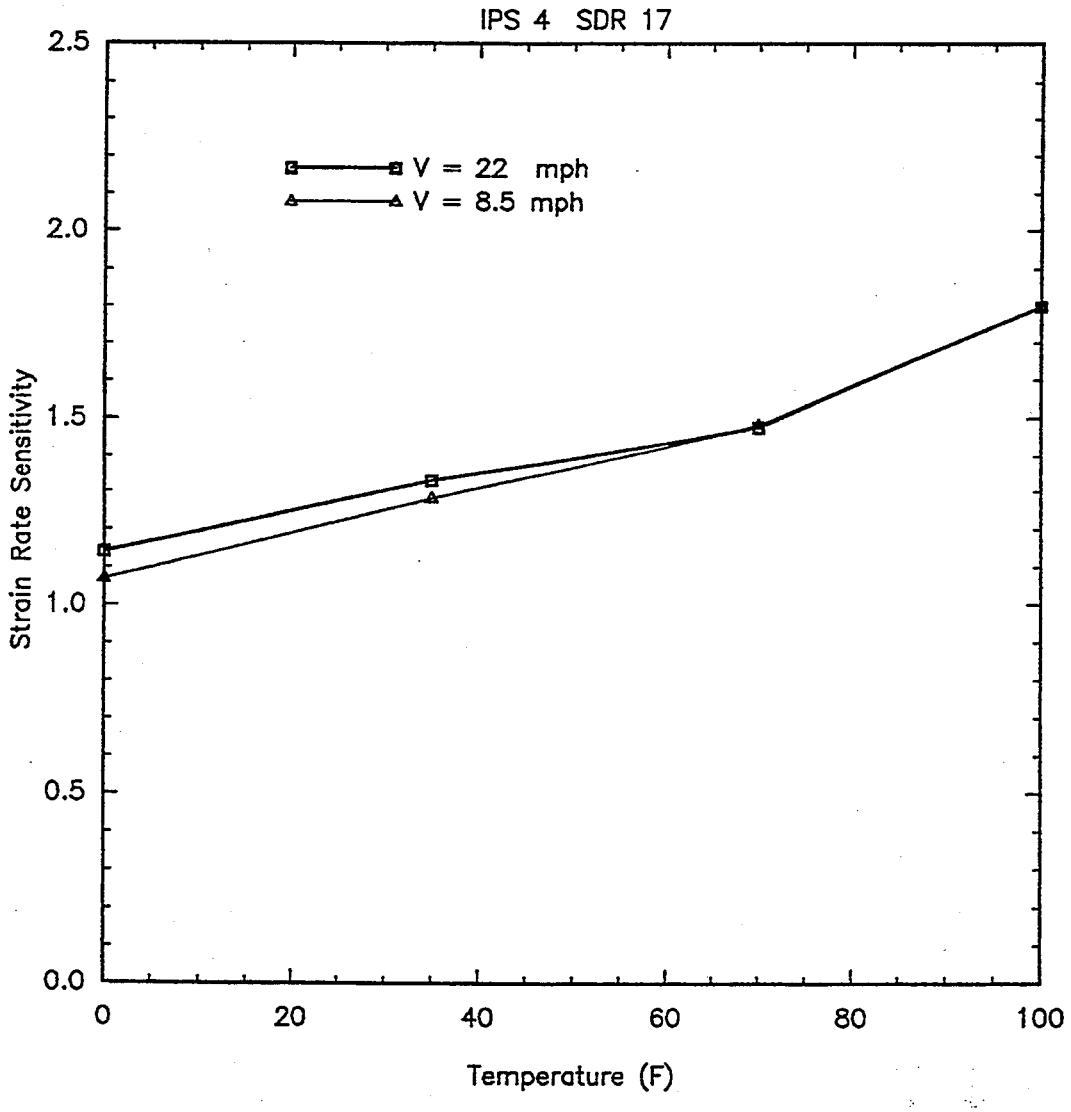
FIG. 38. Strain Rate Sensitivity Factors for IPS 4 SDR17.
Figure 39:
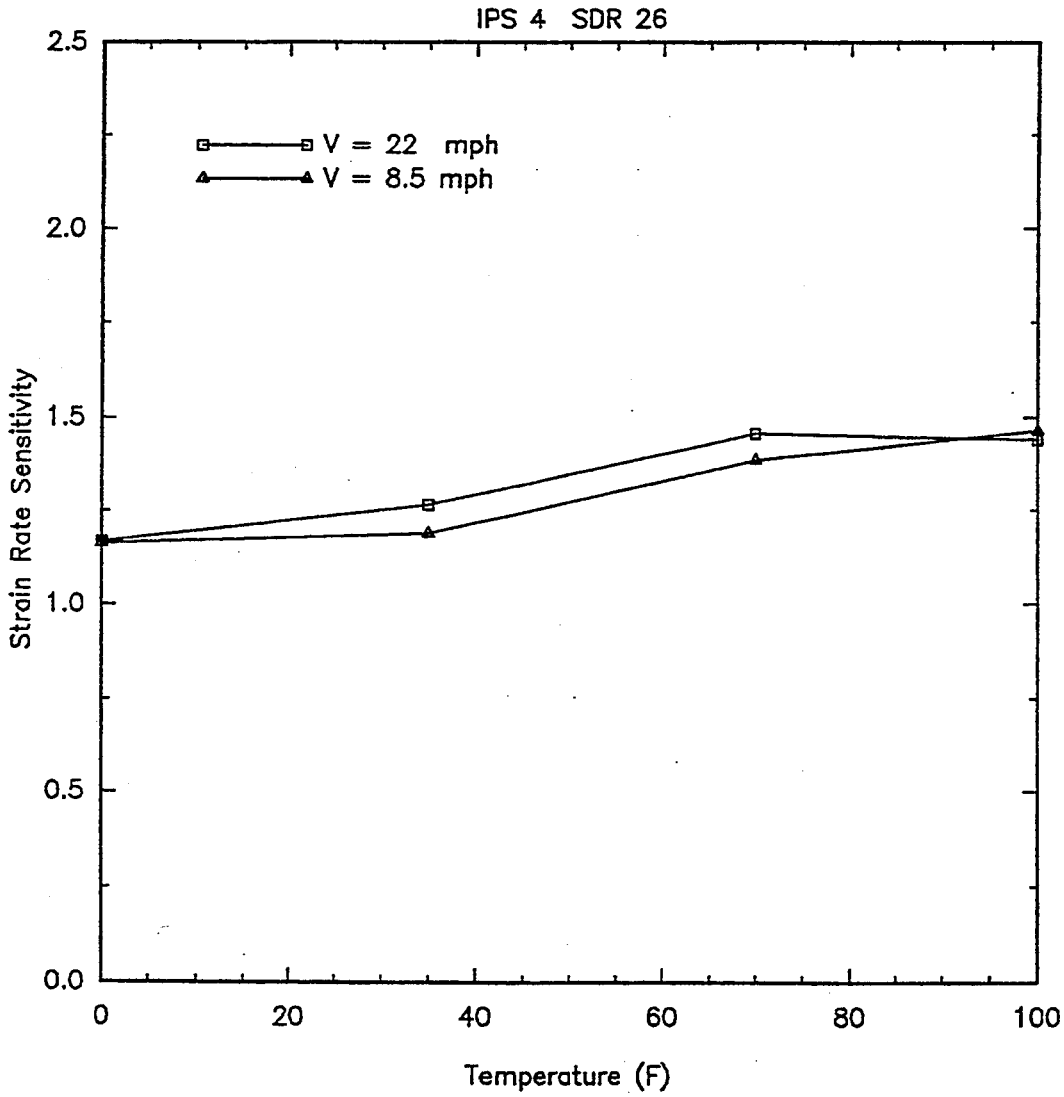
FIG. 39. Strain Rate Sensitivity Factors for IPS 4 SDR26.
Figure 40:
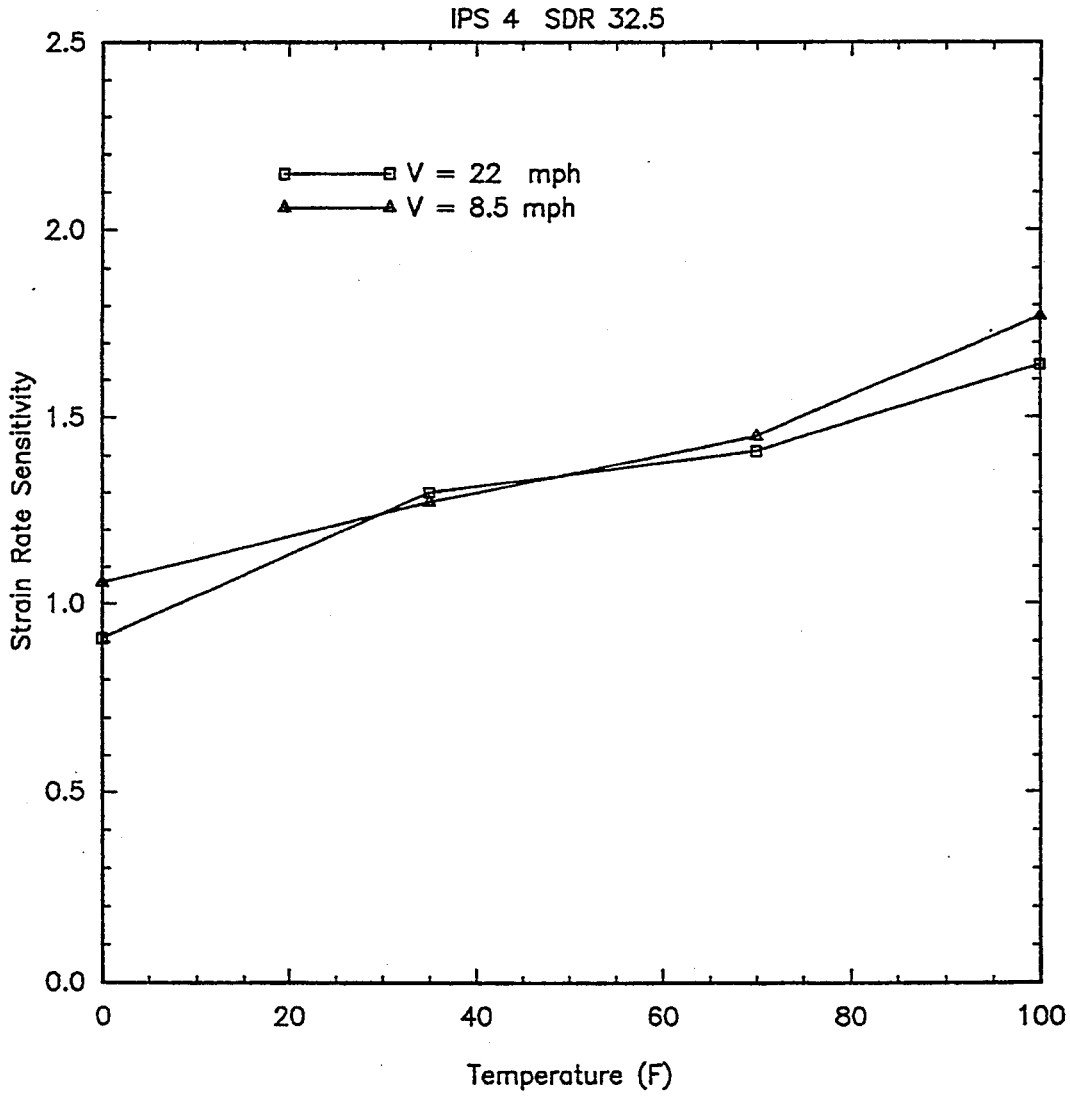
FIG. 40. Strain Rate Sensitivity Factors for IPS 4 SDR32.5.
Figure 41:
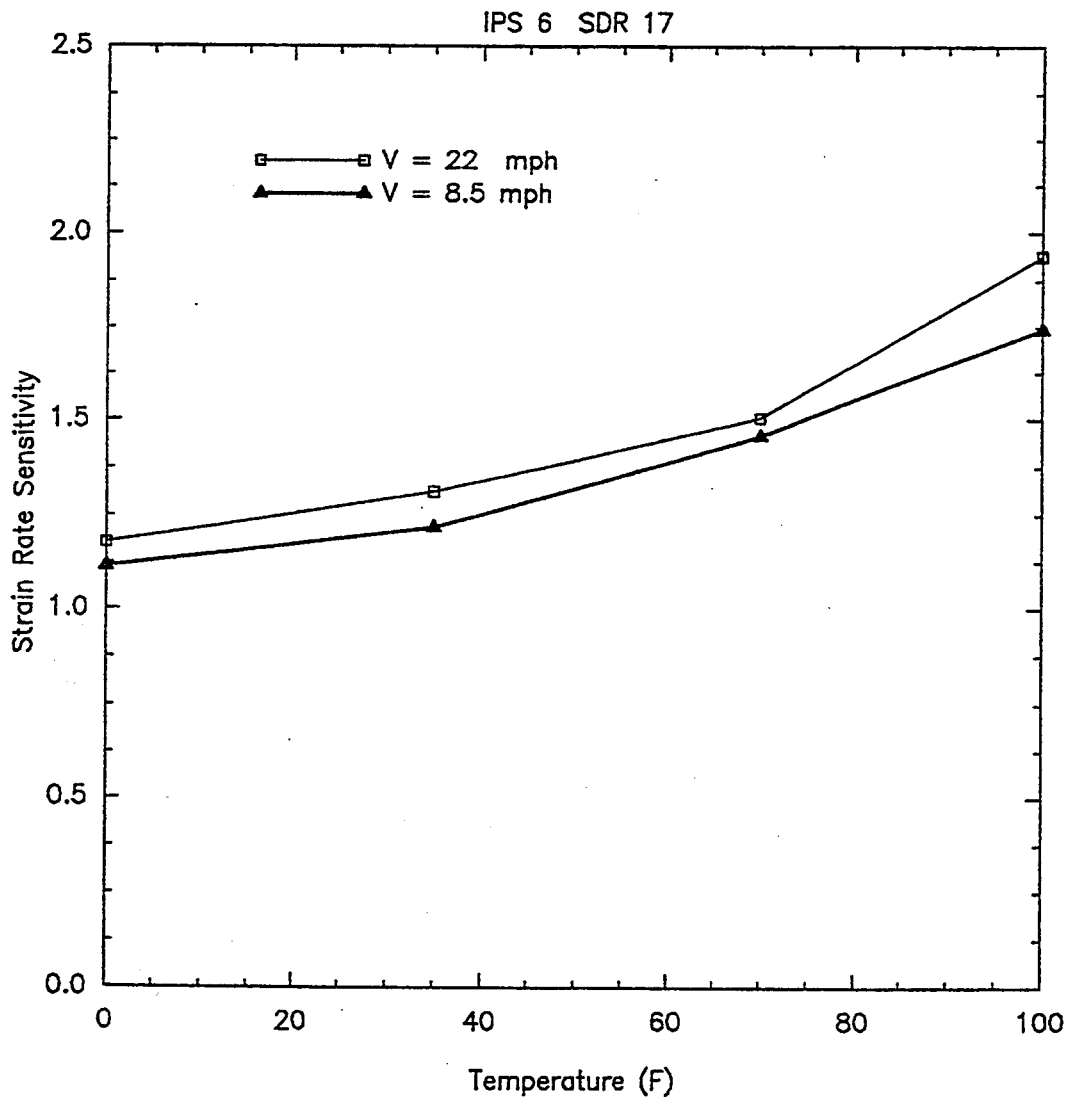
FIG. 41. Strain Rate Sensitivity Factors for IPS 6 SDR17.
Figure 42:
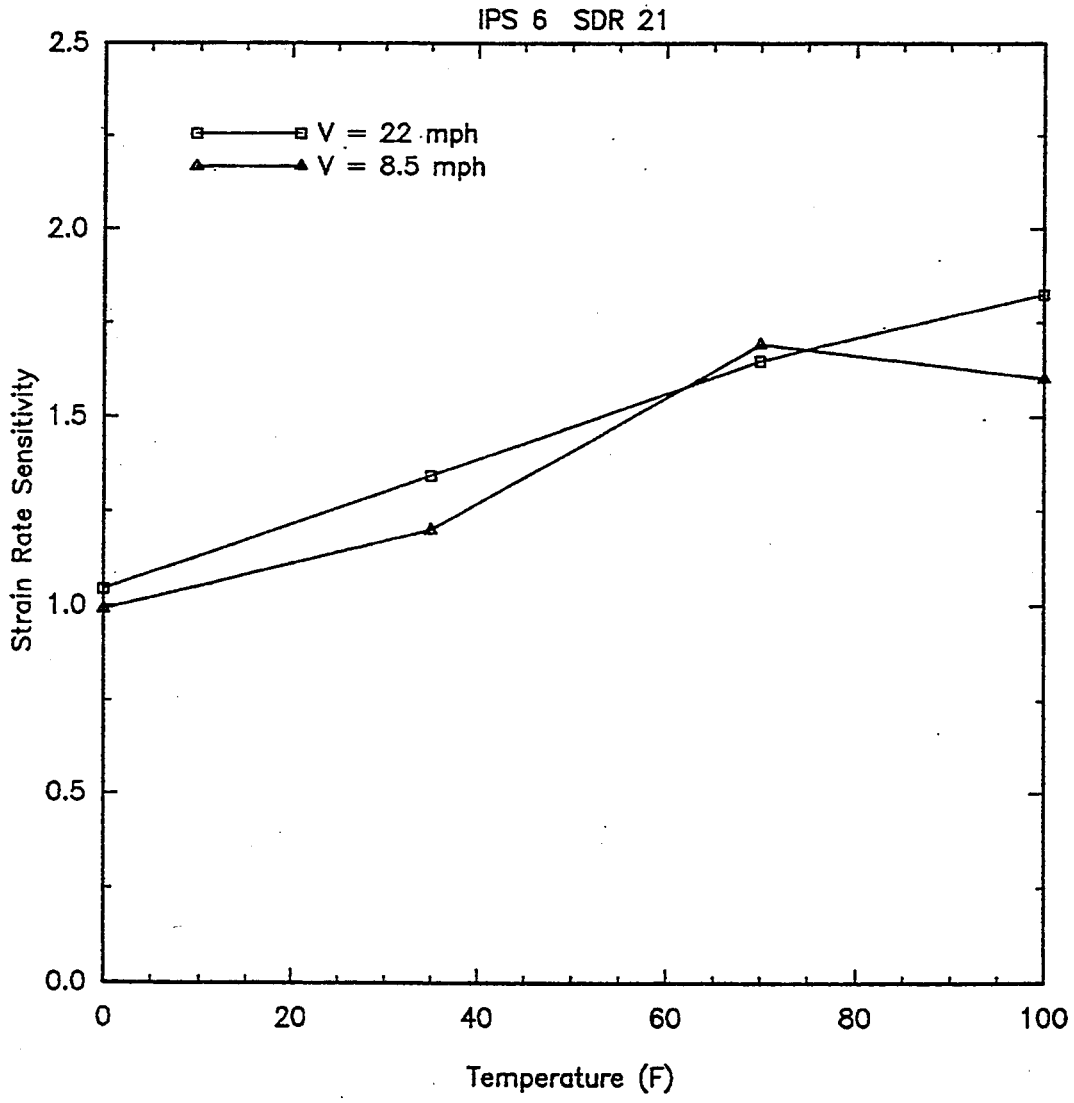
FIG. 42. Strain Rate Sensitivity Factors for IPS 6 SDR21.
Figure 43:
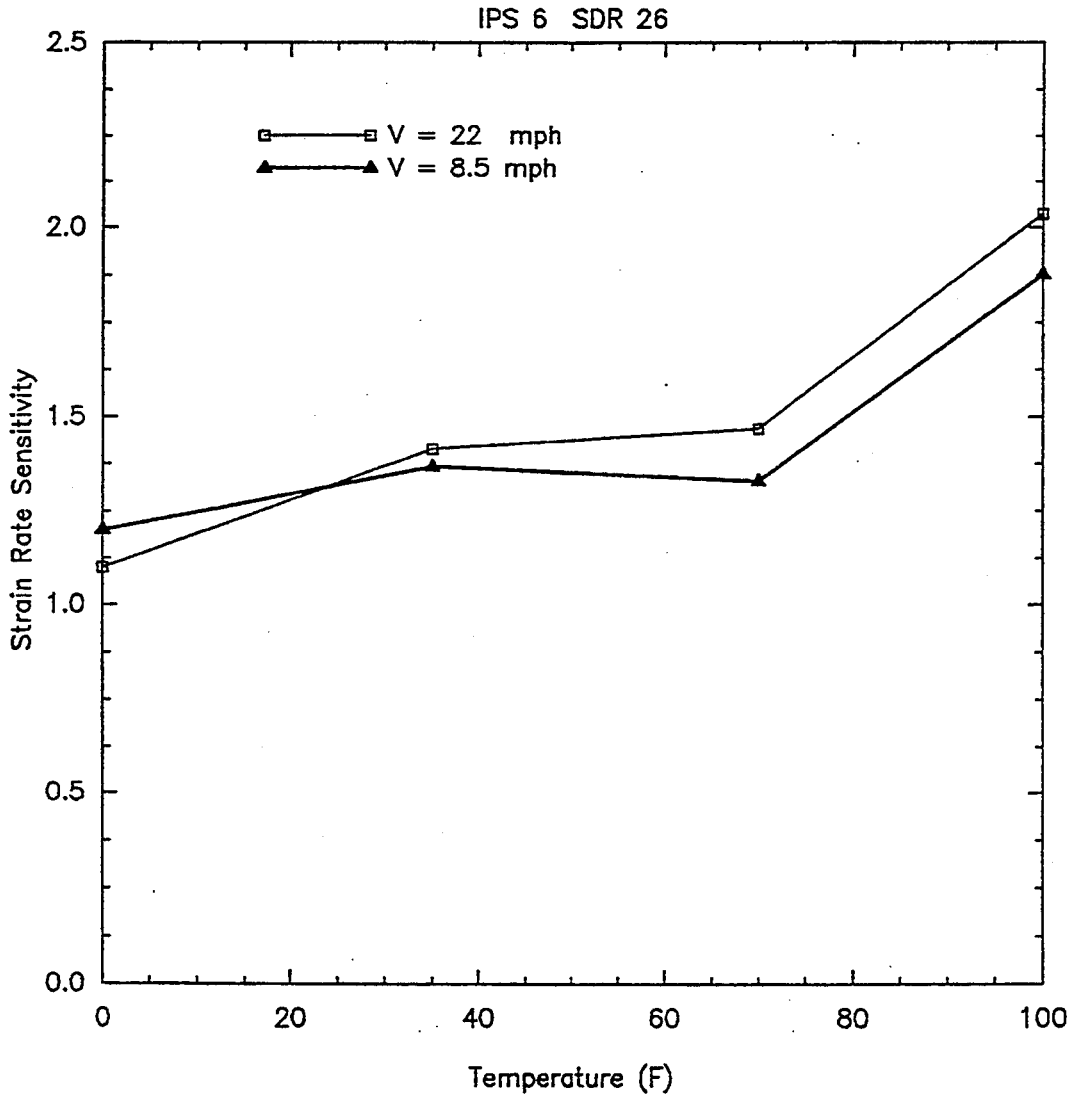
FIG. 43. Strain Rate Sensitivity Factors for IPS 6 SDR26.
Figure 44:
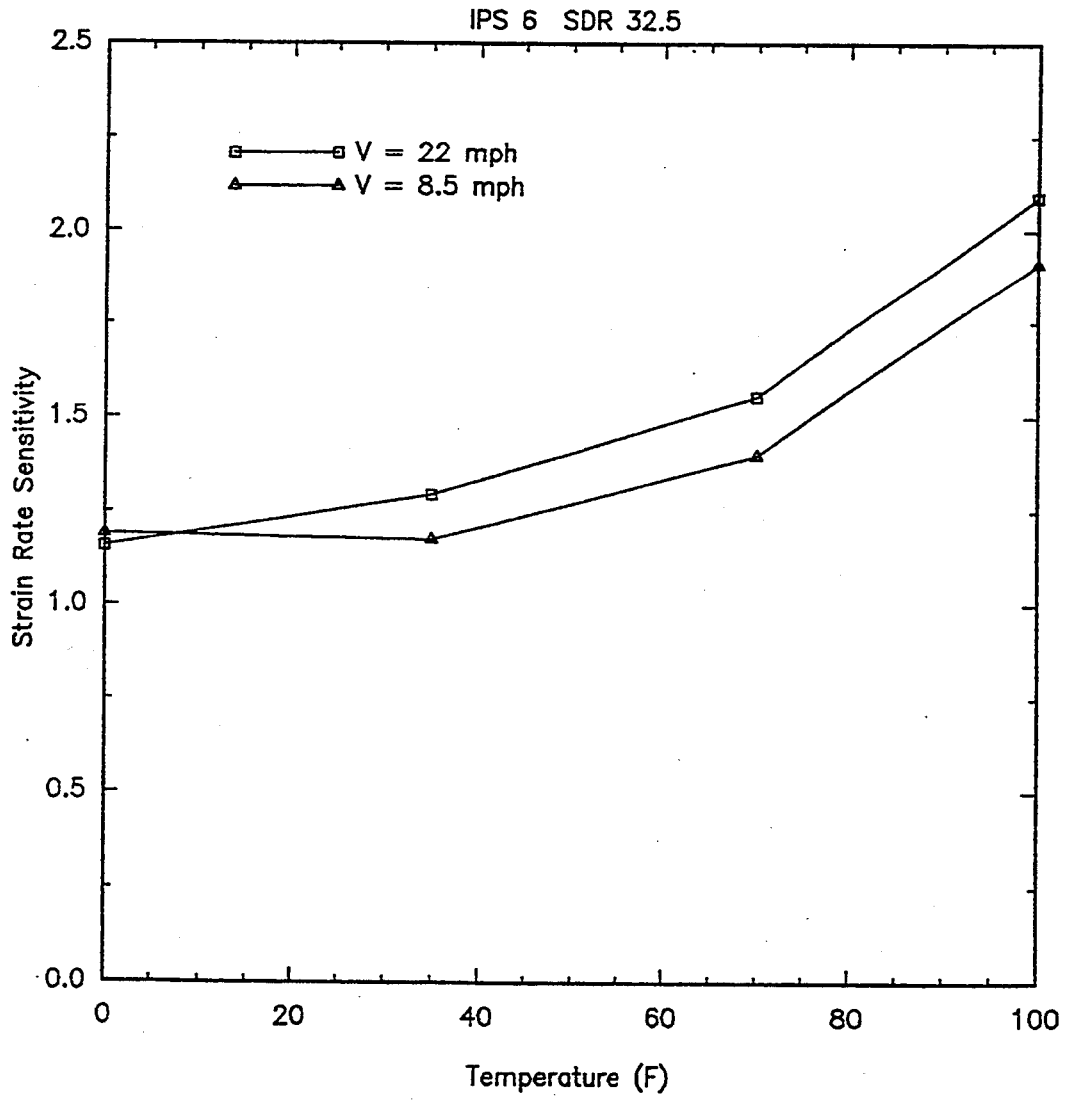
FIG. 44. Strain Rate Sensitivity Factors for IPS 6 SDR32.5.

A limited testing program was conducted with the larger diameter samples listed in Table 4. The test specimens were all 8 in. in length and loaded as shown in FIG. 19. True plate loading was obtained by inserting two steel box beams in the testing machine. The load-displacement curves for these four tests are shown in FIGS. 20–23.

SIGNIFICANT FINDINGS FROM QUASI-STATIC TESTS

- Loads bifurcate into two loads during collapse process, resulting in increased energy dissipation.
- Energy dissipation decreases with increase in test temperature.
- Cylinders retain their ductility under large deformations—no stress fractures occurred.
- Cylinders restore themselves to approximately 90% of their original shapes upon removal of load.
- Load-deformation characteristics are essentially unaffected by repeated loadings.

B. IMPACT TESTS

The impact loading tests were conducted in a MTS 312131 servo-hydraulic testing machine under closed loop control. This machine is capable of applying a maximum static load of P max=7000 lb. The actuator was allowed to reach maximum velocity prior to impact by retracting it by approximately 10 in. The stroke (actuator's displacement) was calibrated at different scales, i.e.,2.0, 5.0, and 10.0 in., prior to testing in order to obtain accurate impact velocity measurements. The impact velocity was varied by modifying the aperture of the servo-hydraulic valve.

The impact load absorbed by the specimen was measured with a Kistler quartz force link Type 9342A installed in the cross head. This sensor is capable of gauging loads in the order of plus or minus 7000 lb under short term static or dynamic modes. The high rigidity of the force link, combined with its high resolution, resulted in an extremely high resonant frequency of the measuring arrangement, thus eliminating the risk of "ringing."

Data acquisition was accomplished by means of a DT2821 high speed single-board analog/digital data acquisition system (from Data Translation, Inc.) installed in an IBM AT386 clone. The software used for the A/D conversion was Global Lab from the same company. The load and stroke channels were configured in a differential mode in order to keep the electrical noise to a minimum.

The seven tube sizes given in Table 1 were each tested at two different impact velocity values, 8.5 and 22 mi/h, and four different temperatures, 0 degrees, 35 degrees, 70 degrees, and 100 degrees F. The results are presented in FIGS. 24–37. It is particularly interesting to compare the corresponding areas under the load vs displacement curves under quasi-static and impact loading conditions. The area under each curve represents the energy dissipated during the deformation process. Note that under quasi-static loading conditions, these areas are sensitive functions of temperature. Consider, for example, the ratio of areas for the IPS=6, SDR=17 specimen size at two temperature extremes (see FIG. 8):

$$\left(\frac{A_{0^\circ}}{A_{100^\circ}}\right)_{STATIC} = \frac{4166}{1549} = 2.69$$

The impact loading program, in contrast, demonstrates that this temperature sensitivity which is present under quasi-static conditions is much reduced under impact conditions. This very significant and here-to-fore unknown fact is made clear by comparing the specific impact test results of FIGS. 24–37, with the corresponding quasi-static responses of FIGS. 5–11.

It is of particular interest to note that:

- At 0 degrees F., the energy dissipation capacity is largely unaffected by the rate of loading.
- At 100 degrees F., the energy dissipation capacity is significantly influenced by the rate of loading.

The consequence of this experimental fact is that the sensitivity of the energy dissipation potential of a HMW HDPE tube to temperature under impact loading conditions is significantly less than under quasi-static ones. Consider, for example, the result from FIG. 27:

$$\left(\frac{A_{0^\circ}}{A_{100^\circ}}\right)_{IMPACT} = \frac{4644}{2702} = 1.72$$

The strain rate sensitivity factor (SRS) is defined as the ratio of the impact to quasi-static energy dissipation capacities of a tube. Strain rate sensitivity factors are presented in FIG. 38–44 for the seven tube sizes under consideration for two sets of impact velocities. Note that the rate of loading is of little import at low temperatures and very significant at high temperatures.

SIGNIFICANT FINDINGS FROM IMPACT TESTS

- Sensitivity of energy dissipation potential of HMW HDPE to temperature under impact loading conditions is significantly less than under quasi-static ones.
- Strain rate sensitivity increases with temperature.
- Fracture under impact loading did not occur, even at low test temperature.

MATHEMATICAL MODELING OF ENERGY DISSIPATION CHARACTERISTICS OF HMW HDPE TUBES

The quasi-static and impact experimental results presented in the previous section were analyzed using Statistical Analysis Software to determine the influence of the various independent parameters on the energy dissipation capacity of HMW HDPE tubes. These parameters include tube thickness, radius, and length, the test temperature, and the impact ;speed.

A. SMALL DIAMETER TUBES

The first modeling phase involved the quasi-static data obtained for the small diameter (4.5- and 6.625-in) tubes presented in FIGS. 5–11. This effort included 7 different tube sizes and 4 different test temperatures, a total of 28 experiments. The statistical analysis of this data yielded the following expression for dissipated energy:

$$\text{Energy}=\beta_0 L R^{\beta_1} t^{\beta_2} F(T)$$

where

Figure 45:
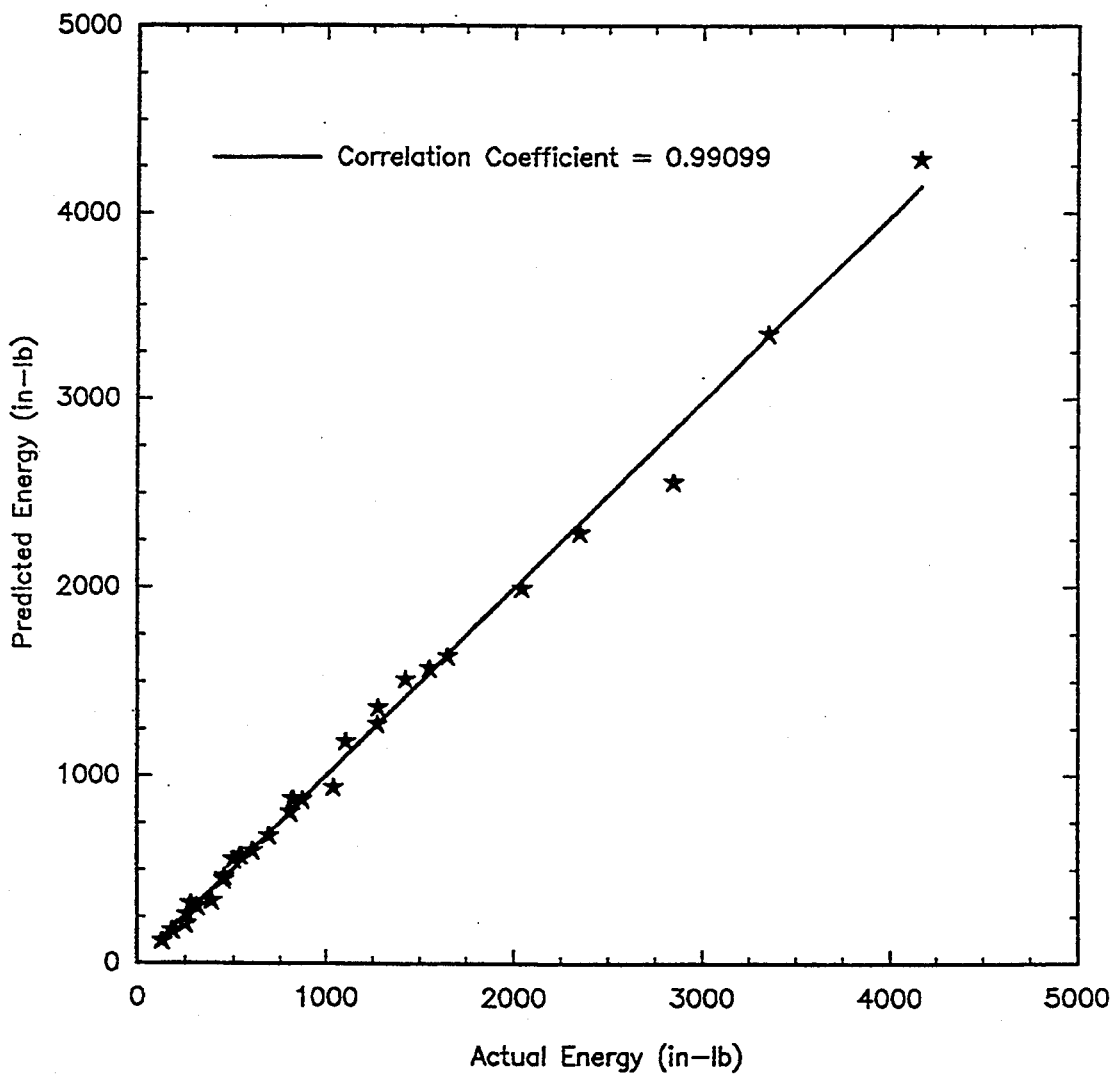
FIG. 45. Predicted vs Actual Energy Dissipation in 4.5-and 6.625-in Diameter Tubes Under Quasi-Static Loading.

L=length of tube in inches
R=radius of tube in inches
t=wall thickness of tube in inches
T=test temperature in °F.
$\beta_0=102.051$
$\beta_1=4.315\times10^{-2}$
$\beta_2=2.444$
$F(T)=199.870-1.012T-9.356\times10^{-3}T^2+6.840\times10^{-5}T^3$ This expression for quasi-static energy dissipation in small diameter tubes yields quite accurate results, as illustrated in FIG. 45.

B. STRAIN RATE SENSITIVITY

The second modeling phase dealt with the determination of the strain rate sensitivity (SRS) of HMW HDPE. The test results presented in FIGS. 38–34 were employed to determine the increase in energy dissipation capacity of a HMW HDPE tube under impact loading conditions. A statistical analysis of the results of these 56 experiments resulted in the determination of the SRS in the form:

$$SRS=1.106+6.660\times10^{-}T-7.650\times10^{-5}T^2+8.340\times10^{-7}T^3$$

C. LARGE DIAMETER TUBES

The third modeling phase involved the analysis of the quasi-static tests conducted on the four tubes of large diameter. The test results were presented in FIGS. 20–23. Many real world applications would involve HMW HDPE tubes of this size or larger. The large diameter tests were conducted to avoid having to extrapolate small diameter test results into the large diameter regime. In modeling the large diameter test results, the temperature variable effect determined in the earlier tests was employed in the statistical analysis, and the following quasi-static energy dissipation predictor (EDC) was obtained:

$$EDC=\alpha_0 L R^{60\ 1} t^{60\ 2} F(T)$$

where $\alpha_0=302.732$
$\alpha_1=-0.409$
$\alpha_2=2.356$

Figure 46:
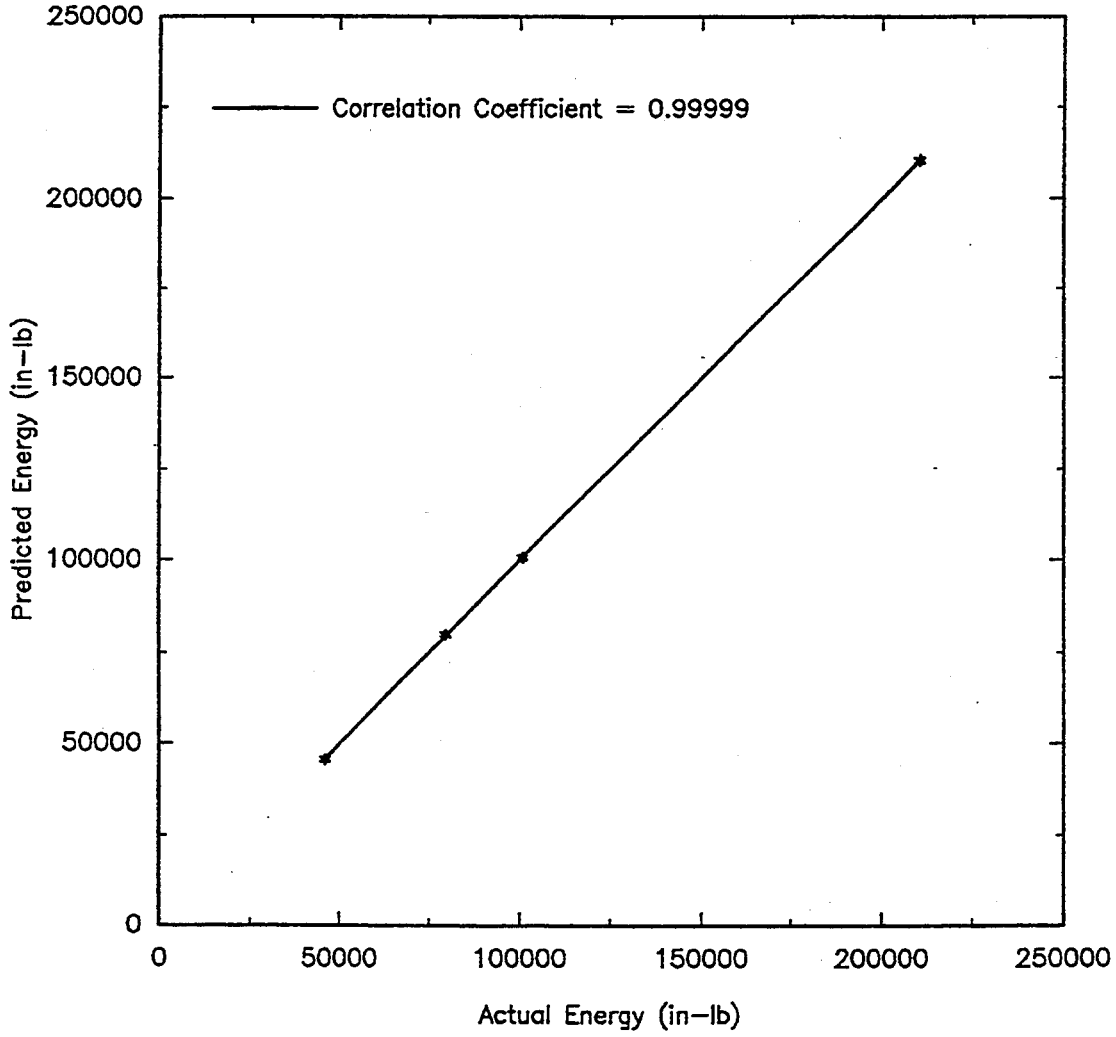
FIG. 46. Predicted vs Actual Energy Dissipation in Large Diameter Tubes Under Quasi-Static Loading.

Equation 5 yields excellent results, as can be seen in FIG. 46.

D. IMPACT MODEL FOR LARGE DIAMETER TUBES

Figure 47:
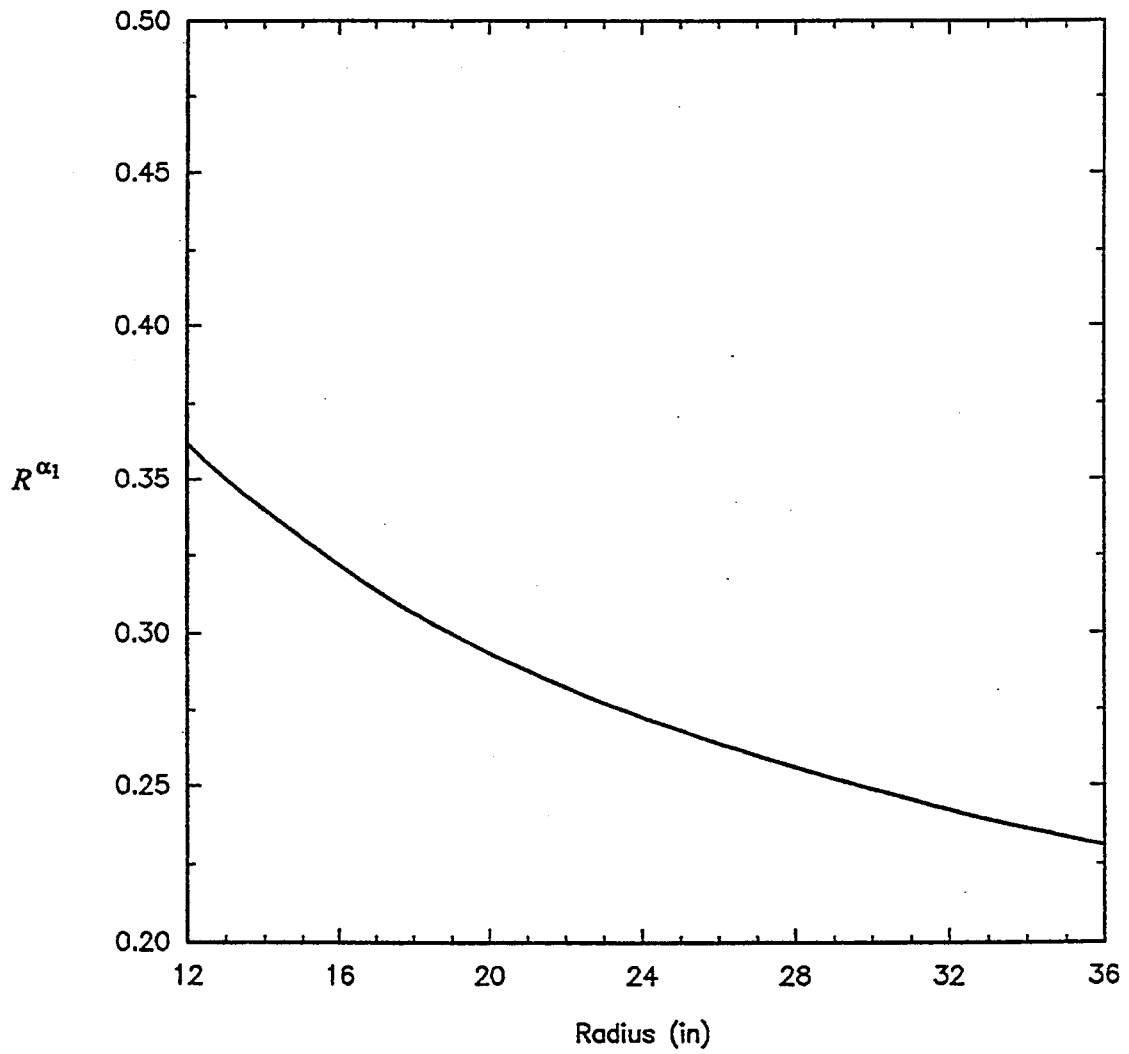
FIG. 47. Energy Dissipation Sensitivity to Radius of Tube.
Figure 48:
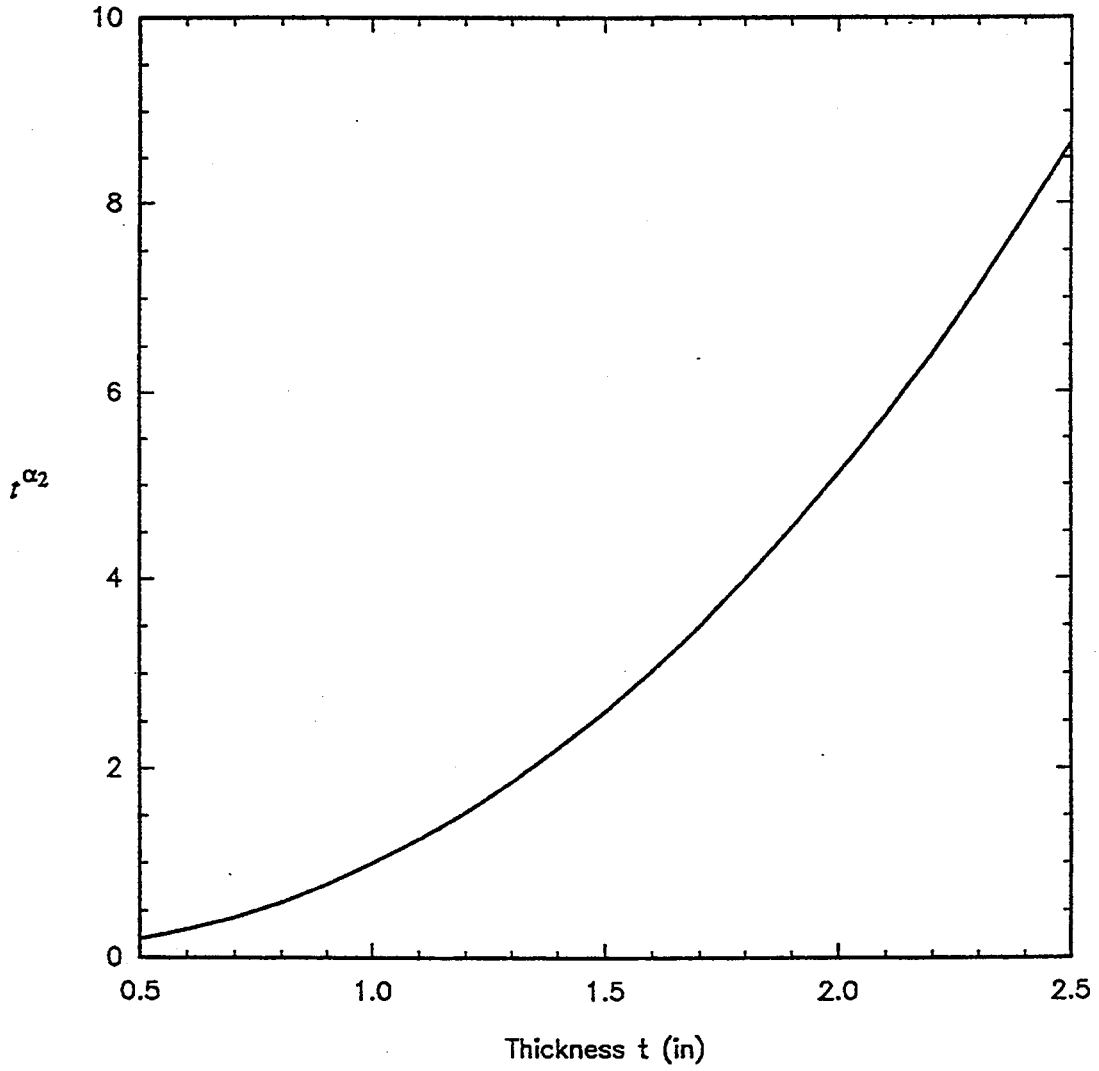
FIG. 48. Energy Dissipation Sensitivity to Wall Thickness of Tube.
Figure 49:
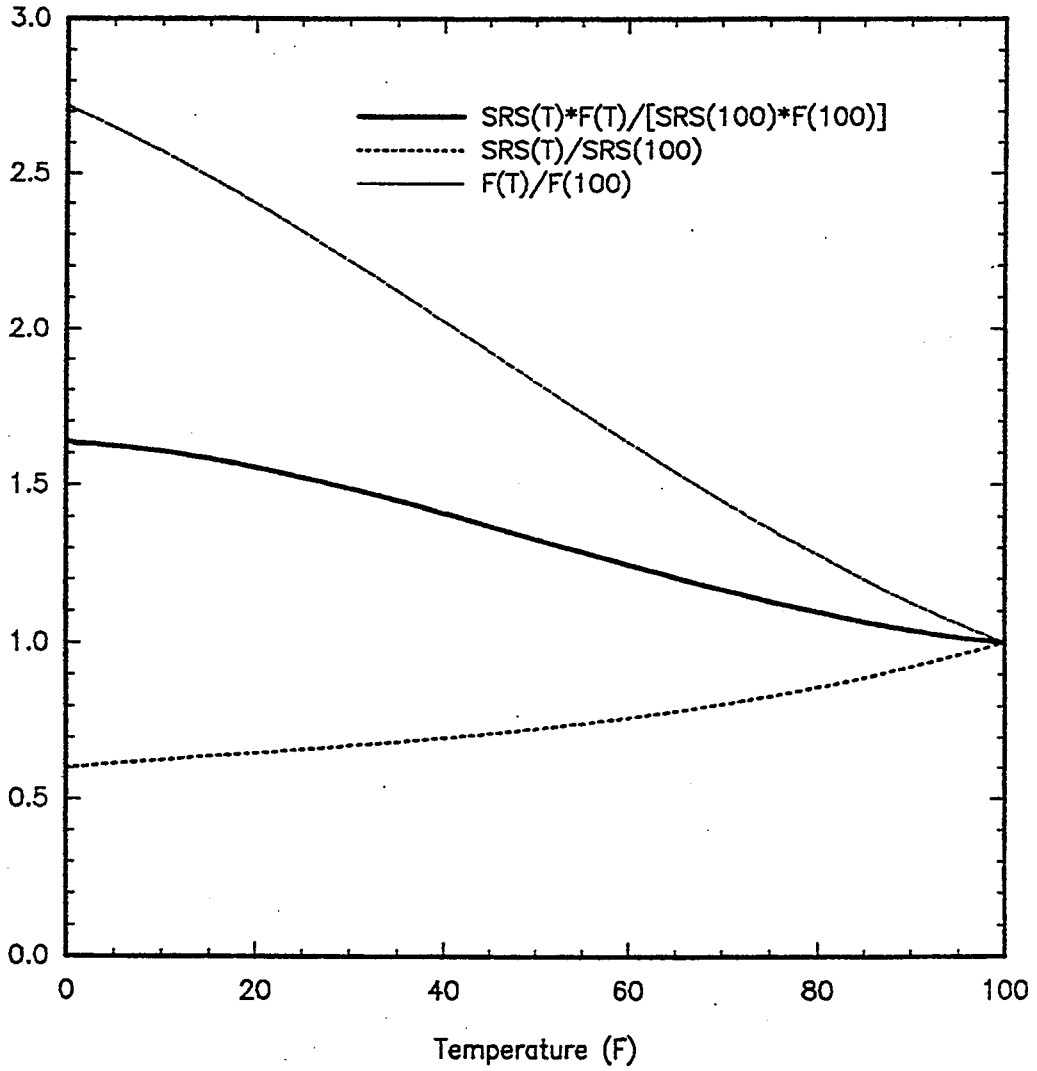
FIG. 49. Temperature Effects Under Quasi-Static and Impact Loading Conditions.

The results of the three modeling efforts described above yield the following expression for the dynamic energy dissipation capacity (DEDC) of a large diameter HMW HDPE tube under impact loading:

$$DEDC=(EDC)(SRS)$$

where SRS and EDC are given by the equations defined above. It is of interest to investigate the sensitivity of the individual component variables in this energy expression. In FIG. 47, $R^{\alpha 1}$ is plotted versus R, illustrating that the energy is relatively insensitive to a change in radius of the tube. On the other hand, the energy dissipation is a very sensitive function of tube thickness, as shown in FIG. 48. The effects of temperature change under quasi-static and impact loading conditions are shown in FIG. 49. F(T) is the variable which captures the very significant dependence of energy dissipation on temperature under quasi-static conditions. However, note how this undesirable effect is cancelled out in large measure by the strain rate sensitivity (SRS) characteristics of HMW HDPE. The result is that the energy dissipation characteristics of HMW HDPE are not severely affected by temperature changes under impact loading conditions.

Cconclusions

The feasibility of employing high molecular weight-/high density polyethylene as a reusable energy dissipation medium in highway safety appurtenances has been demonstrated. This polymer in tubular form can dissipate large amounts of kinetic energy, undergo large deformations and strains without fracturing, and essentially restore itself to its original size, shape, and energy dissipation potential when the forcing function is removed.

Some currently available impact attenuation devices have purchase prices in excess of $30,000 per installation. In addition, replacement costs for impacted systems can run into thousands of dollars per system. It is projected that HMW HDPE impact attenuation devices could be constructed for less than $10,000 each, with little or no associated repair costs. Since there are thousands of impact attenuation devices in existence, the potential future savings could run into the millions of dollars if inexpensive, reusable devices could be produced.

Although there have been described particular embodiments of the present invention of a new and useful Crash Impact Attenuator Constructed From High Molecular Weight/High Density Polyethylene, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

TABLE 1

Specimens in First Quasi-Static Test Series.

| IPS (inches) | SDR |
|---|---|
| 4 | 17 |
| 4 | 26 |

TABLE 1-continued

| Specimens in First Quasi-Static Test Series. | |
|---|---|
| IPS (inches) | SDR |
| 4 | 32.5 |
| 6 | 17 |
| 6 | 21 |
| 6 | 26 |
| 6 | 32.5 |

TABLE 2

Quasi-Static Loading to Complete Collapse.

| LOADING | SAMPLE | | % ORIG. DIA. | % PREV. DIA. |
|---|---|---|---|---|
| 1 | 4" SDR | 17 | — | — |
| | | 26 | — | — |
| | | 32.5 | — | — |
| | 6" SDR | 17 | — | — |
| | | 21 | — | — |
| | | 26 | — | — |
| | | 32.5 | — | — |
| 2 | 4" SDR | 17 | 91.3 | 91.3 |
| | | 26 | 91.1 | 91.1 |
| | | 32.5 | 89.0 | 89.0 |
| | 6" SDR | 17 | 90.8 | 90.8 |
| | | 21 | 90.0 | 90.9 |
| | | 26 | 91.3 | 91.3 |
| | | 32.5 | 90.5 | 90.5 |
| 3 | 4" SDR | 17 | 88.5 | 96.8 |
| | | 26 | 88.0 | 96.6 |
| | | 32.5 | 87.9 | 98.7 |
| | 6" SDR | 17 | 87.7 | 96.5 |
| | | 21 | 87.5 | 96.2 |
| | | 26 | 88.3 | 96.7 |
| | | 32.5 | 87.9 | 97.1 |
| 4 | 4" SDR | 17 | 87.3 | 98.7 |
| | | 26 | 86.7 | 98.5 |
| | | 32.5 | 86.1 | 98.0 |
| | 6" SDR | 17 | 86.3 | 98.5 |
| | | 21 | 86.1 | 98.4 |
| | | 26 | 86.9 | 98.4 |
| | | 32.5 | 87.3 | 99.3 |
| 5 | 4" SDR | 17 | 86.2 | 98.8 |
| | | 26 | 86.0 | 99.3 |
| | | 32.5 | 85.2 | 99.0 |
| | 6" SDR | 17 | 85.5 | 99.1 |
| | | 21 | 85.5 | 99.3 |
| | | 26 | 86.2 | 99.1 |
| | | 32.5 | 86.4 | 99.0 |

TABLE 3

Quasi-Static Loading to Half Original Diameter.

| LOADING | SAMPLE | | % ORIG. DIA. | % PREV. DIA. |
|---|---|---|---|---|
| 1 | 4" SDR | 17 | — | — |
| | | 26 | — | — |
| | | 32.5 | — | — |
| | 6" SDR | 17 | — | — |
| | | 21 | — | — |
| | | 26 | — | — |
| | | 32.5 | — | — |
| 2 | 4" SDR | 17 | 95.4 | 95.4 |
| | | 26 | 95.8 | 95.8 |
| | | 32.5 | 96.3 | 96.3 |
| | 6" SDR | 17 | 95.2 | 95.2 |
| | | 21 | 95.9 | 95.9 |
| | | 26 | 96.2 | 96.2 |
| | | 32.5 | 96.4 | 96.4 |

TABLE 3-continued

Quasi-Static Loading to Half Original Diameter.

| LOADING | SAMPLE | | % ORIG. DIA. | % PREV. DIA. |
|---|---|---|---|---|
| 3 | 4" SDR | 17 | 94.0 | 98.5 |
| | | 26 | 94.6 | 98.7 |
| | | 32.5 | 95.2 | 98.9 |
| | 6" SDR | 17 | 93.8 | 98.6 |
| | | 21 | 94.6 | 98.6 |
| | | 26 | 95.1 | 98.9 |
| | | 32.5 | 95.5 | 99.1 |
| 4 | 4" SDR | 17 | 93.2 | 99.2 |
| | | 26 | 94.1 | 99.5 |
| | | 32.5 | 94.5 | 99.3 |
| | 6" SDR | 17 | 93.1 | 99.2 |
| | | 21 | 93.7 | 99.0 |
| | | 26 | 94.4 | 99.3 |
| | | 32.5 | 94.9 | 99.4 |
| 5 | 4" SDR | 17 | 92.5 | 99.2 |
| | | 26 | 93.6 | 99.5 |
| | | 32.5 | 94.1 | 99.6 |
| | 6" SDR | 17 | 92.6 | 99.5 |
| | | 21 | 93.3 | 99.6 |
| | | 26 | 94.2 | 99.8 |
| | | 32.5 | 94.6 | 99.6 |

TABLE 4

| Large Quasi-Static Test Specimens. | |
|---|---|
| IPS (inches) | SDR |
| 24 | 17 |
| 24 | 32.5 |
| 32 | 32.5 |
| 36 | 32.5 |

What I claim is:

1. A Crash Impact Attenuator including a series of two or more cylinders, each cylinder having an axis and the cylinders positioned in adjacent relation with their axes extending substantially parallel, each cylinder attached to the cylinder(s) adjacent to it, at least one of said cylinders being attached to a roadside barrier and said cylinders supported by a substantially horizontal surface, said axes being substantially perpendicular to said surface, said cylinders manufactured from High Molecular Weight/High Density Polyethylene having a density in the range of 0.94 or higher gms/cc and a molecular weight in the range of 200,000 to 500,000.

2. The Crash Impact Attenuator as claimed in claim 1 wherein said roadside barrier is a service vehicle and the said surface is a road over which the vehicle is traveling.

3. The Crash Impact Attenuator as claimed in claim 1 wherein the cylinders are circular in cross section:

4. The Crash Impact Attenuator as claimed in claim 1 wherein the cylinders have walls with thicknesses in the range of 0.3 to 3 in. and a diameter of 1 to 10 ft.

5. A crash impact attenuator including at least one cylinder fabricated from high molecular weight/high density polyethylene having a density substantially in the range of 0.94 or higher gms/cc and a molecular weight substantially in the range of 200,000 to 500,000, wherein said at least one cylinder is connected to an impact object, said at least one Cylinder being supported by a substantially horizontal surface, and said at least one cylinder having an axis aligned substantially perpendicularly to said surface.

* * * * *